US011002478B2

(12) United States Patent
Kang

(10) Patent No.: US 11,002,478 B2
(45) **Date of Patent: *May 11, 2021**

(54) REFRIGERATOR

(71) Applicant: LG Electronics Inc., Seoul (KR)

(72) Inventor: Daekil Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/814,053

(22) Filed: Mar. 10, 2020

(65) Prior Publication Data

US 2020/0208908 A1 Jul. 2, 2020

Related U.S. Application Data

(63) Continuation of application No. 16/230,521, filed on Dec. 21, 2018, now Pat. No. 10,627,156.

(30) Foreign Application Priority Data

Dec. 29, 2017 (KR) ..... 10-2017-0183779
Mar. 26, 2018 (KR) ..... 10-2018-0034695
Jun. 18, 2018 (KR) ..... 10-2018-0069726

(51) Int. Cl.
*F25D 25/00* (2006.01)
*F25D 25/02* (2006.01)
(Continued)

(52) U.S. Cl.
CPC ..... *F25D 25/022* (2013.01); *F25D 25/025* (2013.01); *A47B 51/00* (2013.01);
(Continued)

(58) Field of Classification Search
CPC .... F25D 25/022; F25D 25/025; F25D 25/005; F25D 25/04; F25D 23/021; F25D 23/02;
(Continued)

(56) References Cited

U.S. PATENT DOCUMENTS 6,494,150 B1 12/2002 Phoenix
7,810,891 B2 * 10/2010 Lee ..... F25D 25/025 312/402
(Continued)

FOREIGN PATENT DOCUMENTS

CN 102226626 10/2011
CN 107388718 11/2017
(Continued)

OTHER PUBLICATIONS

Extended European Search Report in European Application No. 18214383.4, dated May 3, 2019, 7 pages.

*Primary Examiner* — Janet M Wilkens
(74) *Attorney, Agent, or Firm* — Fish & Richardson P.C.

(57) ABSTRACT

A refrigerator includes: a cabinet; a front panel door part; a drawer part configured to be connected to the front panel door part and to insert into and withdraw from the cabinet based on movement of the front panel door part relative to the cabinet; a support member located in the drawer part and configured to seat an object stored in the drawer part; and an elevation device that is located at each of a first side surface of the drawer part and a second side surface of the drawer part, that is configured to be coupled to each of a first side of the support member and a second side of the support member, and that is configured to elevate the support member relative to the drawer part in a state in which the drawer part is withdrawn from a lower storage space defined in the cabinet.

19 Claims, 60 Drawing Sheets

(51) Int. Cl.
*F25D 25/04* (2006.01)
*A47B 51/00* (2006.01)
*F25D 23/02* (2006.01)

(52) U.S. Cl.
CPC ..... *F25D 23/021* (2013.01); *F25D 25/005* (2013.01); *F25D 25/04* (2013.01)

(58) Field of Classification Search
CPC ..... F25D 25/02; F25D 25/05; F25D 23/067; F25D 23/087; F25D 23/028; F25D 29/005; A47B 51/00; A47B 21/02; A47B 2220/0013; A47B 9/12; A47B 2021/006
USPC .. 312/404, 408, 402, 319.5–319.8, 306, 312
See application file for complete search history.

(56) References Cited

U.S. PATENT DOCUMENTS 8,827,390 B2 9/2014 Wehner
9,107,494 B2 * 8/2015 Scheuring ..... A47B 51/00
10,598,428 B2 * 3/2020 Kim ..... F25D 23/021
10,627,156 B2 * 4/2020 Kang ..... F25D 25/022
10,648,727 B2 * 5/2020 Kim ..... F25D 25/025
2006/0021373 A1 * 2/2006 Oh ..... F25D 25/025 62/407
2006/0022564 A1 2/2006 Oh
2006/0091295 A1 * 5/2006 Staples ..... H03K 17/97 250/214 SW
2008/0018215 A1 1/2008 Carden
2009/0322470 A1 * 12/2009 Yoo ..... E05F 15/635 340/3.1
2010/0236280 A1 9/2010 Eom et al.
2011/0050065 A1 3/2011 Lee
2011/0181163 A1 * 7/2011 Han ..... F25D 23/04 312/405
2012/0319552 A1 12/2012 Donmez
2014/0265797 A1 9/2014 Scheuring
2014/0265798 A1 * 9/2014 Watts ..... F25D 23/04 312/404
2014/0313331 A1 * 10/2014 Kim ..... F25D 29/00 348/143
2018/0128540 A1 * 5/2018 Yasaka ..... B66F 7/28
2018/0259246 A1 * 9/2018 Choi ..... F25D 25/025
2019/0293341 A1 * 9/2019 Yeom ..... F25D 23/006
2019/0293345 A1 * 9/2019 Kim ..... E05C 7/06
2019/0346199 A1 * 11/2019 Choi ..... F25D 23/04
2020/0072533 A1 * 3/2020 Cho ..... E05C 7/005

FOREIGN PATENT DOCUMENTS

EP 1621836 2/2006
EP 1621838 2/2006
EP 1653181 5/2006
EP 3546866 * 10/2019
EP 3567327 * 11/2019
JP H05296647 11/1993
KR 20060031113 4/2006
KR 20060053420 5/2006
KR 20080101335 11/2008

* cited by examiner

REFRIGERATOR

CROSS-REFERENCE TO RELATED APPLICATIONS

The present application is a continuation of U.S. application Ser. No. 16/230,521, filed on Dec. 21, 2018, which claims priority under 35 U.S.C. 119 and 35 U.S.C. 365 to Korean Patent Applications No. 10-2017-0183779, filed on Dec. 29, 2017, No. 10-2018-0034695, filed on Mar. 26, 2018, and No. 10-2018-0069726, filed on Jun. 18, 2018, which are hereby incorporated by reference in their entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door for opening and closing the storage space.

The refrigerator door may be classified into a rotation-type door that opens and closes a storage space through rotation thereof and a drawer-type door that is inserted and withdrawn in a drawer type.

Also, the drawer-type door is often disposed in a lower region of the refrigerator. Thus, when the drawer-type door is disposed in the lower region of the refrigerator, a user has to turn its back to take out a basket or foods in the drawer-type door. If the basket or the foods are heavy, the user may feel inconvenient to use the basket or may be injured.

In order to solve such a limitation, various structures are being developed in which the drawer-type door is capable of being elevated.

Representatively, a structure provided with an elevatable storage container on a rear surface of a withdrawable door is disclosed in Korean Patent Publication No. 10-2008-0101335. However, in this structure, a connection portion between the door and the storage container may be exposed, and electrical devices and structures for the elevation may be exposed to cause serious problems of safety in use.

In addition, force for the elevation is substantially applied to a front end of the storage container. Also, when foods are stored in the accommodation container, it is difficult to perform stable elevation of the accommodation container due to an eccentric load applied to the storage container, and serious deformation and breakage of the door and the storage container may occur.

Also, a structure in which a basket is elevated by an operation of a support member provided on a door is disclosed in Korean Patent Publication No. 10-2006-0053420. In this structure, a support member is exposed directly from a rear surface and a bottom surface of the door to cause problems in safety in use.

Also, a structure for lifting a basket is provided on a front surface of the door. Thus, if a load exists at a lower portion of the basket, the basket may be separated. Thus, it is difficult to provide an effective and stable supporting and elevating structure.

Also, a structure in which a fixed frame and a movable frame are disposed on a rear surface of a door, and a pneumatic cylinder is provided on each of both sides of the fixed frame to elevate a basket by elevating the movable frame fixed to the basket is disclosed in Korean Patent Publication No. 10-2006-0031113.

However, if the pneumatic cylinder disposed on each of both the sides is not accurately controlled, the basket may be tilted. Particularly, when an eccentric load is applied to the basket, the basket may not be elevated due to the eccentricity of the basket.

Also, in this structure, since the pneumatic cylinder is exposed to each of both left and right sides, there may also be safety issues. In addition, a volume within the basket may be reduced by the pneumatic cylinder and the movable frame, which are disposed on each of both the sides.

Also, according to the related art, the basket having the accommodation space or the entire structures corresponding to the basket are elevated. In this structure, the load may be eccentric according to the arrangement of the foods in the accommodation space. Thus, when being elevated, an unbalance may occur.

Also, the basket has to be completely withdrawn from the accommodation space within the refrigerator so as to elevate the entire basket. Also, the insertion and the withdrawal of the basket may be unstable due to an increase in a draw-out distance of the entire door including the basket, and thus, a reinforcement structure such as a rail for supporting the door may be required. Particularly, such a limitation may be exacerbated when the structures for the elevation are provided on the door side.

SUMMARY

Embodiments provide a refrigerator in which a portion within a drawer door, which is withdrawn in a drawer type, is elevated to improve user's convenience in use.

Embodiments also provide a refrigerator in which an elevation assembly for elevating a support member on which a food is seated in a drawer-type door is provided on each of both sides of the drawer-type door to elevate the support member without being tilted and improve safety in use and operation reliability.

Embodiments also provide a refrigerator in which an electrical device for elevation is disposed in a front panel door part of a drawer door, and a mechanism part connected to the electrical device and elevated is disposed in a drawer part to improve safety.

Embodiments also provide a refrigerator in which an electrical device for elevation and a mechanism part are not generally exposed to the outside to improve an outer appearance and safety in use.

Embodiments also provide a refrigerator in which a drawer part in which a mechanism part is disposed and a front panel door part in which an electrical device is disposed are coupled to be selectively separated from each other and thereby to improve assembling workability, cleanability, and serviceability.

Embodiments also provide a refrigerator in which elevation is performed in a state in which only a portion of a front portion of a drawer part of a drawer is exposed without withdrawing an entire drawer part to perform the elevation in a stable withdrawal state.

Embodiments also provide a refrigerator in which an elevation assembly for elevating a support member is provided on each of both sides of the support member and coupled to a central portion of each of both the sides of the support member to secure stable elevation operation of the support member.

Embodiments also provide a refrigerator which has a structure in which a support member is elevated while minimizing a loss of a storage space within a drawer door.

Embodiments also provide a refrigerator in which a structure for elevation is minimally exposed to realize a neat and elegant outer appearance.

Embodiments also provide a refrigerator which has a structure capable of covering an elevation assembly disposed on each of both sides so as to elevate a support member, thereby improving an outer appearance and safety.

Embodiments also provide a refrigerator in which a shaft transmitting power for elevating a support member and a guide rail guiding the elevation are provided to realize a stable elevation operation.

Embodiments also provide a refrigerator in which a rail and a shaft, which are disposed to elevate a support member, are covered to secure safety in use and improve an outer appearance.

Embodiments also provide a refrigerator in which an elevation assembly is disposed on each of both sides to elevate a support member, and a mounted structure of an elevation assembly is covered to improve an outer appearance and safety.

According to one aspect of the subject matter described in this application, a refrigerator includes: a cabinet that defines an upper storage space and a lower storage space; a front panel door part that is configured to open and close the lower storage space and that is configured to move toward and away from the lower storage space; a drawer part that is configured to be connected to the front panel door part, that is configured to insert into the lower storage space based on the front panel door part moving toward the lower storage space, and that is configured to withdraw from the lower storage space based on the front panel door part moving away from the lower storage space; a support member located in the drawer part and configured to seat an object stored in the drawer part; and an elevation device that is located at each of a first side surface of the drawer part and a second side surface of the drawer part, that is configured to be coupled to each of a first side of the support member and a second side of the support member, and that is configured to elevate the support member relative to the drawer part in a state in which the drawer part is withdrawn from the lower storage space.

Implementations according to this aspect may include one or more of the following features. For example, the drawer part may include a bottom surface, where the first side surface and the second side surface of the drawer part vertically extend from a first side end portion of the bottom surface and a second side end portion of the bottom surface, respectively. In some implementations, the drawer part includes a mounting part recessed from an inner surface of the drawer part and configured to accommodate the elevation device.

In some implementations, the drawer part is configured to partition an inside of the drawer part into (i) a front space that is configured to be exposed outside of the lower storage space based on the drawer part being withdrawn, and (ii) a rear space that is located rearward of the front space, where the support member has a size corresponding to a size of the front space. In these implementations, the first side surface and the second side surface of the drawer part include side surfaces of the front space, respectively, and the elevation device is located each of the side surfaces of the front space.

In some examples, the drawer part includes a drawer cover located in the drawer part. The drawer cover may include: a cover front surface part that is configured to partition the inside of the drawer part into the front space and the rear space; and a cover top surface part that extends from an upper end of the cover front surface part to a rear end of the drawer part and that is configured to cover a top surface of the rear space.

In some implementations, the refrigerator further includes a motor assembly that is located in the front panel door part, that is configured to generate power to provide a rotational force to the elevation device, where the elevation device is configured to be elevated by the rotational force transmitted from the motor assembly. In some examples, the refrigerator further includes: a door-side shaft that is located at the front panel door part, that is connected to the motor assembly, and that extends from the motor assembly to a first lateral side of the front panel door part and to a second lateral side of the front panel door part; and at least one drawer-side shaft that connects the door-side shaft to the elevation device and that includes (i) a first drawer-side shaft located at a first side of the drawer part, and (ii) a second drawer-side shaft located at a second side of the drawer part. In these implementations, the at least one drawer-side shaft is configured to simultaneously transmit (i) a first rotational force of the motor assembly from the door-side shaft to the elevation device at the first side surface of the drawer part, and (ii) a second rotational force from the door-side shaft to the elevation device at the second side surface of the drawer part, where a magnitude of the first rotational force is equal to a magnitude of the second rotational force.

In some examples, each of the at least one drawer-side shaft includes: a first end portion that is configured to engage with the door-side shaft by angled gear-coupling to receive rotational power from a rotation of the door-side shaft; and a second end portion that is configured to engage with the elevation device by angled gear-coupling to transmit the rotational power received from the door-side shaft to the elevation device. In some examples, the refrigerator further includes: at least one door-side connection member that is arranged at a rear surface of the front panel door part and that is configured to be connected to the door-side shaft; and at least one drawer-side connection member that is arranged at a front surface of the drawer part and that is configured to be connected to the at least one drawer-side shaft. In these examples, the at least one door-side connection member and the at least one drawer-side connection member are configured to: couple to each other based on the front panel door part and the drawer part being coupled to each other; and decouple from each other based on the front panel door part and the drawer part being decoupled from each other.

In some implementations, the elevation device includes: a pair of elevation shafts rotatably mounted on the first side surface of the drawer part and the second side surface of the drawer part, respectively, where each elevation shaft extends along a vertical direction and defines a screw thread on an outer surface thereof; at least one elevation shaft holder that is penetrated by the pair of elevation shafts and that is configured to move in the vertical direction along a length of each of the pair of elevation shafts based on rotations of the pair of elevation shafts; at least one elevation rail disposed in parallel to the pair of elevation shafts at an inner surface of the drawer part, each of the at least one elevation rail including multistage sliding rails that are configured to expand and contract based on the at least one elevation shaft holder moving along the length of the pair of shafts; and at least one connecting bracket to which the at least one elevation shaft holder and the at least one elevation rail are configured to couple, the at least one connecting bracket configured to be fixed to each of the first side of the support member and the second side of the support member. In these implementations, the at least one elevation shaft holder is configured to elevate the at least one connecting bracket to cause the support member to elevate, and the at least one elevation rail is configured to guide a movement of the at least one connecting bracket in the vertical direction.

In some examples, the refrigerator further includes at least one side cover that is located at each of the first side and the second side of the support member, that is configured to cover the pair of elevation shafts and the at least one elevation rail, and that is configured to be elevated based on elevation of the support member.

In some implementations, the elevation device includes: a housing configured to couple to an inner surface of the drawer part; an elevation shaft that is located inside of the housing, that is configured to be rotated by power transmitted from a motor assembly, and that defines a screw thread at an outer circumferential surface thereof; a shaft holder that is located inside of the housing, that is configured to be penetrated by the elevation shaft, and that is configured to move in a vertical direction along a length of the elevation shaft based on rotation of the elevation shaft; and a connecting bracket that connects each of the first side of the support member and the second side of the support member to the shaft holder.

In some examples, the housing includes: a side part that is bent from each of both sides of the housing and that is configured to accommodate each of both sides of the shaft holder; and a housing opening defined between ends of the side part and configured to expose each of a portion of the elevation shaft and a portion of the shaft holder therethrough. In some examples, the shaft holder includes: a shaft through-part that defines a through-hole through which the elevation shaft passes; a side surface extension part that extends from both sides of the shaft through-part; a rolling member mounted to the side surface extension part and configured to contact an inner surface of the side part of the housing; and a bracket mounting part that protrudes through the housing opening and that is configured to connect to the support member.

In some examples, the shaft holder defines a holder space that extends through an inside of the shaft holder in the vertical direction, where the elevation device includes a rail cover having a plate shape, the rail cover being configured to cover the housing opening in a state in which the rail cover is inserted to the holder space and passes through the holder space, where the shaft holder is configured to move in the vertical direction along the rail cover in the state in which the rail cover is inserted to the holder space and passes through the holder space. In some examples, the connecting bracket includes: a rail coupling part configured to couple to the shaft holder; and a support member coupling part located at an end of the rail coupling part and configured to detachably couple to a side surface of the support member.

In some implementations, the drawer part includes at least one plate that is made of a metal material and that defines at least one of an outer appearance of the drawer part, an inner surface of the drawer part, or an outer surface of the drawer part, where at least the one plate is configured to cover the elevation device located at the drawer part and a draw-out rail located at the outer surface of the drawer part and configured to guide insertion and withdrawal of the drawer part.

In some implementations, the drawer part includes an elevation guide part through which the support member coupling part passes, where the elevation guide part protrudes to an inside of the drawer part, extends in the vertical direction, and allows the support member coupling part to move in the vertical direction.

In some examples, the connecting bracket protrudes inward from each of the first side surface of the drawer part and the second side surface of the drawer part, the connecting bracket being configured to detachably seat the support member. In some examples, the support member includes: a support plate that has a plate shape, that is configured to cover a lower side of the drawer part, and that is configured to seat the object stored in the drawer part; and a support frame configured to couple to the connecting bracket and configured to support the support plate at a lower side of the support plate. In these examples, the support plate is configured to be separated upward from the drawer part in a state in which the connecting bracket and the support frame are coupled to each other.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
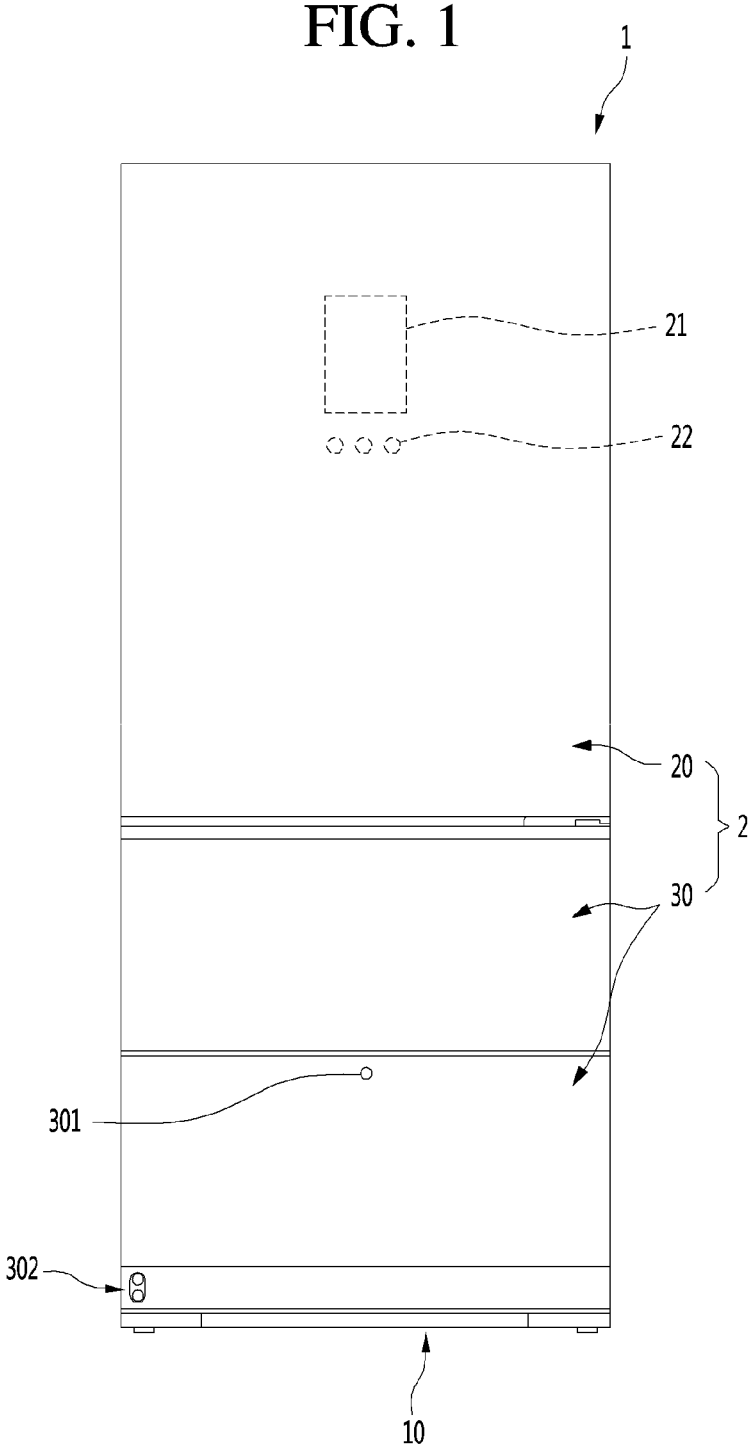
FIG. 1 is a front view of a refrigerator according to a first embodiment.

FIG. 1 is a front view of a refrigerator according to a first embodiment.

As illustrated in the drawing, the refrigerator 1 may have an outer appearance that is defined by a cabinet 10 defining a storage space and a door 2 covering an opened front surface of the cabinet 10.

The storage space of the cabinet 10 may be divided into a plurality of spaces. For example, an upper space of the cabinet 10 may be provided as a refrigerating compartment, and a lower space of the cabinet 10 may be provided as a freezing compartment. Each of the upper space and the lower space may be provided as an independent space that is maintained at a different temperature, except for the refrigerating compartment and the freezing compartment. The upper space and the lower space may be called an upper space and a lower space.

The door 2 may be constituted by a rotation door 20 opening and closing the upper space through rotation thereof and a drawer door 30 opening and closing the lower space by being inserted or withdrawn in a drawer type. The lower space may be vertically divided again. The drawer door 30 may be constituted by an upper drawer door 30 and a lower drawer door 30. Also, an outer appearance of each of the rotation door 20 and the drawer door 30 may be made of a metal material and be exposed to the front side.

Although the refrigerator in which all of the rotation door 20 and the drawer door 30 are provided is described, the present disclosure is not limited thereto. For example, the present disclosure may be applied to all refrigerators including a door that is inserted and withdrawn in the drawer type.

A display 21 may be disposed on one side of a front surface of the rotation door 20. The display 21 may have a liquid crystal display structure such as a multi-segment display (e.g., an "88" shape segment structure or a seven segment display). Also, when the outer appearance of the door 2 is made of the metal material, a plurality of fine holes are punched in the display 21 to display information by using light passing therethrough.

Also, a manipulation part 22 that is capable of manipulating automatic rotation or withdrawal of the upper door 2 or the lower door 2 may be provided on one side of the rotation door 20. The manipulation part 22 may be integrated with the display 21 and may operate in a touch manner or a button manner. The manipulation part 22 may input an overall operation of the refrigerator 1 and manipulate an insertion and withdrawal of the drawer door 30 or an elevation of a support member 35 within the drawer door.

A manipulation part 301 may also be provided on the drawer door 30. The manipulation part 301 may be disposed on one side of the drawer door 30 that is disposed at the lowermost portion of the drawer door 30. The manipulation part 301 may operate in a touch or button manner. The manipulation part 301 may be provided as a sensor detecting proximity or movement of a user or provided as an input unit that operates by a user's motion or voice.

As illustrated in the drawing, a manipulation device 302 may be disposed on a lower end of the lower drawer door 30 to illuminate an image on a bottom surface and thereby to output a virtual switch and to input an operation in such a manner that the user approaches a corresponding area.

The lower drawer door 30 may be automatically inserted and withdrawn according to the manipulation of the manipulation part 301. Also, a food or container within the lower drawer door 30 may be elevated in a state in which the drawer door 30 is withdrawn by the manipulation of the manipulation part 301.

That is, the automatic insertion and withdrawal and/or automatic elevation of the lower drawer door 30 may be performed by at least one of a plurality of manipulation devices 22, 301, and 302. As necessary, only one of the plurality of manipulation devices 22, 301, and 302 may be provided.

Hereinafter, the lower drawer door will be described in more detail, and also, the lower drawer door will be called a drawer door unless otherwise specified.

Figure 2:
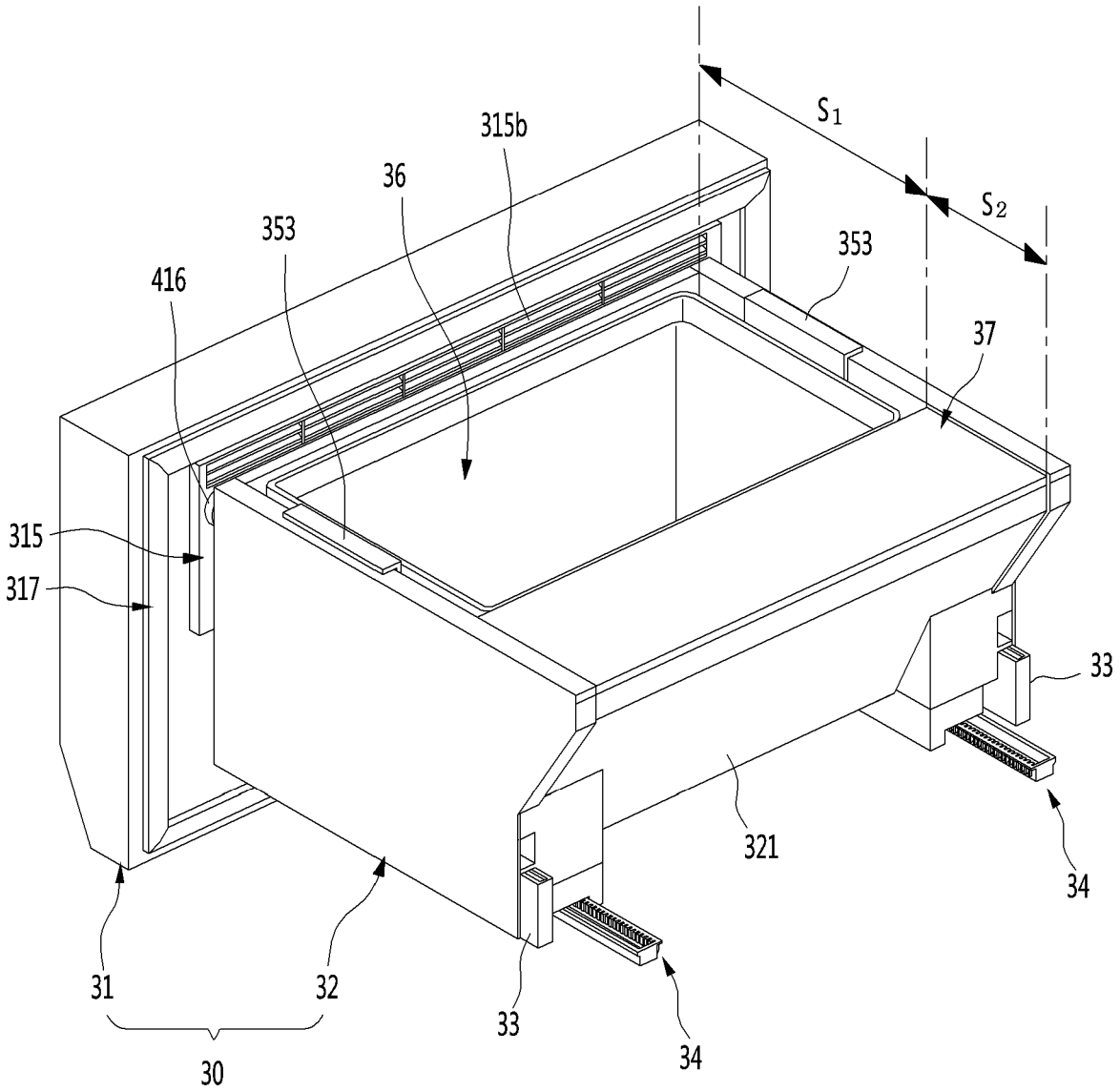
FIG. 2 is a perspective view of a drawer door according to a first embodiment.
Figure 3:
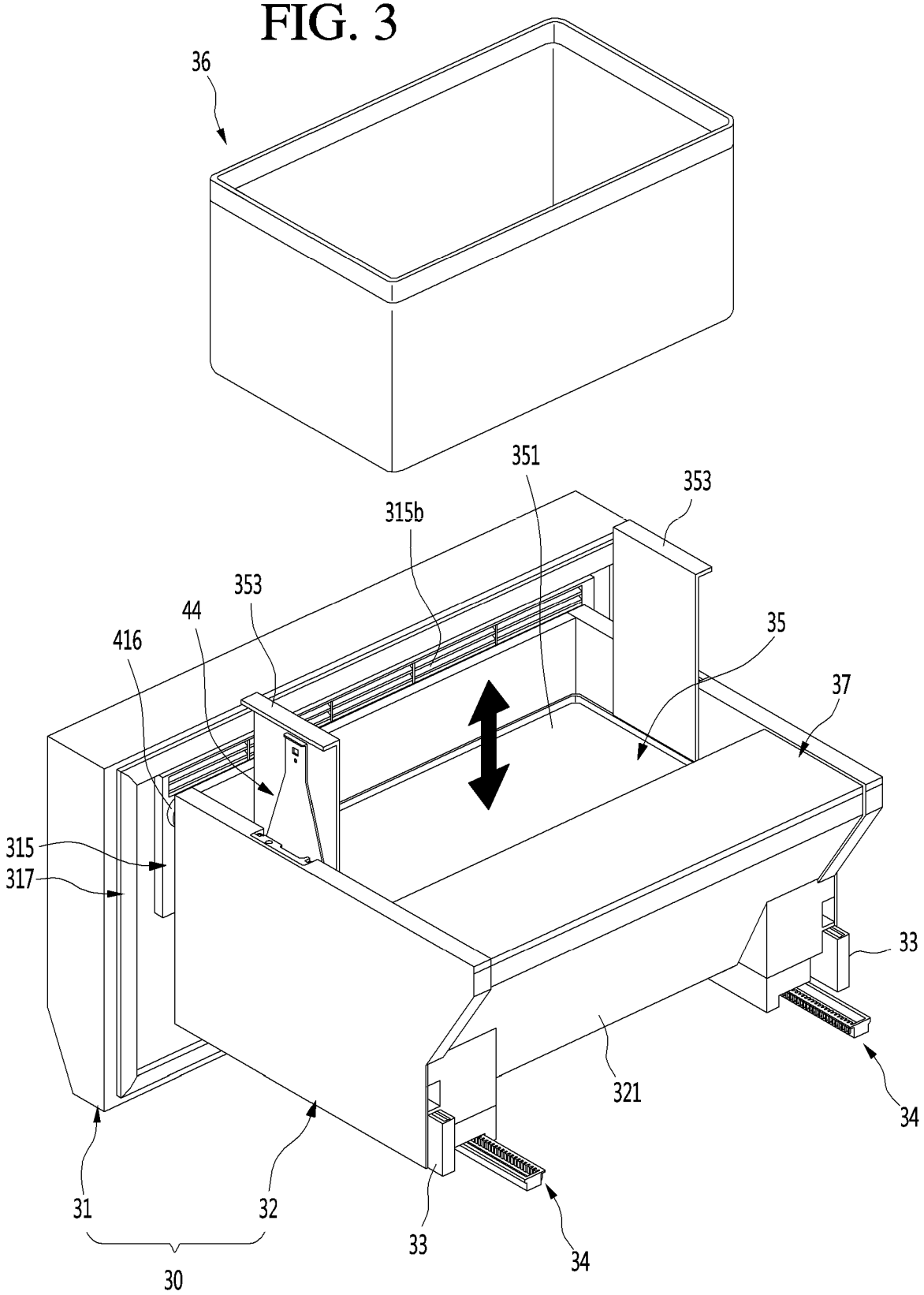
FIG. 3 is a perspective view illustrating a state in which a container of the drawer door is separated.

FIG. 2 is a perspective view of a drawer door according to a first embodiment. Also, FIG. 3 is a perspective view illustrating a state in which the container of the drawer door is separated.

As illustrated in the drawings, the drawer door 30 may include a front panel door part 31 opening and closing the storage space and a drawer part 32 coupled to a rear surface of the front panel door part 31 and inserted and withdrawn together with the front panel door part 31.

The front panel door part 31 may be exposed to the outside of the cabinet 10 to define an outer appearance of the refrigerator 1, and the drawer part 32 may be disposed inside the cabinet 10 to define an storage space. Also, the front panel door part 31 and the drawer part 32 may be coupled to each other and inserted and withdrawn forward and backward together with each other.

The drawer part 32 may be disposed on the rear surface of the front panel door part 31 to define a space in which the food or container 36 to be stored is accommodated. The inside of the drawer part 32 may have a box shape having an opened top surface to define the accommodation space therein.

The drawer part 32 may be constituted by both left and right surface parts for mounting of the elevation device (see reference numeral 51 of FIG. 7) and a bottom surface part connecting both the left and right surface parts to each other to define a bottom surface and also may selectively include a front surface part and a rear surface part.

An outer appearance of the drawer part 32 may be defined by a plurality of plates 391, 392, and 395. Each of the plurality of plates 391, 392, and 395 may be made of a metal material and provided inside and outside the drawer part 32 so that the entire drawer part 32 is made of stainless steel or a material having a texture such as stainless steel.

In the state in which the drawer door 30 is inserted, a machine room 3 in which a compressor and a condenser constituting a refrigeration cycle are provided may be disposed behind the drawer door 30. Thus, a rear end of the drawer part 32 may have a shape of which an upper end further protrudes from a lower end, and an inclined surface 321 may be provided on a rear surface of the drawer part 32.

Also, a draw-out rail 33 guiding the insertion and withdrawal of the drawer door 30 may be provided on each of both side surfaces of the drawer part 32. The drawer door 30 may be mounted to be inserted into or withdrawn from the cabinet 10 by the draw-out rail 33. The draw-out rail 33 may be covered by an outer side plate 391 and thus may not be exposed to the outside. The draw-out rail 33 may have a rail structure that is capable of extending in multistage.

Also, the draw-out rail 33 may be provided on a lower end of each of both the side surfaces of the drawer part 32. Thus, it may be understood that the draw-out rail 33 is disposed on the bottom surface of the drawer part 32. Thus, the draw-out rail 33 may be provided on the bottom surface of the drawer part 32 and called an under rail. The draw-out rail may be disposed on a lower portion or the bottom surface of the drawer part to prevent the draw-out rail from interfering with the drawer-side device 43 (may be called an elevation device) and secure independent operations of the draw-out rail 33 and the drawer-side device 42.

A draw-out rack 34 may be disposed on the bottom surface of the drawer part 32. The draw-out rack 34 may be disposed on each of both sides and be interlocked with an operation of a draw-out motor 14 mounted on the cabinet 10 to automatically insert and withdraw the drawer door 30. That is, when an operation is inputted into the manipulation parts 22 and 301, the draw-out motor 14 may be driven to insert and withdraw the drawer door 30 according to movement of the draw-out rack 34. Here, the drawer door 30 may be stably inserted and withdrawn by the draw-out rail 33.

The draw-out rack 34 may not be provided on the drawer part 32. Here, the user may hold a side of the front panel door part 31 to push and pull the front panel door part 31 so that the drawer door 30 is directly inserted and withdrawn.

The inside of the drawer part 32 may be divided into a front space S1 and a rear space S2. The support member 35 that is vertically elevated and a container seated on the support member 35 to be elevated together with the support member 35 may be disposed in the front space S1. Although the container 36 is illustrated in the form of a basket having an opened upper portion, the container 36 may have a closed box structure such as a kimchi box. Also, a plurality of containers 36 may be stacked or arranged in parallel to each other.

Also, when the drawer door 30 is withdrawn, the entire drawer part 32 may not be withdrawn to the outside of the storage space due to a limitation in draw-out distance of the drawer door 30. That is, at least the front space S1 is withdrawn to the outside of the storage space, and the whole or a portion of the rear space S2 is disposed inside the storage space within the cabinet 10, i.e., in the lower storage space.

The draw-out distance of the drawer door may be limited by the draw-out rack 34 or the draw-out rail 33. Also, when compared with a draw-out distance of the general drawer door 30 in which the drawer part 32 is completely withdrawn, the draw-out distance according to this embodiment may be relatively short. Thus, when compared with a case in which the drawer part 32 is completely withdrawn to the outside of the lower storage space, acting moment may be reduced to prevent the draw-out rail 33 or the draw-out rack 34 from being deformed or damaged by a load of the drawer door.

The support member 35 is accommodated in the front space S1. The support member 35 may be elevated together with the food or container 36 seated on the support member 35 inside the drawer part 32. Also, constituents for the elevation of the support member 35 may be disposed on both left and right surfaces of the drawer part 32 and coupled to a central point of both side surfaces of the support member 35 to fix the support member 35 to be elevated without allowing the support member to be lean to one side.

A separate drawer cover 37 may be provided in the rear space S2. The front space S1 and the rear space S2 may be partitioned by the drawer cover 37. In a state in which the drawer cover 37 is mounted, front and top surfaces of the rear space S2 may be covered.

Thus, the food or container 36 accommodated in the support member 35 that is elevated in the front space S1 may be prevented from dropping into the rear space. Particularly, in the elevation process, the food or container 36 seated on the support member 35 may be prevented from being separated from the front space S1.

When the drawer cover 37 is separated, the user may be accessible to the rear space S2, and thus, foods may be easily accommodated in the rear space S2. To utilize the rear space S2, a separate structure for accommodating may be provided in the rear space S2.

Figure 4:
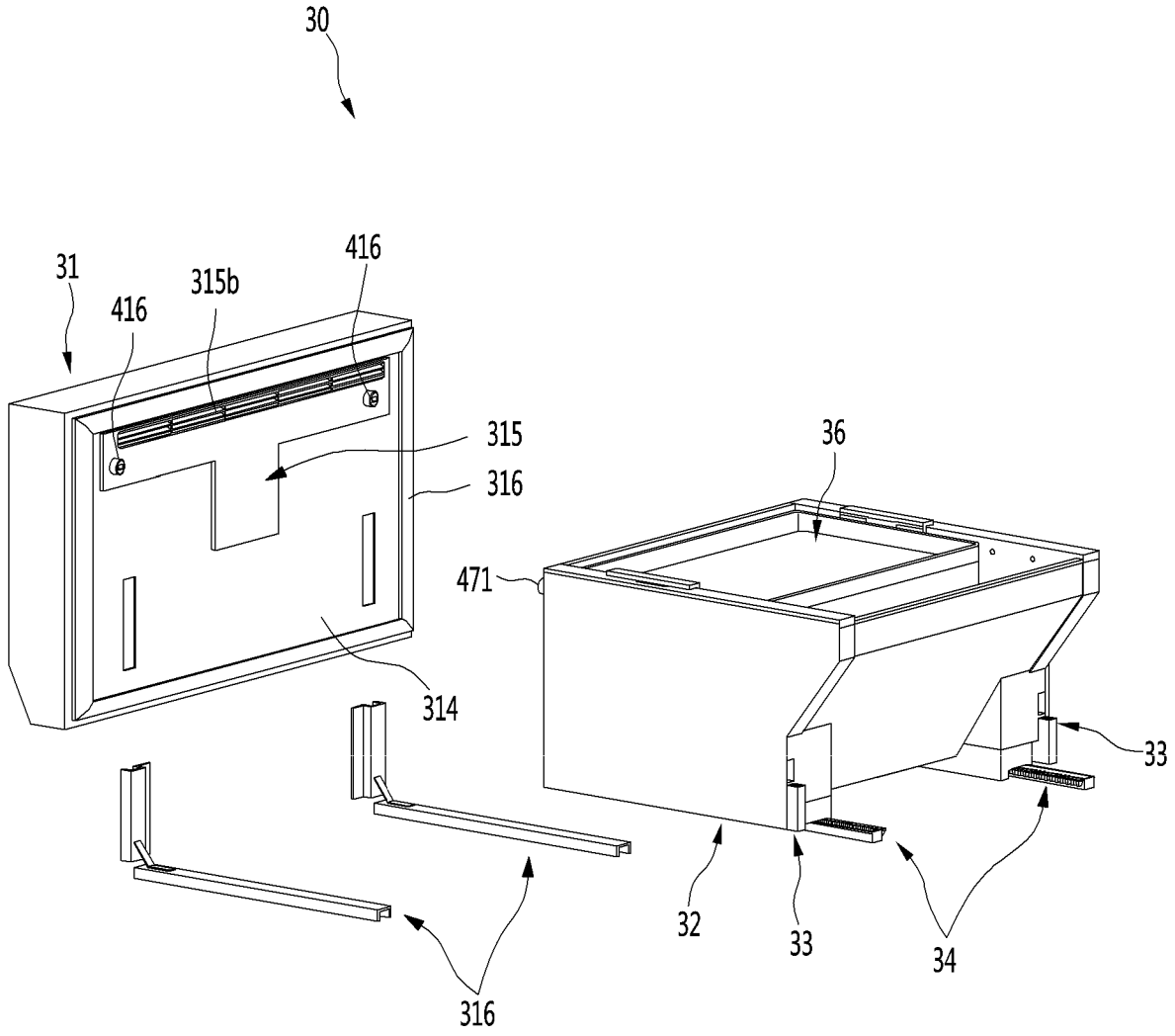
FIG. 4 is an exploded perspective view illustrating a state in which a drawer part of the drawer door and a front panel door part are separated from each other when viewed from a rear side.
Figure 5:
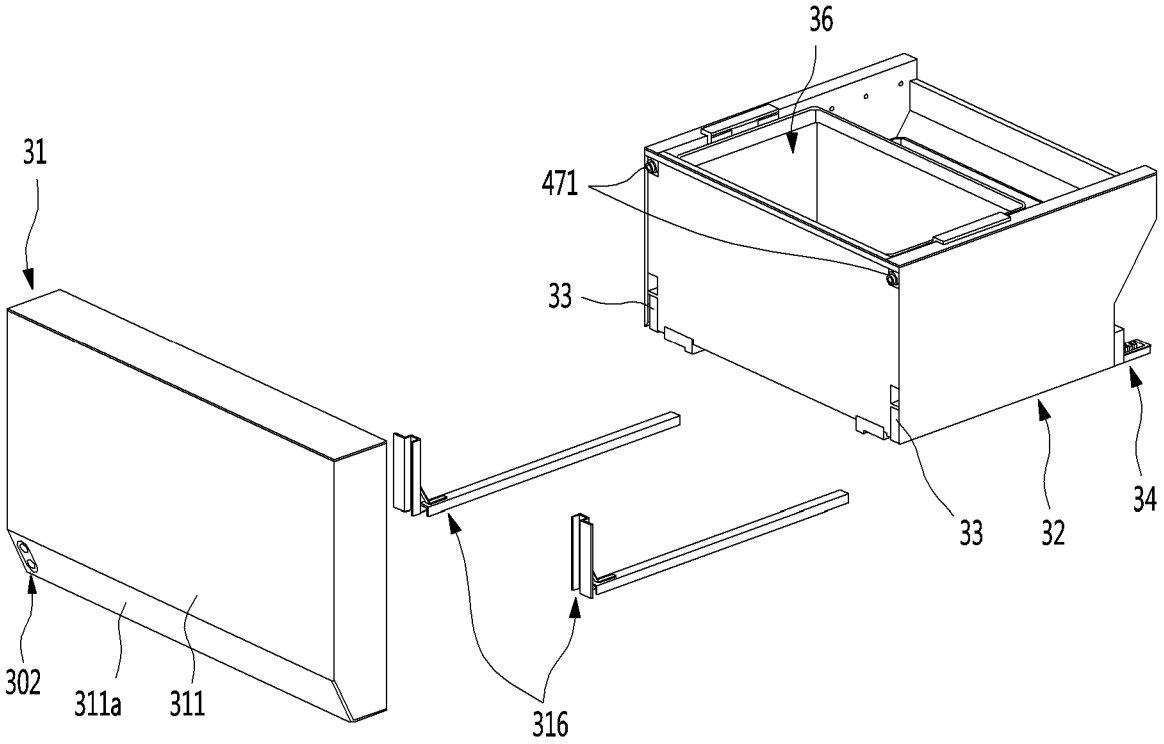
FIG. 5 is an exploded perspective view illustrating a state in which the drawer part of the drawer door and the front panel door part are separated from each other when viewed from a front side.

FIG. 4 is an exploded perspective view illustrating a state in which the drawer part of the drawer door and the front panel door part are separated from each other when viewed from a rear side. FIG. 5 is an exploded perspective view illustrating a state in which the drawer part of the drawer door and the front panel door part are separated from each other when viewed from a front side.

As illustrated in the drawings, the front panel door part 31 and the drawer part 32 constituting the drawer door 30 may be coupled to be separated from each other. Thus, assembling workability and serviceability may be improved through the separable structure of the front panel door part 31 and the drawer part 32.

A rear surface of the front panel door part 31 and a front surface of the drawer part 32 may be coupled to each other. When the front panel door part 31 and the drawer part 32 are coupled to each other, power for the elevation of the support member 35 may be provided. The elevation assembly 40 for the elevation of the support member 35 may be disposed on each of the front panel door part 31 and the drawer part 32. When the front panel door part 31 and the drawer part 32 are coupled to or separated from each other, the elevation assembly may be selectively connected.

For this, the elevation assembly 40 may be constituted by the door-side device 41 disposed in the front panel door part 31 and the drawer-side device 42 disposed in the drawer part 32.

The door-side device 41 may be called a driving device that generates power for driving the drawer-side device 42. Also, the drawer-side device 42 may have a mechanism structure that is elevated by the power transmitted by the door-side device 41 and thus be called an elevation device.

The door-side device 41 may be provided in the front panel door part 31, and a door connection member 416 that is one component of the door-side device 41 may be exposed to the rear surface of the front panel door part 31. Also, the drawer-side device 42 may be provided in the drawer part 32, and a drawer connection member 471 disposed at a position corresponding to the door connection member 416 may be exposed to the front surface of the drawer part 32. The door connection member 416 and the drawer connection member 471 may have shapes corresponding to each other and be coupled to be separated from each other. When the door connection member 416 and the drawer connection member 522 are coupled to each other, power may be transmitted. When the front panel door part 31 is fixed to the drawer part 32, the door connection member 416 and the drawer connection member 522 may be coupled to each other. When the front panel door part 31 is separated from the drawer part 32, the door connection member 416 and the drawer connection member 522 may be separated from each other.

That is, a protrusion 471*a* and a groove 416*a* may be provided on the door connection member 416 and the drawer connection member 471, respectively. The protrusion 471*a* and the groove 416*a* may have a polygonal shape or a shape that is capable of transmitting the power and be interlocked with each other. The door connection member 416 and the drawer connection member 417 may have a different coupling structure in which the power is capable of being transmitted and detachable.

Also, an elevation motor 411 serving as a power source of the elevation assembly 40 may be provided in the front panel door part 31. Also, a door cover 315 may be disposed above a space in which the elevation motor 411 is provided. The door cover 315 may be disposed on the rear surface of the front panel door part 31 to cover the door-side device 41 including to the elevation motor 411 provided in the front panel door part 31.

That is, the door-side device 41 including the elevation motor 411 and the door connection member 416 may be mounted on the rear surface of the front panel door part 31 and then covered by the door cover 315 to assemble the front panel door part 31. The door cover 315 may be configured to cover the entire rear surface of the front panel door part 31 or cover only an area corresponding to the door-side device 41.

Also, a pair of door frames 316 may be disposed on the rear surface of the door 2. The coupled state of the front panel door part 31 and the drawer part 32 may be maintained by the door frames 316.

Hereinafter, the front panel door part 31 and the drawer part 32 constituting the drawer door 30 will be described in more detail with reference to the drawings.

Figure 6:
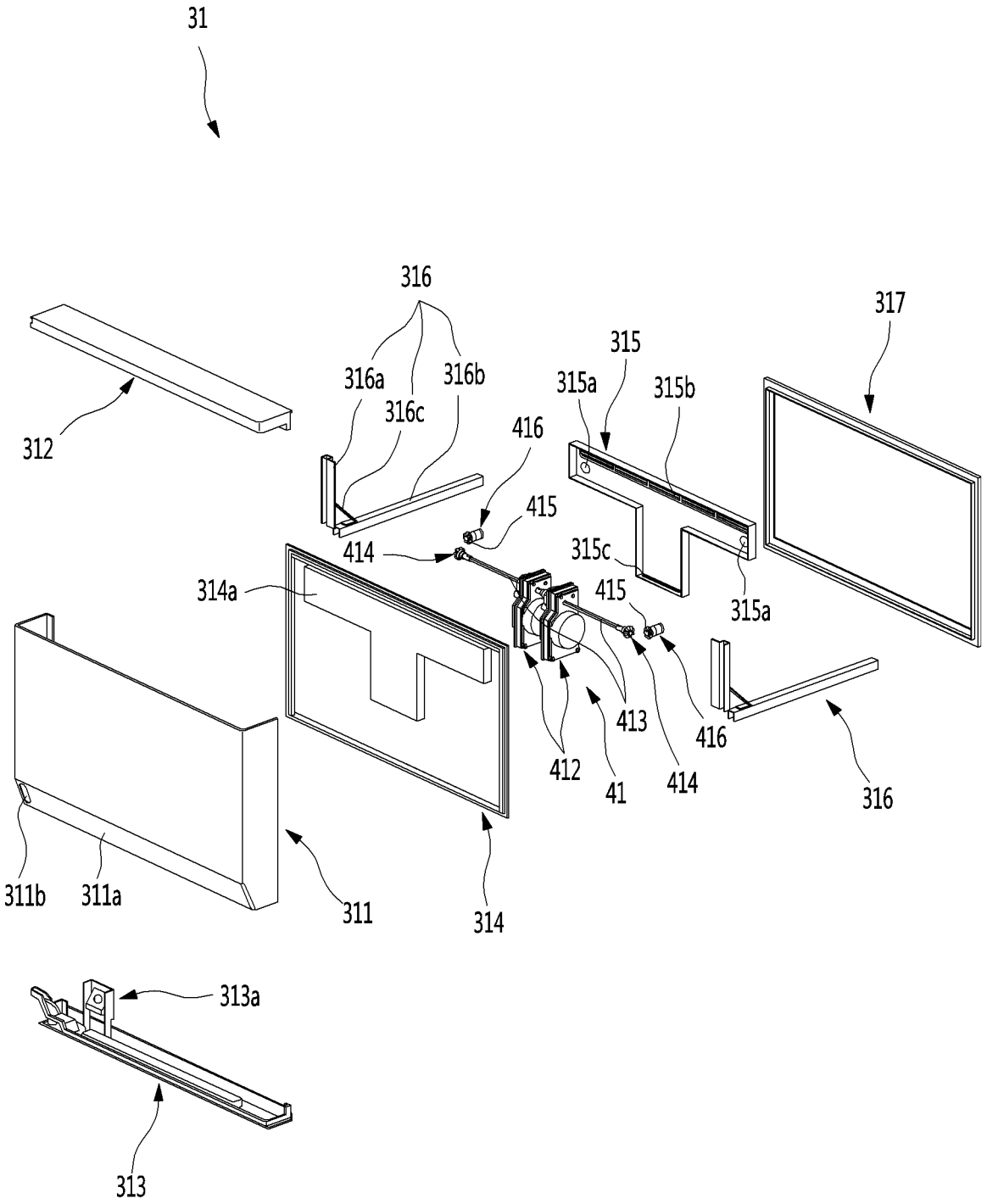
FIG. 6 is an exploded perspective view of the front panel door part.

FIG. 6 is an exploded perspective view of the door part.

As illustrated in the drawings, the front panel door part 31 may have an outer appearance that is defined by an outer case 311 defining a front surface and a portion of a circumferential surface, a door liner 314 defining a rear surface, and an upper deco 312 and a lower deco 313 which respectively define top and bottom surfaces. Also, the inside of the front panel door part 31 may be filled with a heat insulating material and may provide a space in which the door-side device 41 constituting a portion of the elevation assembly 40 is mounted.

The outer case 311 may be formed by bending a plate-shaped metal material, and an inclined part 311*a* may be provided on a lower end of a front surface of the outer case 311. A manipulation device hole 311*b* is defined in one side of the inclined part 311*a*, and the manipulation device 302 for detecting an output of a virtual switch and user's manipulation may be disposed in the manipulation device hole 311*b*. The manipulation device 302 may be constituted by a projector light that outputs an image to be used as a virtual switch and a proximity sensor.

A manipulation part bracket 313*a* for the mounting of the manipulation device 302 and an arrangement of a line connected to electrical components within the front panel door part 31 may be provided in the lower deco 313.

The door liner 314 may be made of a plastic material, and a recess part 314*a* recessed so that the door-side device 41 including the elevation motor 411 is mounted may be provided. The door cover 315 may be mounted on the door liner 314 to cover the door-side device mounted on the front panel door part 31 and the recess part 314*a*.

A cold air inflow hole 315*b* may be defined in an upper portion of the door cover 315. At least a portion of the cold air inflow hole 315*b* may be exposed at a height higher than that of the upper end of the drawer part 32 when the front panel door part 31 and the drawer part 32 are coupled to each other. Thus, a portion of cold air supplied to the drawer part 32 may be introduced into the door cover 315 through the cold air inflow hole 315*b*. Also, a cold air discharge hole 315*c* may be defined in a lower portion of the door cover 315. The cold air discharge hole 315*c* is opened downward between the front panel door part 31 and the drawer part 32. Thus, the cold air introduced into the door cover 315 may flow up to a lower side of the drawer part 32.

That is, the door cover 315 may provide a flow and circulating path of the cold air at the front of the drawer part 32 therein. In a state in which the drawer part 32 is inserted into the storage space of the cabinet 10, the cold air may circulate around the drawer part 32 to more efficiently cool the drawer part 32.

Also, a connection member hole 315*a* may be defined in the rear surface of the front panel door part 31. The connection member hole 315*a* may be defined in the door cover 315. The door connection member 416 may be exposed to the rear surface of the front panel door part 31 through the connection member hole 315*a*. The door connection member 416 may move forward and backward according to the user's manipulation. When the front panel door part 31 and the drawer part 32 are separated from each other by the user's manipulation, the door connection member 416 and the drawer connection member 471 may be separated from each other.

The door-side device 41 may be provided on the front panel door part 31. The door-side device 41 may be constituents disposed on the front panel door part 31 of the elevation assembly and include a motor assembly 412 constituted by the elevation motor 411 and gears, a door-side shaft rotating by the motor assembly 412, a door-side first gear 414 having a bevel gear shape and disposed on each of both ends of the door-side shaft 413, and a door-side second gear 415 having a bevel gear shape and coupled to the door-side first gear 414 and the door connection member 416. A configuration of each of the constituents of the door-side device 41 will be described below in more detail.

The motor assembly 412 may be provided as a single motor assembly constituted by one motor and gears as long as the motor assembly 412 provides sufficient power for elevating the support member 35. If it is impossible to provide sufficient torque, as illustrated in FIG. 6, a pair of motor assemblies 412 may be disposed in parallel to each other, and a pair of door-side shafts 413 may be respectively coupled to the motor assemblies. Also, the motor assembly 412 may disposed in parallel to the front surface of the front panel door part 31 to minimize the recessed space within the front panel door part 31.

The pair of door frames 316 may be disposed on both left and right sides on the rear surface of the front panel door part 31. The door frames 316 may connect the front panel door part 31 to the drawer part 32 so that the drawer part 32 is maintained in the state of being coupled to the front panel door part 31.

In detail, the door frames 316 may be constituted by a door frame part 316*a* fixed to the rear surface of the front panel door part 31 and a drawer frame part 316*b* fixed to the bottom surface of the drawer part 32. The door frame part 316*a* and the drawer frame part 316*b* may be vertically perpendicular to each other. Also, a frame reinforcement part 316*c* connecting the door frame part 316*a* to the drawer frame part 316*b* to prevent the door frames 316 from being deformed may be further provided.

The door frame part 316*a* may be mounted on the rear surface of the front panel door part 31 and provided in the front panel door part 31 so that the drawer frame part 316*b* extends to pass through the rear surface of the front panel door part 31. Also, the drawer frame part 316*b* may extend backward from a lower end of the door frame part 316*a* to support the drawer part 32 at a lower side.

Also, the drawer frame part 316*b* may be fixed and mounted on a lower end of each of both sides of the drawer part 32 on which the draw-out rail 33 is mounted. Here, the draw-out rail 33 may support the drawer part 32 at both the sides together with the drawer frame part 316*b*.

Also, a gasket 317 contacting the front end of the cabinet 10 to seal the storage space may be disposed around the rear surface of the door liner 314.

Figure 7:
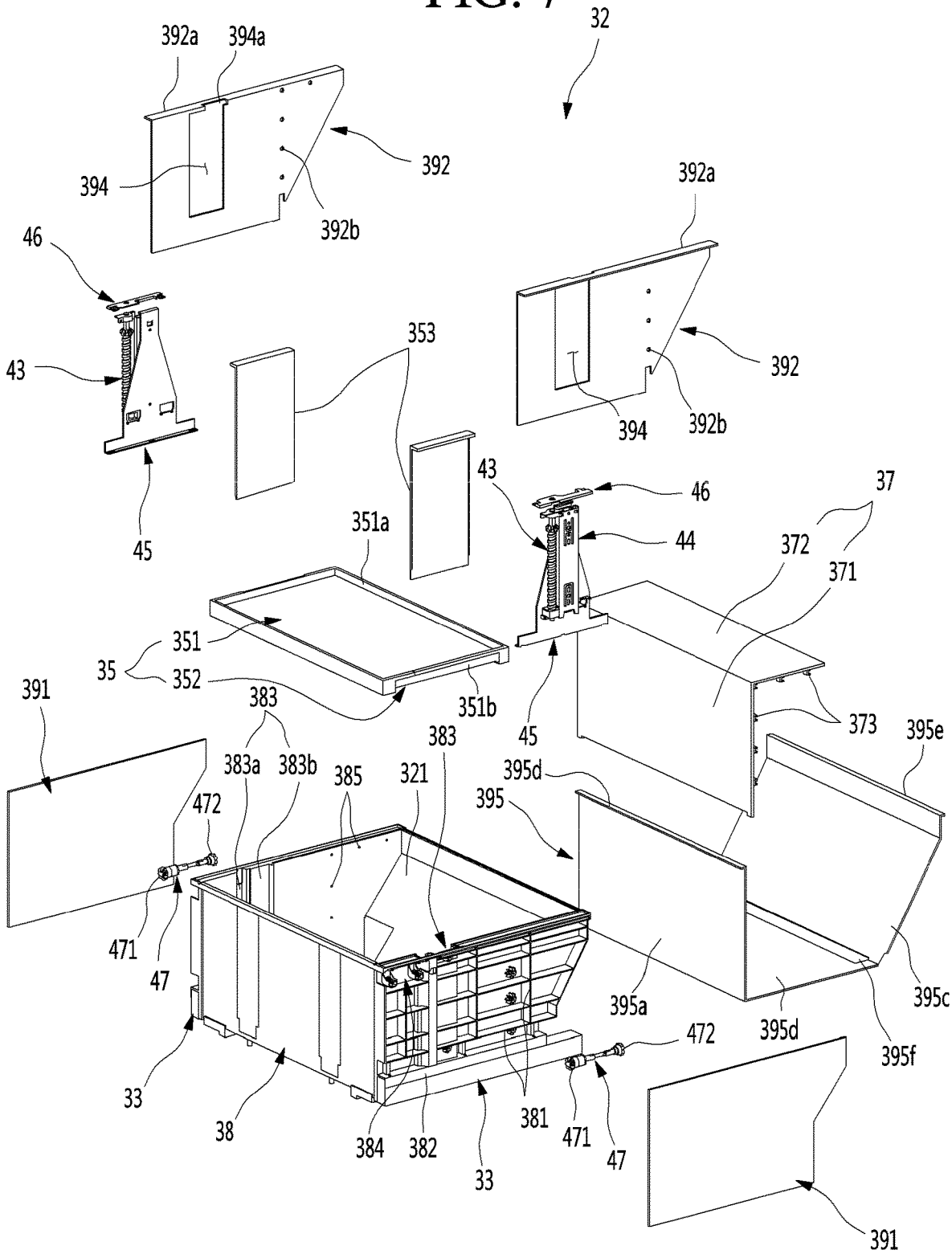
FIG. 7 is an exploded perspective view of the drawer part.

FIG. 7 is an exploded perspective view of a drawer part.

As illustrated in the drawings, the drawer part 32 may include a drawer body 38 defining an entire shape of the drawer part 32, a drawer-side device 42 provided in the drawer body 38 to constitute the elevation assembly 40, and a plurality of plates 391, 392, and 393 defining an outer appearance of the drawer part 32.

In more detail, the drawer body 38 may be injection-molded by using a plastic material and define an entire shape of the drawer part 32. The drawer body 38 may have a basket shape having an opened top surface to define a food storage space therein. An inclined surface 321 may be disposed on a rear surface of the drawer body 38. Thus, an interference with the machine room 3 may not occur.

The door frames 316 may be mounted on both sides of the drawer part 32. The door frame 316 may be coupled to a lower portion of each of both sides of the bottom surface or both left and right surfaces of the drawer part 32. The drawer part 32 and the front panel door part 31 may be integrally coupled to each other and be inserted and withdrawn together with each other.

The draw-out rack 34 may be disposed on each of both the sides of the bottom surface of the drawer part 32. The drawer part 32 may be inserted and withdrawn forward and backward by the draw-out rack 34. In detail, in the state in which the drawer part 32 is mounted on the cabinet 10, at least a portion of the rear space S2 is disposed in the lower storage space.

Also, the draw-out rack 34 may be coupled to a pinion gear 141 disposed on the bottom surface of the storage space. Thus, when the draw-out motor 14 is driven, the pinion gear 141 may rotate to allow the draw-out rack 34 to move, and the drawer door 30 may be inserted and withdrawn.

The drawer door 30 may not be automatically inserted and withdrawn. That is, the user may push or pull the drawer door 30 to be inserted and withdrawn. Here, the draw-out rack 34 may be omitted, and thus, the insertion and withdrawal may be performed through only the draw-out rail 33.

A plurality of reinforcement ribs 381 may extend in vertical and horizontal directions on both left and right sides of the drawer body 38. The reinforcement ribs 381 may prevent the drawer body 38 from being deformed by a load applied to both the left and right surfaces of the drawer body.

Particularly, the shaft 43 and the elevation rail 44, which are a main component for the elevation of the support member 35, may be disposed on both side surfaces of the drawer body 38. Thus, when the support member 35 and the food or container seated on the support member 35 is elevated, a load may be concentrated into both the side surfaces of the drawer body 38. The reinforcement ribs 381 may maintain the shape of the drawer body 38, particularly, the drawer part 32 even under the concentrated load.

A rail mounting part 382 on which the draw-out rail 33 for guiding the insertion and withdrawal of the drawer body 38 is mounted may be disposed on a lower portion of each of both the side surfaces of the drawer body 38. The rail mounting part 382 may extend from a front end to a rear end and provide a space in which the draw-out rail 33 is accommodated.

The rail mounting part 382 may be disposed below the drawer-side device 42 to prevent the interference with the drawer-side device 42. Also, the rail mounting part 382 may be disposed on the lower end of both the side surfaces of the drawer body 38 to secure a sufficient elevation distance of the drawer-side device 42 in the vertical direction.

The draw-out rail 33 may be a rail that extends in multistage. The draw-out rail 33 may have one end fixed to the storage space inside the cabinet 10 and the other end fixed to the rail mounting part 382 to more stably realize insertion and the withdrawal of the drawer door 30.

A mounting part 383 on which the elevation shaft 43 and the elevation rail 44, which are main components of the drawer-side device 42, are mounted may be recessed inside both side surfaces of the drawer body 38. The mounting part 383 may be recessed inward and include a shaft groove 383*a* defined in the elevation shaft 43 and a rail groove 383*b* defined in the elevation rail 44. The elevation shaft 43 and the elevation rail 44 may be disposed outside the inner surface of the drawer body 38 in a state of being mounted on the mounting part 383 so as not to interfere with the support member 35 when the support member 35 is elevated.

A bottom surface of the mounting part 383 may support a lower end of the elevation shaft 43. Also, when the top surface of the mounting part 383 is opened so that the elevation rail 44 extends, the elevation rail 44 may pass through the opened top surface of the mounting part 383 to protrude.

A mounting part bracket 46 may be disposed on the opened top surface of the mounting part 383. The mounting part bracket 46 may be made of a metal material. Thus, the mounting part bracket 46 may support the upper end of the elevation shaft 43, and also, the elevation rail 44 may pass through the mounting part bracket 46. That is, the opened top surface of the mounting part 383 may be covered by the mounting part bracket 46, and also, the elevation shaft 43 may be mounted inside the mounting part 383 in the state in which the elevation shaft is rotatable.

The elevation shaft 43 and the elevation rail 44 may be coupled to the connecting bracket 45, and the connecting bracket 45 may be elevated by the rotation of the elevation shaft 43. The elevation shaft 43 and the elevation rail 44 may be coupled to the connecting bracket 45 in state of being mounted on the mounting part 383. Also, the connecting bracket 45 may be connected to the elevation plate 351 constituting the support member 35, and the support member 35 may be elevated as the connecting bracket 45 vertically moves.

A shaft mounting part 384 may be disposed on an outer surface of each of both sides of the drawer body 38. A space in which the drawer-side shaft 47 is disposed may be provided in the shaft mounting part 384. Here, the drawer-side shaft 47 may be rotatably mounted.

The shaft mounting part 384 may be opened outward from the upper end of each of both the side surfaces of the drawer body 38 to communicate with the mounting part 383, more particularly, the shaft groove 383*a*. Thus, the drawer-side shaft 47 mounted on the shaft mounting part 384 may be coupled to the elevation shaft 43 mounted on the mounting part 383 to transmit the power.

A drawer-side device 42 constituting a portion of the elevation assembly 40 may be provided in the drawer body 38. Also, the support member 35, the elevation shaft 43, and the elevation rail 44 of the drawer-side device 42 may be disposed on the inner surface of the drawer body 38, and the drawer-side shaft 47 may be disposed outside the drawer body 38. A specific structure of the drawer-side device 42 will be described below in more detail.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the drawer-side shaft 47 and the draw-out rail 33, which are mounted on both the sides of the drawer body 38 may not be exposed to the outside.

An inner side plate 392 may be disposed on each of both left and right surfaces of the inside of the drawer body 38.

The inner side plate 392 may be mounted on each of both the side surfaces of the drawer body 38 to define both the left and right surfaces of the inside thereof. Also, an upper bent part 392*a* may be disposed on an upper end of the inner side plate 392. The upper bent part 392*a* may cover the upper end of each of both the side surfaces of the drawer body 38. Also, an extending end of the upper bent part 392*a* may contact the upper end of the outer side plate 391. Thus, all of the inside and outside and the top surface of both the left and right surfaces of the drawer body 38 may be covered by the inner side plate 392 and the outer side plate 391.

Also, a side opening 394 having a size corresponding to the mounting part 383 may be defined in the inner side plate 392. Thus, in the state in which the inner side plate 392 is mounted, the elevation shaft 43 and the elevation rail 44, which are mounted on the mounting part 383, may be exposed to the inside of the drawer body 38 so as not to interfere when being coupled to the support member 35, and the support member 35 is elevated.

Also, a rail entrance part 394*a* through which the elevation rail 44 is inserted and withdrawn may be further provided on the upper bent part 392*a* contacting the upper end of the side opening 394. The rail entrance part 394*a* may have a shape corresponding to a cross-sectional shape of the elevation rail 44 on the upper bent part 392*a*. When the support member 35 ascends, the elevation rail 44 may be inserted and withdrawn through the rail entrance part 394*a*.

An inner plate 395 may be disposed on each of front, bottom, and rear surfaces of the inside of the drawer body 38. The inner plate 395 may be constituted by a front surface part 395*a*, a bottom surface part 395*b*, and a rear surface part 395*c*, which have sizes correspond to the front surface, the bottom surface, and the rear surface of the inside of the drawer body 38. The inner plate 395 may be provided by bending the plate-shaped stainless material so that the inner plate 395 defines the inner surface of the remaining portion except for both the left and right surfaces of the drawer body 38. Also, both left and right ends of the inner plate 395 may contact the inner side plate 392. The front surface part 395*a*, the bottom surface part 395*b*, and the rear surface part 395*c* constituting the inner plate 395 may be separately provided and then coupled to or contact each other.

The entire inner surfaces of the drawer body 38 may be defined by the inner side plate 392 and the inner plate 395, and the inner surface of the drawer body 38 may provide texture of the metal. Thus, the inner surface of the drawer part 32 may more easily transfer heat by the inner side plate 392 and the inner plate 395, and thus, the entire drawer part 32 may be uniformly cooled by the surrounding cold air. Thus, the foods accommodated in the drawer part 32 may be more uniformly cooled and thus stored at a low temperature in the more uniform region. In addition, visually excellent cooling performance and storage performance may be provided to the user.

Also, upper bent parts 395*d* and 395*e* that are bent outward may be further disposed on the front surface part 395*a* and the rear surface part 395*c* of the inner plate 395 to cover the top surfaces of the front end and the rear end of the drawer body 38, respectively. Also, the rear surface part 395*c* may have a shape corresponding to the inclined surface 321 of the rear surface of the drawer body 38 and thus be closely attached to the inclined surface 321.

Also, a bottom surface opening 395*f* may be further defined in the rear end of the bottom surface part 395*b* adjacent to the lower end of the rear surface part 395*c*. The bottom surface opening 395*f* may be opened at a position corresponding to a cover support part 388 protruding from the bottom surface of the drawer body. Thus, the cover support part 388 may be exposed through the bottom surface opening 395*f*. The lower end of the drawer cover 37 may be coupled to the cover support part 388 so that the drawer cover 37 is mounted.

The drawer cover 37 may include a cover front part 371 that partitions the inside of the drawer body 38 into a front space S1 and a rear space S2 and a cover top surface part 372 bent from an upper end of the cover front part 371 to cover a top surface of the rear space S2.

That is, when the drawer cover 37 is mounted, only the front space S1, in which the support member 35 is disposed, may be exposed in the drawer body 38, and the rear space S2 may be covered by the drawer cover 37.

A lower end of the cover front part 371 may be coupled to the cover support part 388. Also, a plurality of cover restriction parts 373 may be disposed along both the left and right ends of the drawer cover 37. The cover restriction part 373 may be disposed at a position corresponding to a plurality of cover restriction protrusions 385 protruding inward from the inner surface of the drawer body 38. Each of the cover restriction protrusions 385 may pass through a protrusion hole 392*b* defined in the inner side plate 392 to protrude.

Also, the cover restriction part 373 may be press-fitted into the cover restriction protrusion 385. When the drawer cover 37 is mounted, the cover restriction protrusion 385 may be coupled to the cover restriction part 373 to fix the drawer cover 37.

The support member 35 may be disposed in the drawer body 38. The support member 35 may include one component of the elevation assembly 40. The support member 35 may have a size that is enough to be accommodated in the front space S1 of the bottom surface of the drawer body 38.

Also, the support member 35 may have a rectangular plate shape. Substantially, the support member 35 may include an elevation plate 351 supporting the food or container and an elevation frame 352 supporting the elevation plate 351 at a lower side and reinforcing strength of the elevation plate 351. The support member 35 may be a portion on which the food or container 36 is substantially seated and supported and thus may be called a seating member or a tray. Also, as necessary, the support member 35 may be provided as one of the elevation plate 351 or the elevation frame 352.

The elevation plate 351 may have a rectangular plate shape and include a circumferential part 351*a* protruding upward along a circumference thereof. The circumferential part 351*a* may have an opened bottom surface, and a portion of the elevation frame 352 may be accommodated in the circumferential part 351*a*. Also, the circumferential part 351*a* may contact a circumference of a bottom surface of the container 36 to prevent the container 36 from moving.

Also, a connecting bracket mounting part 351*b* on which the connecting bracket 54 is mounted may be disposed on each of both left and right surfaces of the circumferential part 351*a*. Also, the connecting bracket mounting part 351*b* may be cut so that the side surface of the elevation frame 352 is exposed. The connecting bracket 54 may mounted on each of both side surfaces of the elevation frame 352 through the connecting bracket mounting part 351*b*.

The connecting bracket 45 may have a plate shape. The connecting bracket 45 may have a size corresponding to or larger than that of at least the mounting part 383 to prevent the mounting part 383, the elevation shaft 43 mounted on the mounting part 383, the elevation rail 44 from being exposed to the inside of the drawer part 32. Also, the connecting bracket 45 may further extend upward from the upper end of the side surface of the drawer body 38, and the extending upper end of the connecting bracket 45 may be bent outward. Thus, the side surface of the mounting part, the opened top surface of the mounting part 383, and the mounting part bracket 46 mounted on the upper end of the drawer body 38 may be covered from the upper side by the connecting bracket 45.

The connecting bracket 45 may have one side fixed to the elevation frame 352 and the other side coupled to the elevation rail 44 and the elevation shaft 43. Thus, when the elevation shaft 43 and the elevation rail 44 operate, the elevation frame 352 connected to the connecting bracket 45, i.e., the support member 35 may vertically move together with the connecting bracket 45.

A side cover 353 may be further disposed on the inner surface of the connecting bracket 45. The side cover 353 may have a size corresponding to or greater than that of the connecting bracket 45 and be made of the same material as the inner side plate 392 or a material of a metal texture.

In the state in which the side cover 353 is mounted, the side cover 353 may cover the connecting bracket 45 and the mounting part 383. Thus, an outer appearance of the inside of the drawer body 38 may be configured to be more elegant and unified. Also, an upper end of the side cover 353 may be bent outward to cover the bent portion of the upper end of the connecting bracket 45. Also, an outer circumference of the side cover 353 may be bent and fixed to surround a circumference of the connecting bracket 45.

The drawer-side device 42 disposed in the drawer body 38 of the elevation assembly 40 may be mounted in the drawer body 38. The drawer-side device 42 may include the support member 35, the elevation shaft 43 and the elevation rail 44, which is mounted inside the mounting part 383, the connecting bracket 45, and the drawer-side shaft 47.

Hereinafter, a structure of the elevation assembly will be described in more detail with reference to the accompanying drawings.

Figure 8:
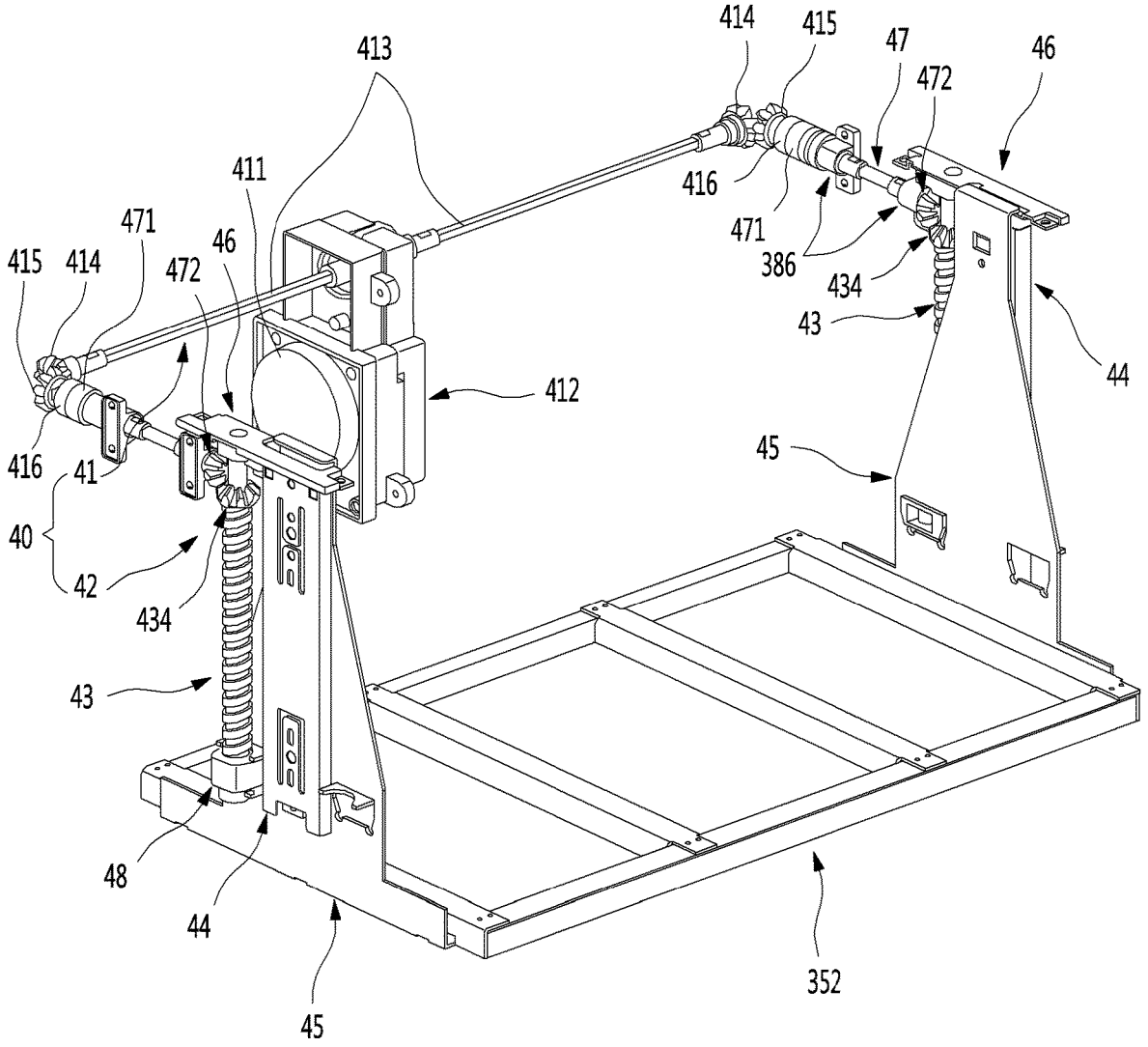
FIG. 8 is a perspective view of an elevation assembly built in the drawer door.

FIG. 8 is a perspective view of the elevation assembly built in the drawer door.

As illustrated in the drawing, the elevation assembly 40 may be constituted by the door-side device disposed in the front panel door part 31 and the drawer-side device 42 disposed in the drawer part 32. Also, the door-side device 41 and the drawer-side device 42 may be coupled to each other by coupling the front panel door part 31 to the drawer part 32 to transmit the power.

As described above, the door-side device 41 may include the motor assembly 412 including the elevation motor 411, the door-side shaft 413 coupled to the motor assembly 412 to rotate, the door-side first gear 414 disposed on each of both the ends of the door-side shaft 413, the door-side second gear 415 engaged with the door-side first gear 414, and the door connection member 416 coupled to the door-side second gear 415.

Although one motor assembly 412 is provided in FIG. 8, if larger torque is required for the elevation of the support member 35, a pair of motor assemblies 412 may be provided as illustrated in FIG. 6. Also, although the motor assembly 412 is disposed in perpendicular to the front surface of the front panel door part 31 in FIG. 8, the motor assembly 412 may be disposed in parallel to the front panel door part 31 to minimize a loss in insulation space of the front panel door part 31.

The drawer-side device 42 may include the support member 35 provided inside the drawer body 38, the elevation shaft 43 disposed on each of both sides of the support member 35 to elevate the support member 35, the elevation rail 44, the elevation frame 352, and the connecting bracket 45, and the drawer-side shaft 47 disposed outside the drawer body 38 to transmit the rotation force of the door-side device 41 to the elevation shaft 43.

When the motor assembly 412 is driven, the rotation force of the door-side shaft 413 may be transmitted to the drawer-side device 42 by the door connection member 416 and the drawer connection member 471, which are coupled to each other. When the drawer-side shaft 47 rotates by the rotation of the drawer connection member 471, the elevation shaft 43 coupled to the drawer-side shaft 47 rotates. A shaft holder 48 coupled to the elevation shaft 43 may vertically move through the rotation of the elevation shaft 43.

The shaft holder 48 and the elevation rail 44 may be coupled to the connecting bracket 45 to elevate the connecting bracket 45, and the connecting bracket 45 disposed each of both the left and right sides may elevate the support member 35 in the state of being coupled to the elevation frame 352.

That is, the rotation force of the motor assembly 412 may be transmitted to the drawer-side shaft 47 through the door-side shaft 413 to allow the elevation shaft 43 to rotate. The shaft holder 48 and the elevation rail 44 may guide the support member 35 to move vertically.

Hereinafter, a detailed structure of each of the constituents of the drawer-side device 42 will now be described in more detail with reference to the accompanying drawings.

Figure 9:
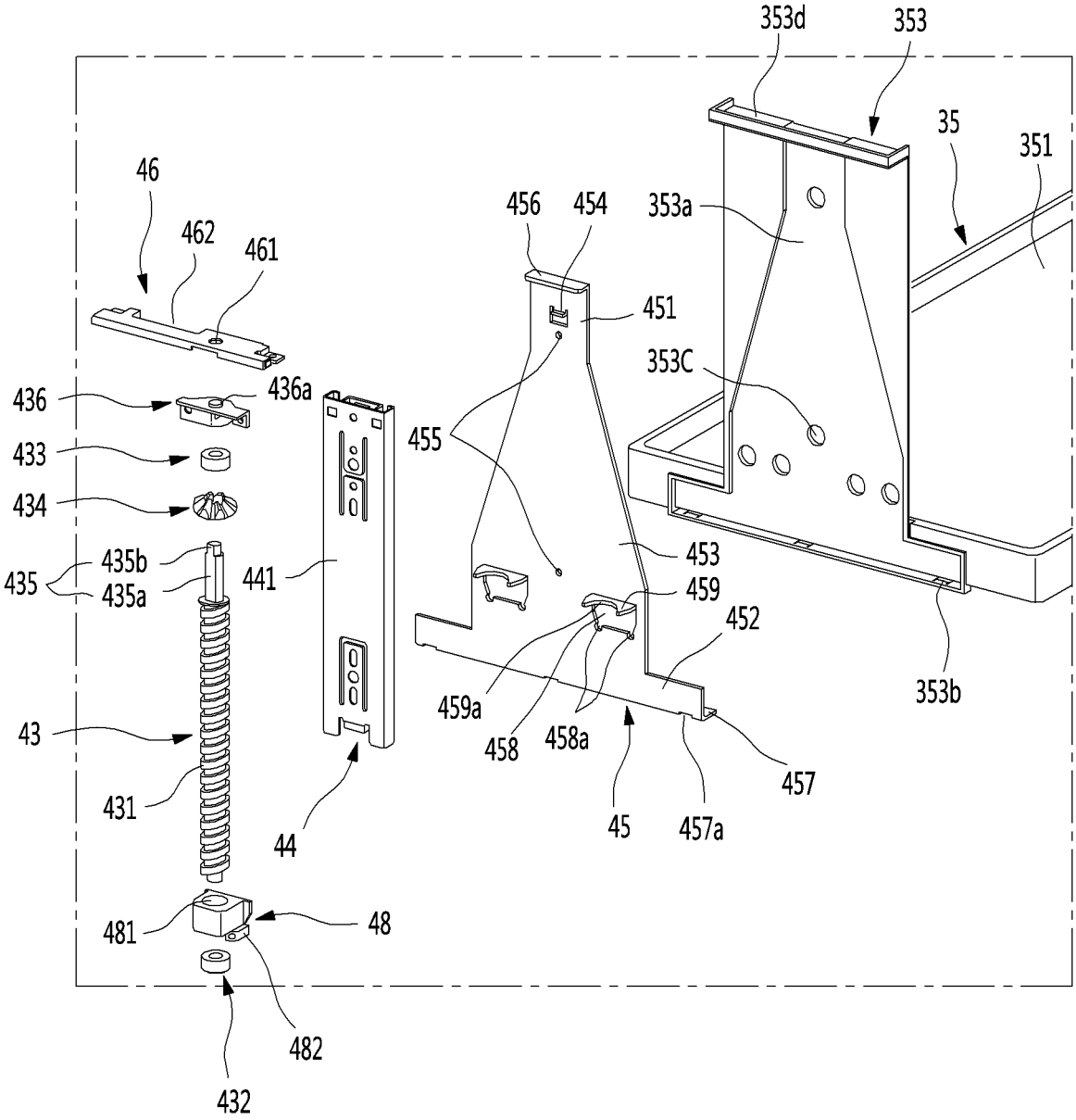
FIG. 9 is an exploded perspective view illustrating a coupling structure of a drawer-side device of the elevation assembly.
Figure 10:
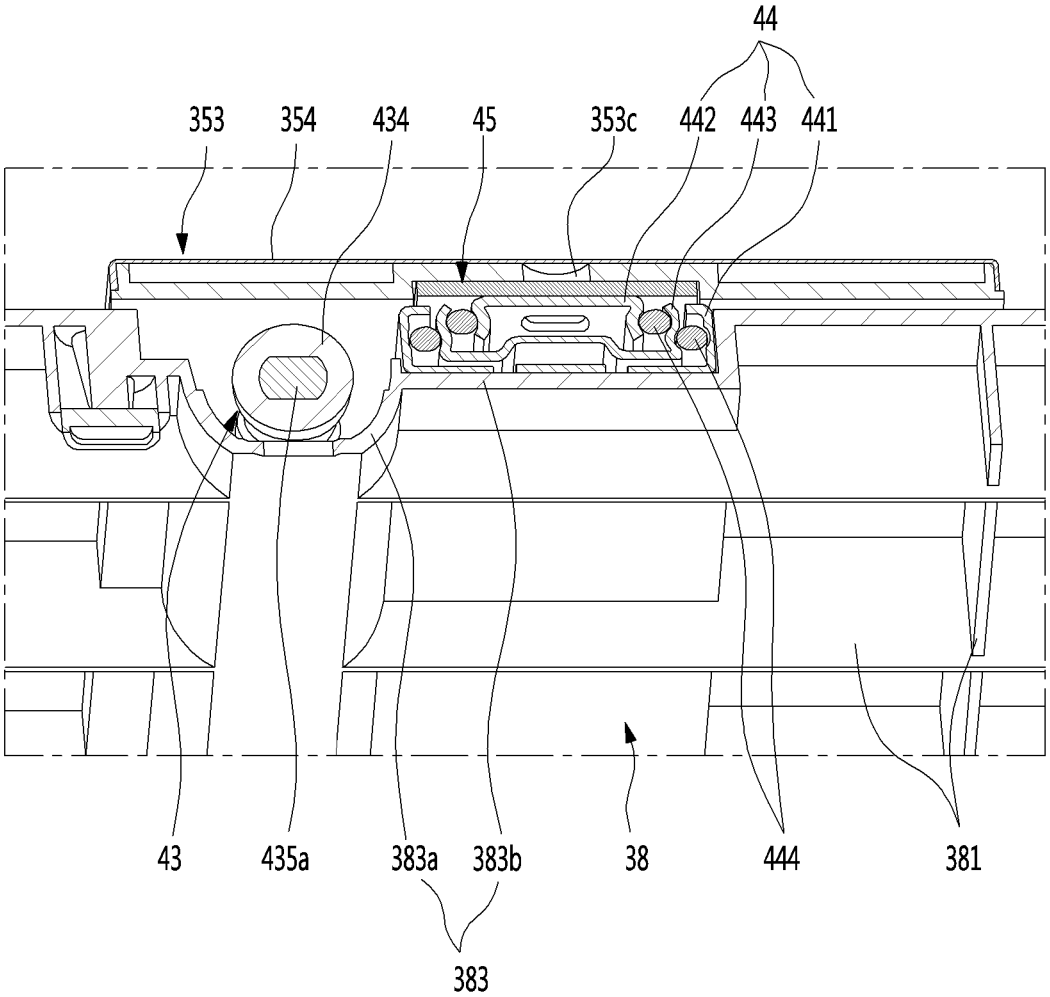
FIG. 10 is a cutaway perspective view illustrating a state in which an elevation shaft and an elevation rail, which constitute the elevation assembly, are mounted.

FIG. 9 is an exploded perspective view illustrating a coupling structure of the drawer-side device of the elevation assembly. Also, FIG. 10 is a cutaway perspective view illustrating a state in which the elevation shaft and the elevation rail, which constitute the elevation assembly, are mounted.

As illustrated in the drawings, the elevation shaft 43 and the elevation rail 44 may be mounted inside the mounting part 383. The elevation rail 44 may vertically extend in multistage.

For example, the elevation rail 44 may include a fixed rail 441 mounted in the rail groove 383*b*, a movable rail 442 fixedly mounted on the connecting bracket 45, and an intermediate rail 443 connecting the fixed rail 441 to the movable rail 442. The intermediate rail 443 may be disposed inside the fixed rail 441, and the movable rail 442 may be disposed inside the intermediate rail 443. The fixed rail 441, the intermediate rail 443, and the movable rail 442 may overlap each other. Also, a plurality of bearing balls 444 may be disposed inside and outside the intermediate rail 443 so that the intermediate rail 443 and the movable rail 442 are vertically slid and may provide stroke for the elevation of the support member 35.

The position at which the elevation rail 44 is disposed may be a position corresponding to a center in a front and rear direction of the front space S1. Thus, the plurality of bearing balls 444 may guide the vertical movement of the support member 35 at a position corresponding to the central portion of both the side surfaces of the support member 35 so that the support member 35 is stably elected without being tilted.

Also, the elevation shaft 43 may be disposed at a side of the elevation rail 44. The elevation shaft 43 may be accommodated into the mounting part 383 and disposed in the shaft groove 383*a*. Also, a screw thread 431 may be provided on an outer circumferential surface of the elevation shaft 43 so that the shaft holder 48 vertically moves along the elevation shaft 43 when the elevation shaft 43 rotates.

A lower spacer 432 on which the elevation shaft 43 is rotatably supported may be disposed below the elevation shaft 43. The lower spacer 432 may be fixed to a bottom surface of the mounting part 383, and a lower protrusion 437 protruding from a lower end of the elevation shaft 43 may be inserted. The lower spacer 432 may have a structure similar to a bearing.

The elevation shaft 43 may extend up to the upper end of the mounting part 383, and upper protrusion 435 extending upward may be disposed on the upper end of the elevation shaft 43. Also, a shaft gear 434 and an upper spacer 433 may pass through the upper protrusion 435 so as to be mounted.

In detail, the shaft gear 434 may have a bevel gear shape and be disposed on a lower portion 435*a* having a polygonal cross-section of the upper protrusion 435. Thus, the shaft gear 434 may have a structure that is capable of rotating together with the elevation shaft 43. Also, the shaft gear 434 may be gear-coupled to the drawer-side shaft 47 in the state of perpendicularly crossing the drawer-side gear 472 mounted on the drawer-side shaft 47.

Also, the upper spacer 433 may be disposed on an upper portion 435*b* having a circular cross-section of the upper protrusion 435. The upper spacer 433 may rotatably support the upper end of the elevation shaft 43 and fixed and mounted on a spacer fixing member 436 provided above the elevation shaft 43. Also, the spacer fixing member 436 may be fixed and mounted on the mounting part bracket 46. Thus, the upper and lower ends of the elevation shaft 43 may be rotatably supported by the upper spacer 433 and the lower spacer 432.

The mounting part bracket 46 may cover the opened top surface of the mounting part 383 and be mounted on an upper end of each of both side surfaces of the drawer body 38. A bracket hole 461 into which a fixing protrusion 436*a* of the spacer fixing member 436 is inserted may be defined in one side of the mounting part bracket 46 corresponding to the upper end of the elevation shaft 43.

Also, a bracket cutoff part 462 may be further provided in one side of the mounting part bracket 46 corresponding to an upper side of the elevation rail 44. When the elevation rail 44 extends upward to allow the support member 35 to ascend, the elevation rail 44 may pass through the bracket cutoff part 462 to extend upward.

The shaft holder 48 coupled to the elevation rail 44 and the elevation shaft 43 may be coupled to the connecting bracket 45.

The connecting bracket 45 may have a plate shape and be made of a metal material to endure a load when the support member 35, on which the food or container 36 is seated, is elevated. Also, the connecting bracket 45 may be disposed between the side cover 353 and the inner surface of the drawer body 38. Also, the connecting bracket 45 may be coupled to one side of the support member 35 and also coupled to the elevation rail 44 and the shaft holder 48 to elevate the support member 35.

The connecting bracket 45 may be constituted by a bracket upper portion defining an upper shape, a bracket lower portion 452 defining a lower shape, and a bracket intermediate portion connecting the bracket upper portion 451 and the bracket lower portion 452.

The bracket upper portion 451 may be disposed at a center in a transverse direction of the connecting bracket 45 and be coupled to the fixed rail 441 of the elevation rail 44. The bracket upper portion 451 may have a horizontal width equal to or greater than that of at least the fixed rail 441 and have a width less than that of each of the bracket intermediate portion 453 and the bracket lower portion 452.

Also, a rail coupling part 454 may be disposed on the bracket upper portion 451. The rail coupling part 454 may be hooked with one side of the fixed rail 441. A portion of the bracket upper portion 451 of the rail coupling part 454 may be cut. The cut portion may be bent to be coupled to the movable rail 442. Also, a screw hole 455 may be defined in a lower portion of the rail coupling part 454 to couple the connecting bracket 45 to the fixed rail 441 again by using a screw. The screw hole 455 may be further provided in the bracket intermediate portion 453 or the bracket lower portion 452 to stably couple the elevation rail by using the plurality of screws. When the elevation rail 44 is fixed and mounted on the bracket upper portion 451, the elevation rail 44 may be disposed to vertically extend from the center of the connecting bracket 45.

Also, a rail covering part 456 may be disposed on an upper end of the bracket upper portion 451. The rail covering part 456 may be formed by bending the upper end of the bracket upper portion 451 outward. A bent length may be a length that is enough to cover the entire top surface of the elevation rail 44.

The bracket lower portion 452 may be substantially coupled to the support member 35, particularly, the elevation frame 352. The bracket lower portion 452 may have a length equal to or slightly less than that of the side surface of the support member 35 and be entirely coupled to the side surface of the support member 35 to allow the support member 35 to be stably elevated. In detail, the bracket lower portion 452 may contact the side surface of the support member 35, and a bracket coupling part 457 which is bent inward and on which the bottom surface of the support member 35 or the bottom surface of the elevation frame 352 is seated may be disposed on the lower end of the bracket lower portion 452. The bracket lower portion 452 may be coupled to the elevation frame 352 or the support member 35 to support both ends of the support member 35.

The bracket intermediate portion 453 may connect the bracket upper portion 451 to the bracket lower portion 452 and have a horizontal width less than that of the bracket lower portion. Also, the bracket intermediate portion 453 may have a width that is enough to fix and mount the shaft holder 48 at any position of both left and right sides with respect to at least the elevation rail 44. A lower end of the bracket intermediate portion 453 may have a predetermined width and extend upward. The bracket intermediate portion 453 may have a width that gradually decreases at a portion higher than the portion to which the shaft holder 48 is coupled.

A holder opening 458 and a holder support part 459, on which the shaft holder 48 is mounted, may be provided in the bracket intermediate portion 453. The holder opening 458 and the holder support part 459 may have the same structure at positions that are symmetrical to each other with respect to the elevation rail 44 mounted to the center of the connecting bracket 45. Thus, the connecting brackets disposed on both the sides of the drawer body 38 may have the same structure. Also, the connecting brackets may be commonly used by being molded with the same structure on both left and right sides.

The holder opening 458 may have a shape corresponding to a cross-sectional shape of the shaft holder 48. Also, the holder opening 458 may have a shape having at least one or more angles or a polygonal shape so that the shaft holder 48 is fixed in the state of being inserted into the holder opening 458 without rotating.

Also, the holder support part 459 may extend backward from an upper end of the holder opening 458 and also extend to contact a top surface of the shaft holder 48. Also, a rear end of the holder support part 459 may have a recess part 459*a* so as not to interfere with the elevation shaft 43. The recess part 459*a* may have a shape corresponding to a through-hole 481 of the shaft holder 48.

Thus, when the shaft holder 48 is elevated, force transmitted through the shaft holder 48 may be applied to a circumferential surface of the holder opening 458. Particularly, when the shaft holder 48 ascends, the holder support part 459 may be lifted from a lower side by the force to allow the connecting bracket to ascend.

A screw hole 458*a* may be further defined in each of both sides of the holder opening 458. The screw passing through the screw hole 458*a* from the outside of the connecting bracket 45 may be coupled to the screw coupling part 482 provided on each of both the sides of the lower end of the shaft holder 48 to allow the shaft holder 48 to be more firmly fixed to the connecting bracket 45.

As described above, the shaft holder 48 may be firmly coupled to the connecting bracket 45 by the holder opening 458, the holder support part 459, and the screw. Here, the shaft holder 48 and the connecting bracket 45 may be elevated together with each other.

Thus, when the shaft holder 48 vertically moves along the screw, the force applied to the shaft holder 48 may be effectively transmitted to the connecting bracket 45. Also, even though the force for the elevation is applied through the shaft holder 48 at a position that is eccentric from the center of the support member 35, the support member 35 may be stably elevated by the elevation rail 44 and the connecting bracket 45 without being tilted.

Also, the side cover 353 may be coupled to each of both side surfaces of the elevation plate 351 and the elevation frame 352. A bracket accommodation part 353*a* having a shape corresponding to the connecting bracket 45 may be disposed on an outer surface of the side cover 353. Thus, the connecting bracket 45 may be closely attached and fixed to the side cover 353, and thus, the connecting bracket 45 and the side cover 353 may be elevated together with each other.

Also, a protrusion 353*b* corresponding to the groove 457*a* recessed in the lower end of the connecting bracket 45 may be disposed inside the bracket accommodation part 353*a* to more firmly fix the connecting bracket 45 to the inside of the bracket accommodation part 353*a*. Also, a bracket opening 353*c* may be defined in a position corresponding to each of the plurality of screw holes 455 and 458*a* inside the bracket accommodation part 353*a*. The screw 353*c* coupled to the connecting bracket 45 may be coupled to the inside of the side cover 353, and thus, the connecting bracket 45 and the side cover 353 may be more firmly fixed. Here, the side cover 353 may be made of a plastic material. A separate cover plate 354 may be further provided inside the side cover 353 to cover the entire inner surface and the top surface of the side cover in addition to the bracket opening.

Figure 11:
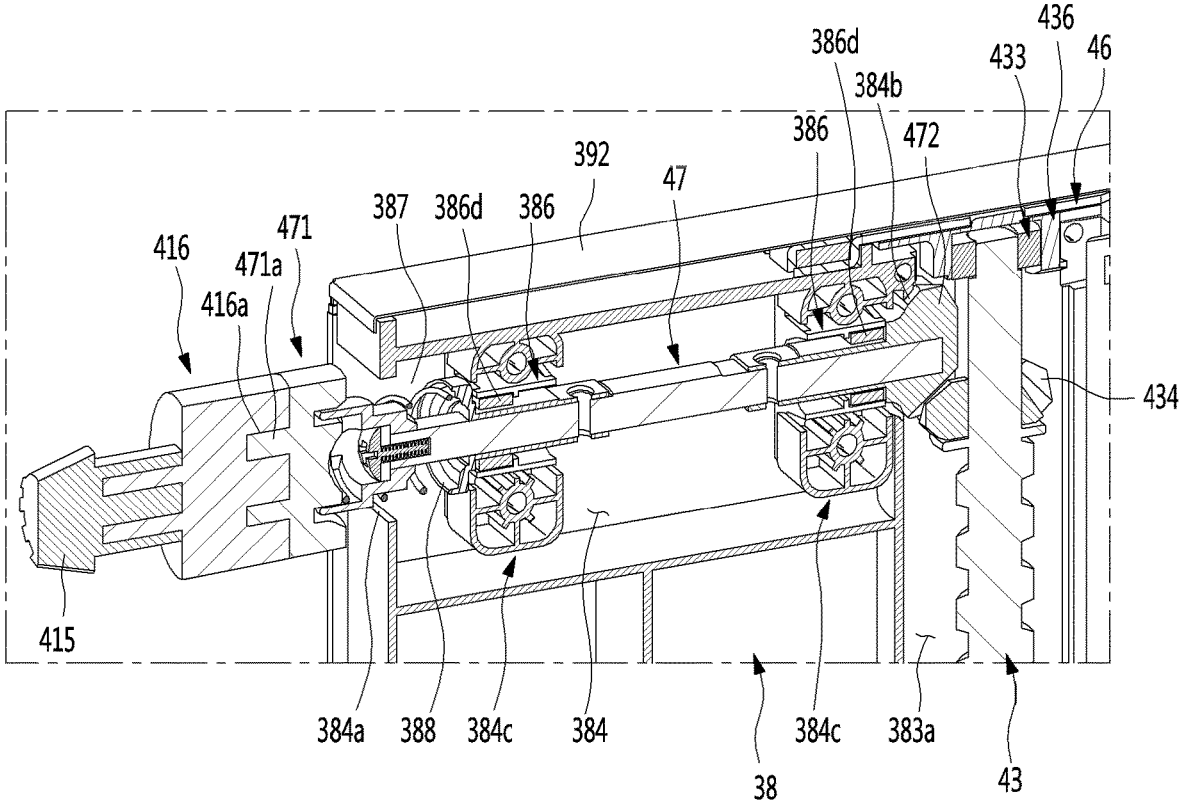
FIG. 11 is a perspective view illustrating a mounting structure of a drawer shaft of the drawer-side device of the elevation assembly.
Figure 12:
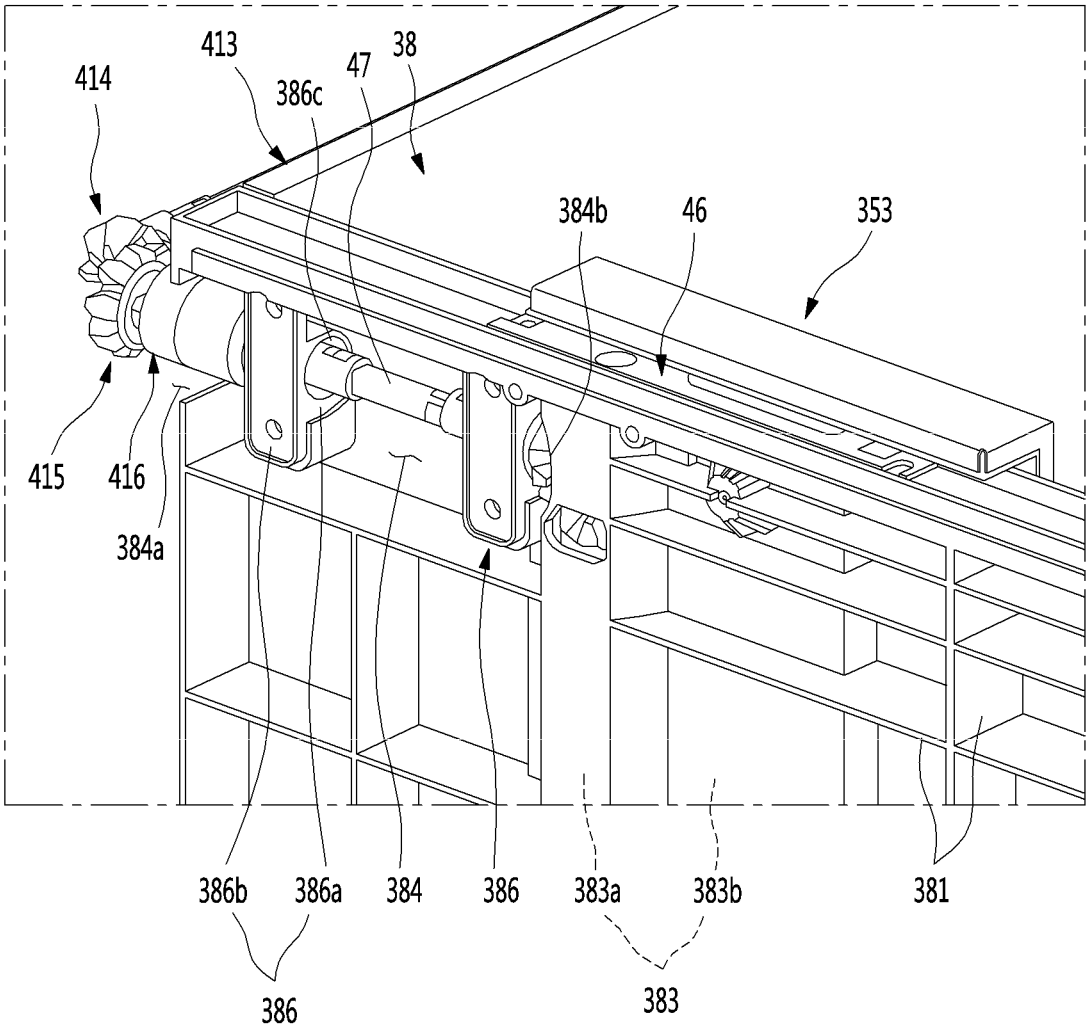
FIG. 12 is a cutaway perspective view illustrating a power transmission structure of the drawer-side device.

FIG. 11 is a perspective view illustrating a mounting structure of the drawer shaft of the drawer-side device of the elevation assembly. Also, FIG. 12 is a cutaway perspective view illustrating a power transmission structure of the drawer-side device.

As illustrated in the drawings, the shaft mounting part 384 may be disposed on the upper end of each of both the sides of the drawer body 38. The shaft mounting part 384 may be disposed in a region between the front surface of the drawer body 38 and the mounting part 383, and the drawer-side shaft 47 may be disposed on the shaft mounting part 384.

Also, the front end of the shaft mounting part 384 may include a front opening 384*a* of which at least a portion of a front end is opened so that the shaft mounting part 384 communicates with the front surface of the drawer body 38 and a rear opening 384*b* of which at least a portion of a rear end is opened so that the shaft mounting part 384 communicates with the mounting part 383.

Also, the drawer-side shaft 47 may be disposed on the shaft mounting part 384. Also, the shaft fixing member 386 for fixing the drawer-side shaft 47 may be provided, and a mounting part 384*c* for mounting the shaft fixing member 386 may be further provided.

In detail, the drawer-side shaft 47 may extend from the front opening 384*a* to the rear opening 384*b*. Also, the drawer connection member 471 may be coupled to the front end of the drawer-side shaft 47, and the drawer connection member 471 may be exposed to the front surface of the drawer part 32 through the front opening 384*a*. Also, as described above, the drawer connection member 471 may be coupled to the door connection member 416 when the front panel door part 31 and the drawer part are coupled to each other and may rotate together with the driving of the door-side device 41.

Also, the drawer-side gear 472 may be disposed on the rear end of the drawer-side shaft 47. The drawer-side gear 472 may have a bevel gear shape and be coupled to the shaft gear 434 through the rear opening 384*b*. That is, the drawer-side shaft 47 and the elevation shaft 43, which are disposed to perpendicularly cross each other, may be connected to each other by the drawer-side gear 472 and the shaft gear 434 to transmit the power.

Also, the shaft fixing member 386 may be disposed on the drawer-side shaft 47. The shaft fixing member 386 may be provided in a pair on both left and right sides to support the drawer-side shaft 47 so that the drawer-side shaft 52 is rotatable without being tilted or moving. The shaft fixing member 386 may include a through-part 386*a* having the through-hole 386*c* through which the drawer-side shaft 47 passes. A fixing end 386*b* for the screw-coupling may be disposed on each of upper and lower sides of the through-part 386*a*.

Also, a shaft support member 386*d* may be disposed inside the through-part 386*a*. The shaft support member 386*d* may support a circumference of the drawer-side shaft 47 and have a bearing structure that is penetrated by the drawer-side shaft 47. Thus, the shaft fixing member 386 may stably support the drawer-side shaft 47 and be configured so that the drawer-side shaft 47 is rotatably mounted.

The mounting part 384*c* may be provided in a pair on the shaft mounting part 384 and be coupled to the shaft fixing member 386. The mounting part 384*c* may have a recessed center for accommodating the through-part 386*a* or may protrude so that a screw passing through the fixing end 386*b* of the fixing member 386 is coupled.

Thus, the drawer-side shaft 47 may be maintained in the state of being fixed and mounted by the shaft fixing member 386 on the shaft mounting part 384 and have structure that is rotatable together by being interlocked with the door-side device 41 and the elevation shaft 43.

An elastic member 387 having a spring shape may be further provided on the drawer-side shaft 47. The elastic member 387 may be disposed between the drawer connection member 471 and the shaft fixing member 386 to press the drawer connection member 471 forward. Thus, the drawer connection member 471 may be maintained in the state of being coupled to the door connection member 416 until the drawer part 32 and the front panel door part 31 are separated from each other. The drawer connection member 471 may transmit the power to the drawer-side device 42 so as not to be slipped when the door-side device 41 is driven.

Alternatively, an elastic member support member 388 for supporting the elastic member 387 may be further provided on the drawer-side shaft 47. The elastic member support member 388 may support one end of the elastic member 387 and be mounted on the shaft fixing member 386. Also, the elastic member support member 388 may be molded to be integrated with the shaft fixing member 386.

The drawer-side shaft 47 may be mounted on the outer surface of the drawer body 38, and the elevation shaft 43 may be mounted on the inner surface of the drawer body 38. Also, the shaft mounting part 384 on which the drawer-side shaft 47 is mounted and the mounting part 383 on which the elevation shaft 43 is mounted may communicate with each other through the rear opening 384*b*. Also, the drawer-side gear 472 disposed on the rear end of the drawer-side shaft 47 may be connected to the shaft gear 434 connected to the elevation shaft 43 through the rear opening 384*b*.

Hereinafter, a mounting structure of the drawer-side device 42 mounted inside the drawer body 38 will be described in detail.

Figure 13:
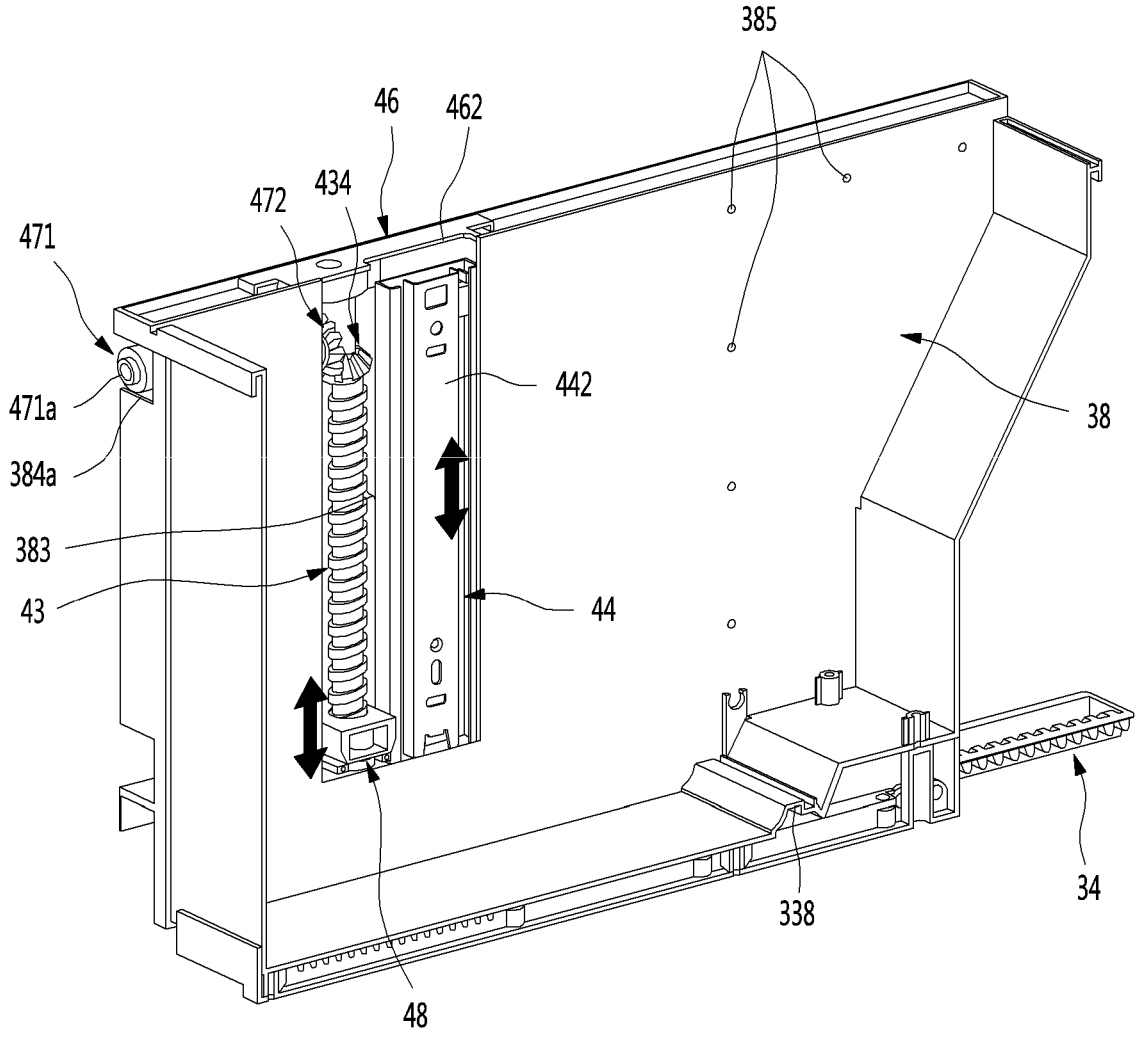
FIG. 13 is a cutaway perspective view illustrating a state in which the elevation shaft and the rail are mounted on a drawer body.

FIG. 13 is a cutaway perspective view illustrating a state in which the elevation shaft and the rail are mounted on the drawer body.

As illustrated in the drawings, the elevation shaft 43 and the elevation rail 44 may be mounted on the mounting part 383 inside the drawer body 38. Here, the upper and lower ends of the elevation shaft 43 may be rotatably supported and have a structure that is mounted so that the shaft gear 434 and the drawer-side gear 472 are gear-coupled to each other.

Also, the shaft holder 48 mounted to be penetrated by the shaft gear 434 may be disposed to face the inside of the drawer body 38. Thus, the shaft holder 48 may be disposed to face the connecting bracket 45. Also, when the elevation shaft rotates, the shaft holder 48 may vertically move along the elevation shaft 43.

The elevation shaft 43 and the elevation rail 44 may be disposed outside the inner wall of the drawer body 38 in the state of being accommodated in the mounting part 383. Thus, when the support member 35 vertically moves, the elevation shaft 43 and the elevation rail 44 may not interfere with other constituents such as the support member 35 or the connecting bracket 45 coupled to the support member 35.

Also, the mounting part bracket 46 may be coupled to the upper end of the mounting part 383 so that the elevation shaft 43 is rotatably fixed and mounted inside the mounting part 383. Also, when the elevation rail 44 extends, the elevation rail 44 may pass through the mounting part bracket 46 to extend upward.

Figure 14:
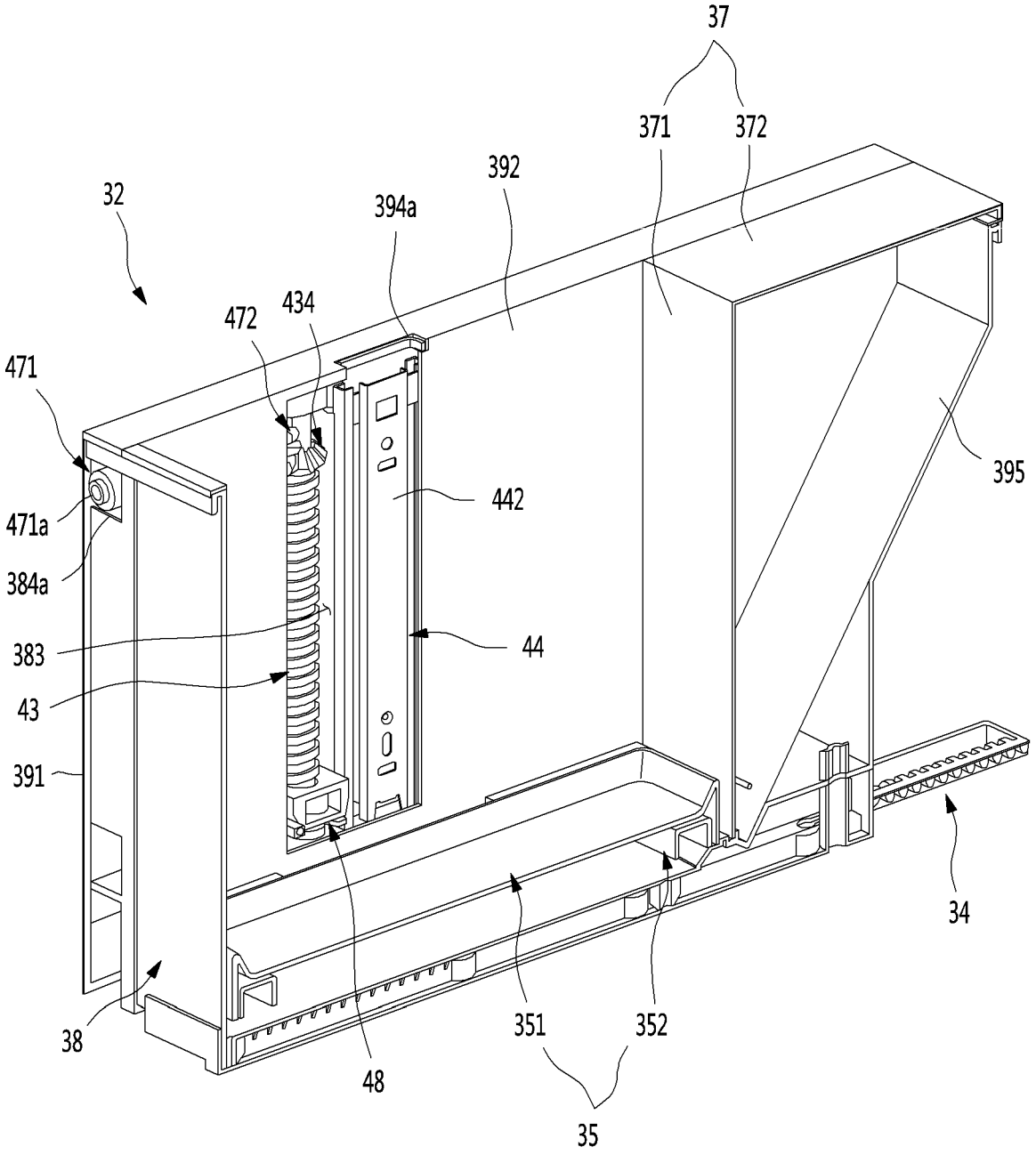
FIG. 14 is a cutaway perspective view illustrating a state in which plates are mounted on the rawer body.

FIG. 14 is a cutaway perspective view illustrating a state in which plates are mounted on the rawer body.

As illustrated in the drawing, in the state in which the elevation shaft 43 and the elevation rail 44 are mounted, an outer side plate 391, an inner side plate 392, and an inner plate 395 may be mounted on the drawer body 38 to define an outer appearance of each of the inside and outside of the drawer body 38.

In detail, an outer portion of both the left and right surfaces, which is exposed when the drawer door 30 is withdrawn may be completely covered by the outer side plate 391. That is, the draw-out rail 33 that is at least a portion of the drawer-side device 42 disposed on the side surface of the drawer body 38 and the constituents disposed on the outer surface of the drawer body 38 in addition to the drawer-side shaft 47 may be completely covered by the outer side plate 391. The outer side plate may be made of a material having a metal texture to realize a more neat and elegant outer appearance.

Also, the space within the drawer part 32, which is seen in the state in which the drawer door 30 is withdrawn may also be defined by the inner side plate 392 and the inner plate 395 to provide the outer appearance of the drawer part 32 having a sense of unity.

The outer appearance and the inner surface of the drawer part 32 may be seen to have the metal texture by mounting the plurality of plates 391, 392, and 395. Although a separate plate for the outer appearance is not provided on the bottom and rear surfaces of the drawer part 32 and the front surface coupled to the front panel door part 31, which are not exposed to the outside, all of the portions exposed to the outside during the use may be substantially covered by the plates 391, 392, and 395.

Particularly, in the state in which the inner side plate 392 is mounted, the mounting part 383 may be exposed through the side opening 394. That is, in the inner side plate 392 is mounted, the elevation shaft 43 and the elevation rail 44 inside the mounting part 383 may be exposed, and the remaining portions may be covered by the inner side plate 392. Also, the support member 35 and the connecting bracket 45 may be coupled to or separated from the shaft holder 48 and the elevation rail 44 through the exposed side opening 394.

An upper end of the inner side plate 392 may be bent outward, and the bent upper end may cover the upper ends of both side surfaces of the drawer body 38 and the mounting part bracket 46 and contact the upper end of the outer side plate 391 to define the outer appearance.

The elevation plate 351 substantially supporting the food or container in the support member 35 may be disposed on the bottom surface of the inside of the drawer body 38. Also, the mounting part 383 and the lower end of the side opening 394 may be disposed above the elevation plate 351 to more facilitate the mounting and service of the elevation shaft 43 and the elevation rail 44. Also, the mounting part 383 and the upper end of the side opening 394 may extend up to the upper end of the side surface of the drawer body 38 to maximally utilize the stroke of the support member 35.

Figure 15:
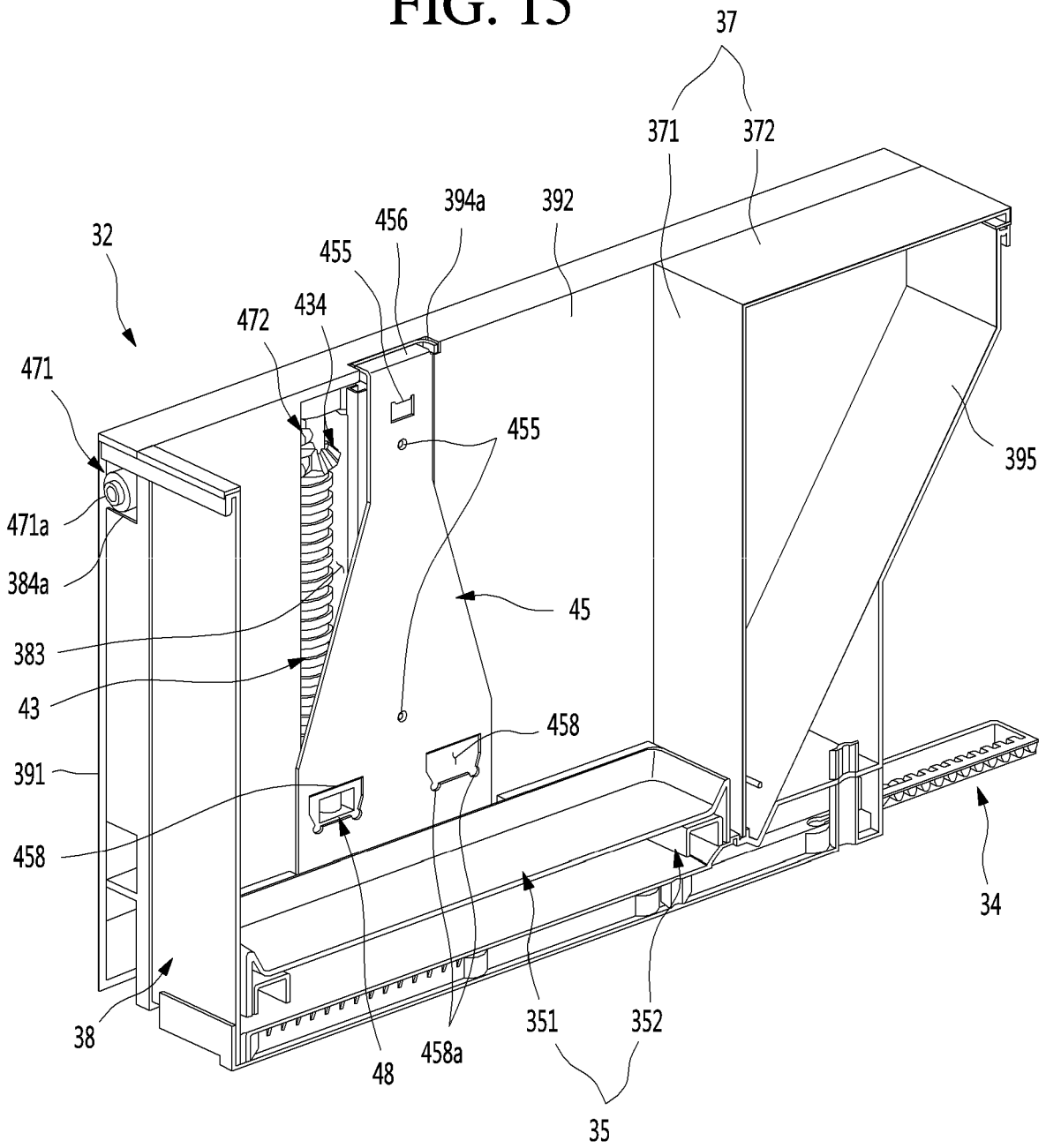
FIG. 15 is a cutaway perspective view illustrating a connecting bracket is mounted on the drawer body.

FIG. 15 is a cutaway perspective view illustrating the connecting bracket is mounted on the drawer body.

As illustrated in the drawing, the lower end of the connecting bracket 45 may be fixed to the support member 35, and the outer surface of the connecting bracket 45 may be coupled to the shaft holder 48 and the support member 35. Thus, the elevation plate 351 or the elevation frame 352 may be connected to the shaft holder 48 and the connecting bracket 45 by the connecting bracket 45. Here, the support member 35, the shaft holder 48, and the elevation rail 44 may be coupled to surfaces opposite to each other with respect to the connecting bracket 45 having the plate shape.

In the state in which all of the support member 35, the shaft holder 48, and the elevation rail 44 may be coupled to the connecting bracket 45, when the elevation shaft 43 rotates, the shaft holder 48 may vertically move together with the connecting bracket 45. Also, the vertical movement of the connecting bracket 45 may be guided by the elevation rail 44 disposed at a center of the connecting bracket 45, and thus, the support member 35 may be vertically elevated in the stable state without being tilted.

Here, since the shaft holder 48 moves upward along the elevation shaft 43, and the elevation rail 44 extends, the connecting bracket 45 may also move upward together to lift the support member 35 upward. On the other hand, when the shaft holder 48 moves downward along the elevation shaft 43, the elevation rail 44 may be contracted, and thus, the connecting bracket 45 may move downward together with the elevation rail 44. Thus, the support member 35 may move to the bottom surface of the inside of the drawer body 38.

Figure 16:
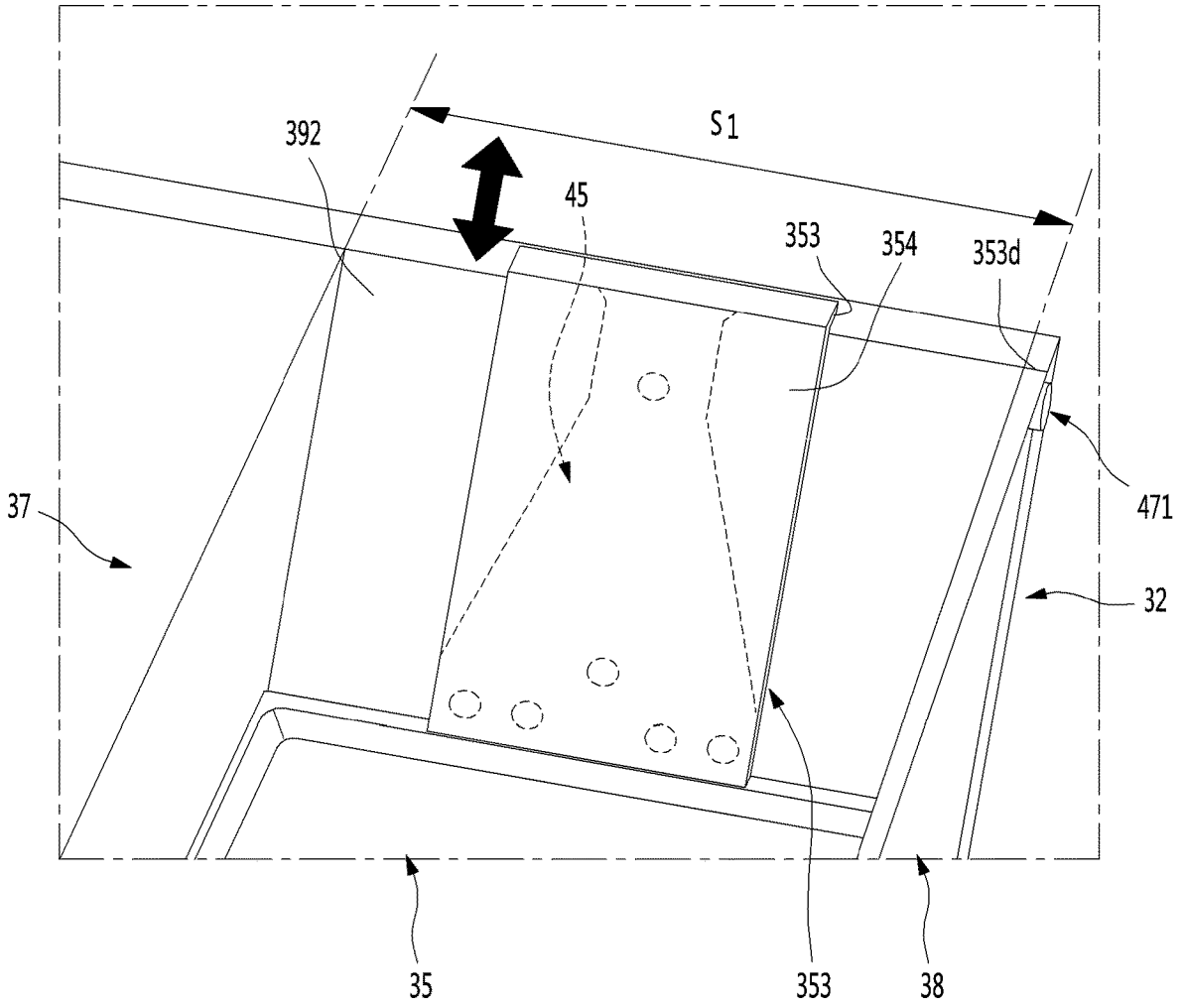
FIG. 16 is a partial perspective view illustrating a state in which a side cover is mounted on the drawer body.

FIG. 16 is a partial perspective view illustrating a state in which the side cover is mounted on the drawer body.

In the state of FIG. 15, the connecting bracket 45 may be coupled to the side cover 353. The side cover 353 may have a size that is enough to cover all of the mounting part 383 and the side opening 394 in addition to the connecting bracket 45.

The side cover 353 may be coupled to a side end of the elevation frame 352 or the elevation plate 351. Thus, when the support member 35 is elevated, and the elevation rail 44 is inserted and withdrawn, the support member 35 and the elevation rail 44 may vertically move together with each other. Also, the elevation shaft and the elevation rail, which constitute the drawer-side device 42, and the connecting bracket 45 may not be exposed.

Also, an upper end covering part 353*d* that is bent outward may be disposed on an upper end of the elevation side cover 353 to cover the inner surface of the drawer part 32 and a portion of the upper end of the drawer part 32. In addition, the mounting part bracket 46 exposed to the upper end and the upper end of the elevation rail 44 may be covered from the upper side.

The side cover 353 may be configured to surround the connecting bracket 45, thereby preventing the connecting bracket 45 from being exposed. Also, the side cover 353 may be made of a plate-material like the inner side plate 392.

That is, in the state in which the side cover 353 is mounted, all of the connecting bracket 45 as well as the elevation shaft and the connecting bracket 45, which are covered by the connecting bracket 45, may not be exposed. Thus, the inner surface of the drawer part 32 may be defined by the side cover 353 and the inner side plate 392.

The side cover 353 may be injection-molded by using plastic as necessary. Alternatively, a cover plate 354 made of a metal material like the inner side plate 392 may be attached to the outer surface of the side cover 353, or a material having a metal texture may be applied to the outer surface of the side cover 353.

Since the side cover 353 is in the state of being coupled to the connection member 45, the side cover 353 may be elevated together with the support member 35 when the support member 35 is elevated. Also, while the support member 35 is elevated, all of the constituents covered by the connecting bracket 45 may not be exposed to the outside, and the unity of the outer appearance may also be maintained.

Hereinafter, a state in which the drawer door 30 of the refrigerator 1 is inserted and withdrawn and is elevated according to an embodiment will be described in more detail with reference to the accompanying drawings.

Figure 17:
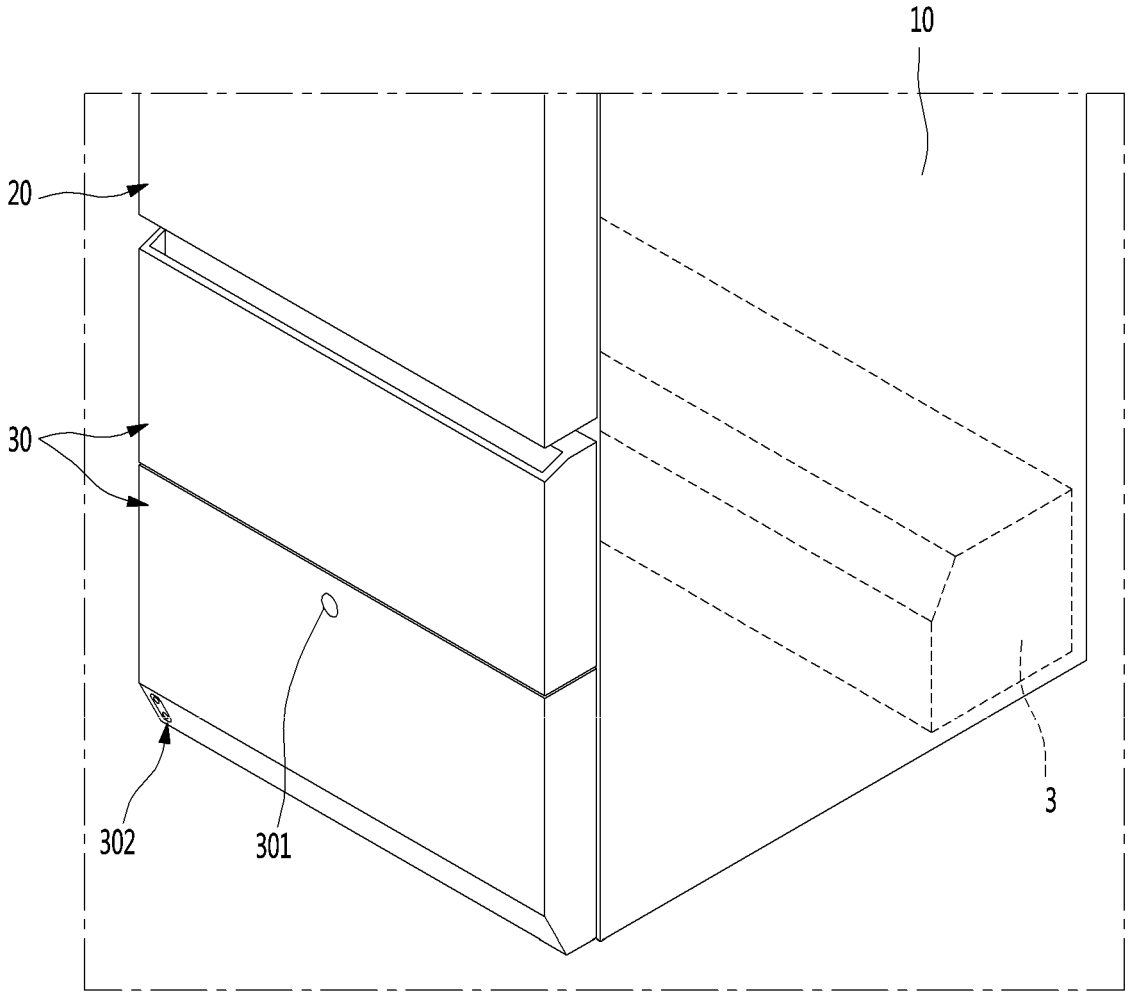
FIG. 17 is a perspective view illustrating a state in which the drawer door is closed.

FIG. 17 is a perspective view illustrating a state in which the drawer door is closed.

As illustrated in the drawing, in the state in which the food is stored, the refrigerator 1 may be maintained in a state in which all of the rotation door 20 and the drawer door 30 are closed. In this state, the user may withdraw the drawer door 30 to accommodate the food.

The drawer door 30 may be provided in plurality in a vertical direction and be withdrawn to be opened by the user's manipulation. Here, the user's manipulation may be performed by touching the manipulation part 301 disposed on the front surface of the rotation door 20 or the drawer door 30. Alternatively, an opening command may be inputted on the manipulation device 302 provided on the lower end of the drawer door 30. Also, the manipulation part 301 and the manipulation device 302 may individually manipulate the insertion and withdrawal of the drawer door 30 and the elevation of the support member 35. Alternatively, the user may hold a handle of the drawer door 30 to open the drawer door 30.

Hereinafter, although the lowermost drawer door 30 of the drawer doors 30, which are disposed in the vertical direction, is opened and elevated as an example, all of the upper and lower drawer doors 30 may be inserted and withdrawn and elevated in the same manner.

Figure 18:
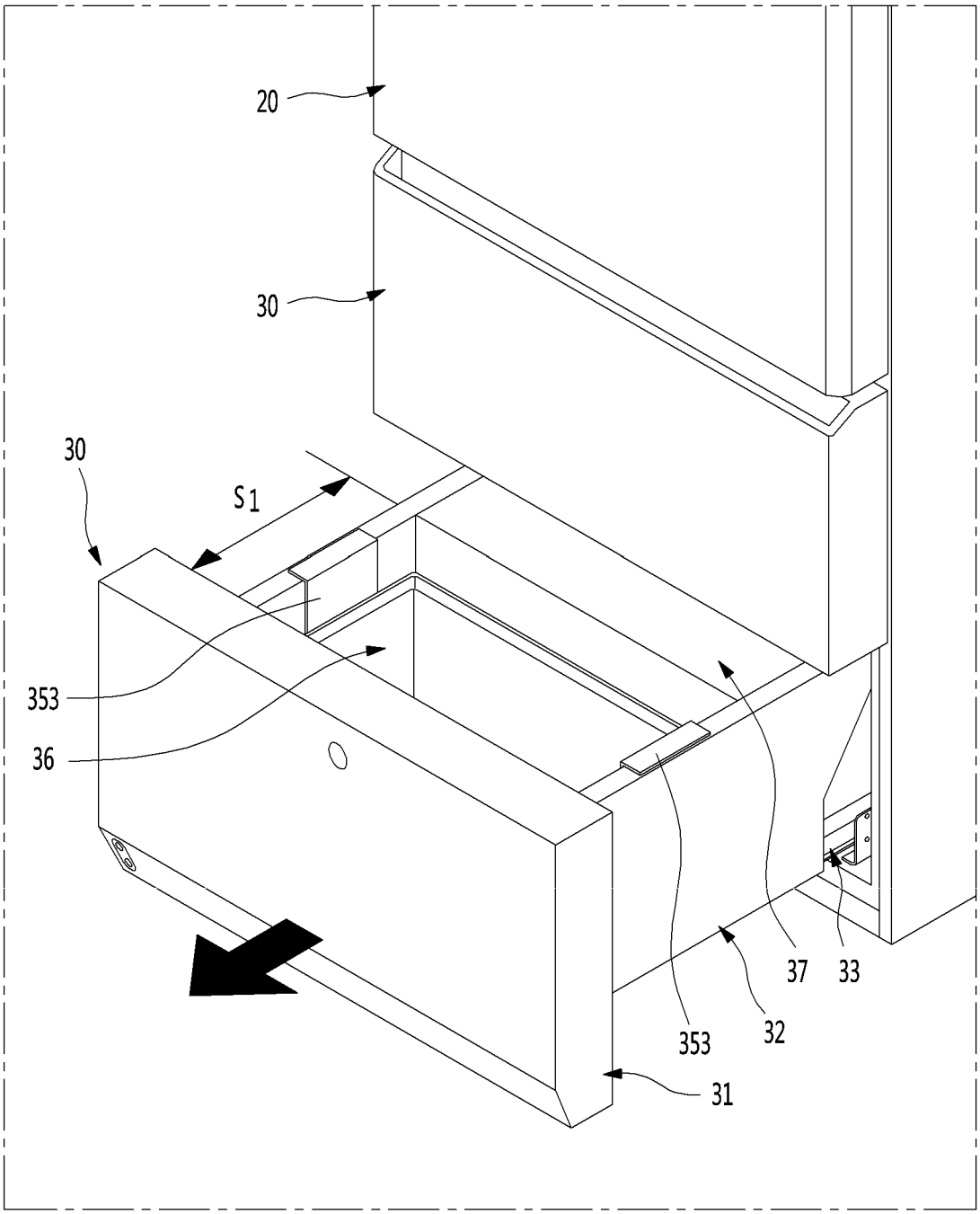
FIG. 18 is a perspective view illustrating a state in which the drawer door is completely opened.
Figure 19:
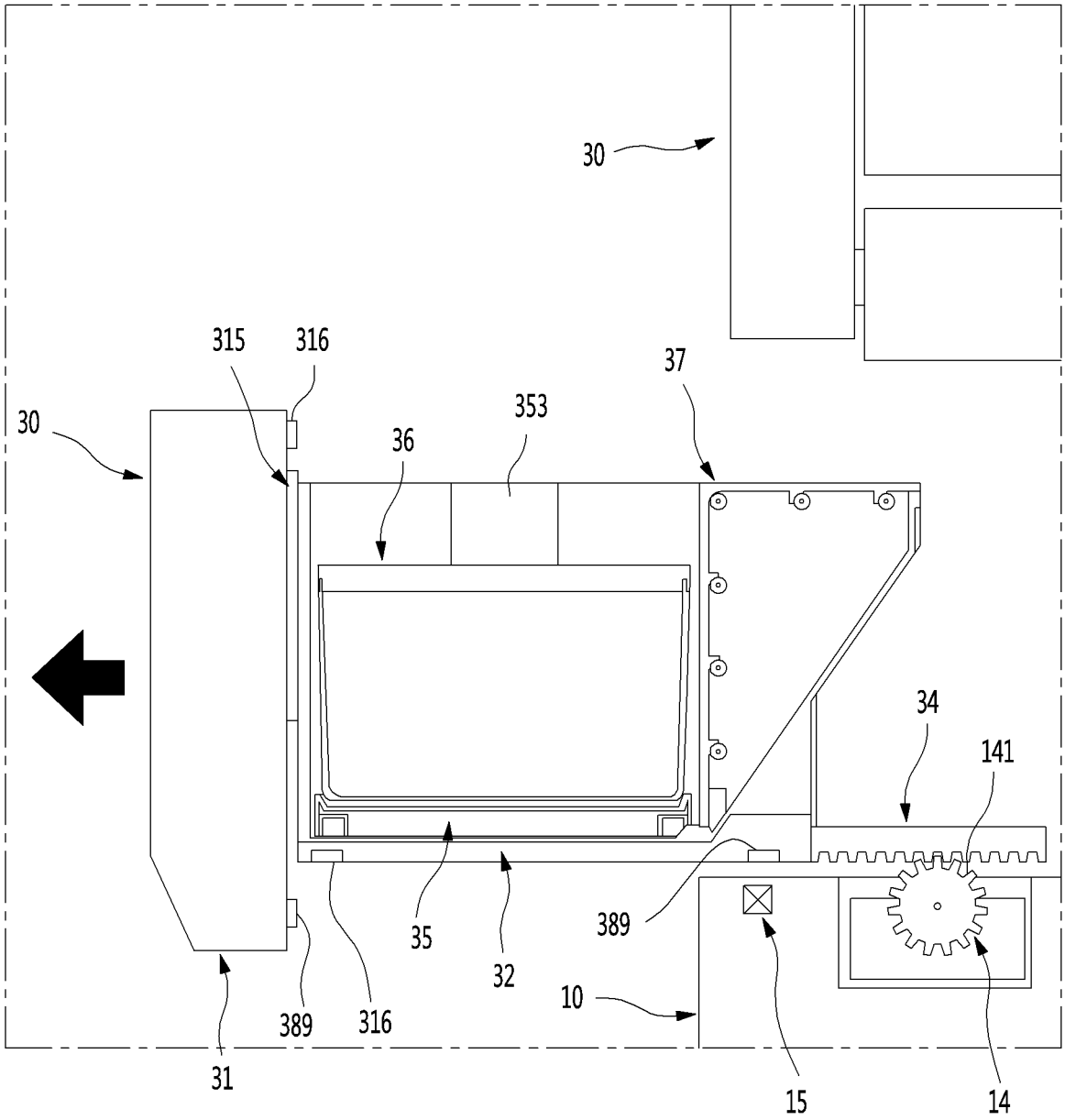
FIG. 19 is a cross-sectional view of the drawer door in the state of FIG. 18.

FIG. 18 is a perspective view illustrating a state in which the drawer door is completely opened. FIG. 19 is a cross-sectional view of the drawer door in the state of FIG. 18.

As illustrated in the drawings, the user may manipulate the draw-out operation on the drawer door 30 to withdraw the drawer door 30 forward. The drawer door 30 may be withdrawn while the draw-out rail 33 extends.

The drawer door 30 may be configured to be inserted and withdrawn by the driving of the draw-out motor 14, not by a method of directly pulling the drawer door 30 by the user. The draw-out rack 34 provided on the bottom surface of the drawer door 30 may be coupled to the pinion gear 141 rotating when the draw-out motor 14 provided in the cabinet 10 is driven. Thus, the drawer door 30 may be inserted and withdrawn according to the driving of the draw-out motor 14.

The draw-out distance of the drawer door 30 may correspond to a distance at which the front space S1 within the drawer part 32 is completely exposed to the outside. Thus, in this state, the support member 35 may not interfere with the doors 20 and 30 disposed thereabove or the cabinet 10.

Here, the draw-out distance of the drawer door 30 may be determined by a draw-out detection device 15 disposed on the cabinet 10 and/or the drawer door 30. The draw-out detection device 15 may be provided as a detection sensor that detects a magnet 389 to detect a state in which the drawer door 30 is completely withdrawn or closed.

For example, as illustrated in the drawings, the magnet 389 may be disposed on the bottom of the drawer part 32, and the detection sensor may be disposed on the cabinet 10. The draw-out detection device 15 may be disposed at a position corresponding to a position of the magnet 389 when the drawer door 30 is closed and a position of the magnet 389 when the drawer door 30 is completely withdrawn. Thus, the draw-out state of the drawer door 30 may be determined by the draw-out detection device 15.

Also, as necessary, a switch may be provided at each of positions at which the drawer door 30 is completely inserted and withdrawn to detect the draw-out state of the drawer door 30. In addition, the draw-out state of the drawer door 30 may be detected by counting the rotation number of draw-out motor 14 or measuring a distance between the rear surface of the front panel door part 31 and the front end of the cabinet 10.

In the state in which the drawer door 30 is completely withdrawn, the elevation motor 411 may be driven to elevate the support member 35. The support member 35 may be driven in an even situation in which the drawer door 30 is sufficiently withdrawn to secure safe elevation of the food or container 36 seated on the support member 35.

That is, in the state in which the drawer door 30 is withdrawn to completely expose the front space to the outside, the support member 35 may ascend to prevent the container 36 or the stored food seated on the support member 35 from interfering with the doors 20 and 30 or the cabinet 10.

The ascending of the support member 35 may start in a state in which the drawer door 30 is completely withdrawn. Also, to secure the user's safety and prevent the food from being damaged, the ascending of the support member 35 may start after a set time elapses after the drawer door 30 is completely withdrawn.

After the drawer door 30 is completely withdrawn, the user may manipulate the manipulation part 301 to input the ascending of the support member 35. That is, the manipulation part 301 may be manipulated to withdraw the drawer door 30, and the manipulation part 301 may be manipulated again to elevate the support member 35. Also, the drawer door 30 may be manually inserted and withdrawn by a user's hand. After the drawer door is withdrawn, the manipulation part 301 is manipulated to elevate the support member 35.

Figure 20:
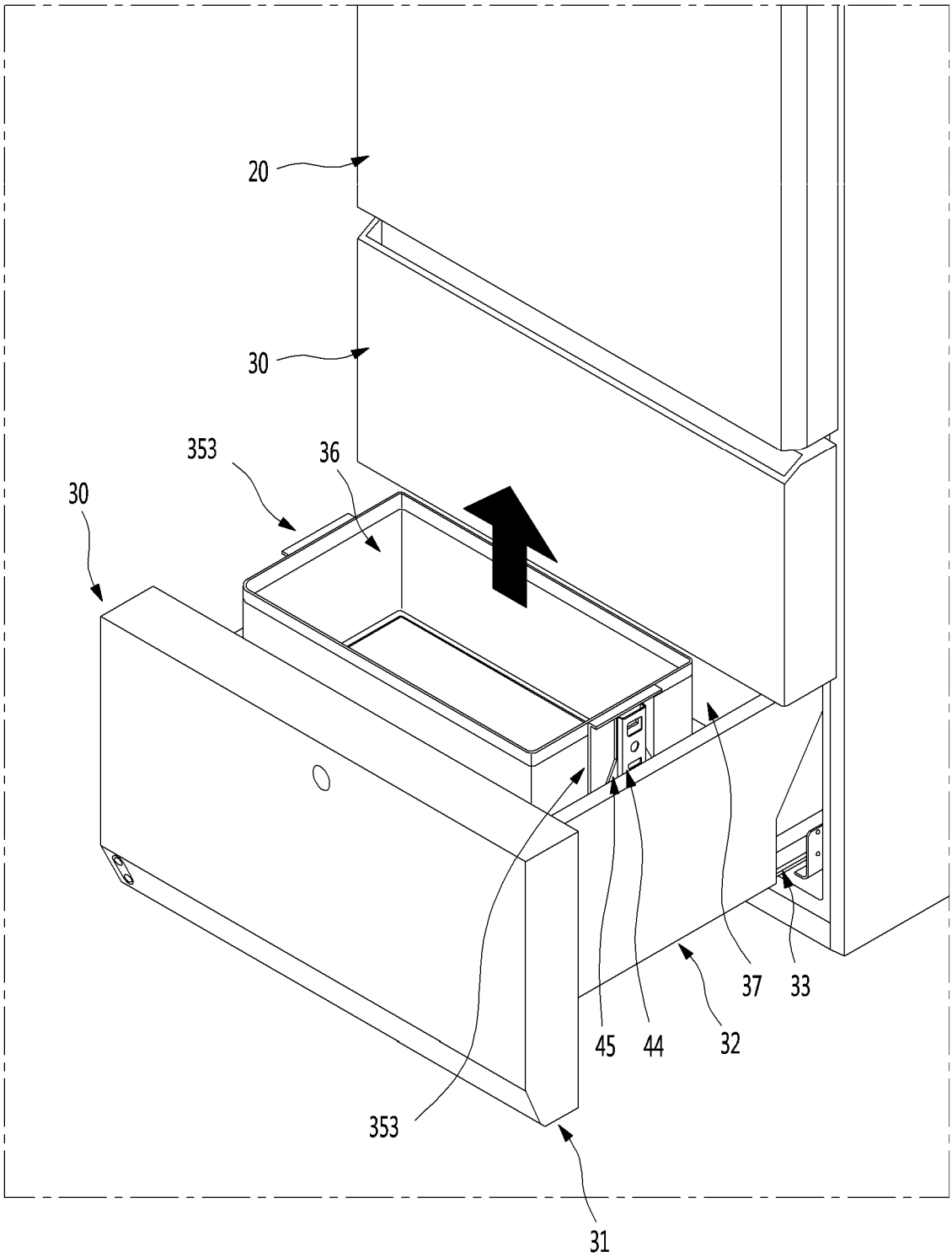
FIG. 20 is a perspective view illustrating a state in which a support member of the drawer door is completely elevated.
Figure 21:
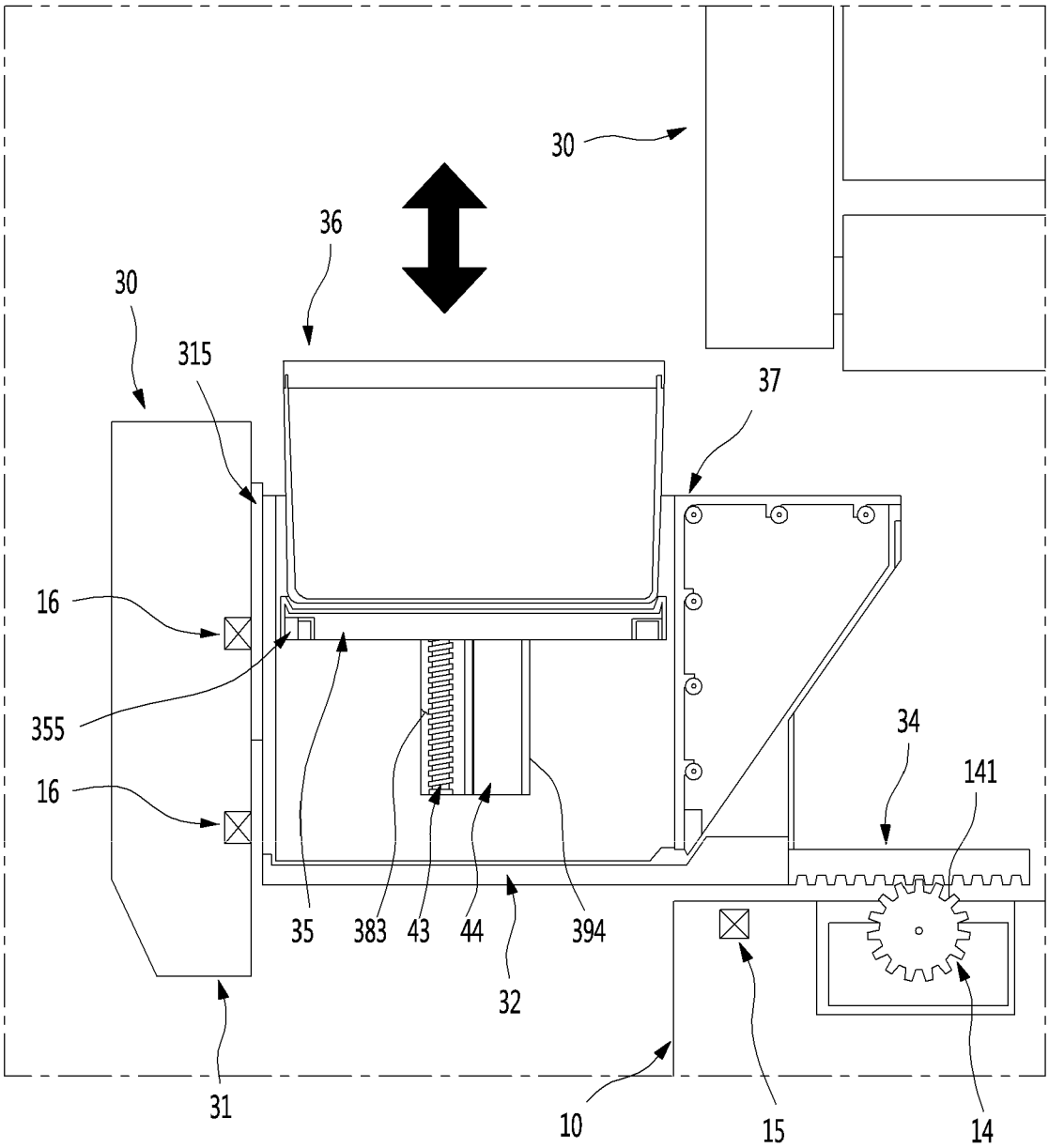
FIG. 21 is a cross-sectional view of the drawer door in the state of FIG. 20.

FIG. 20 is a perspective view illustrating a state in which the support member of the drawer door is completely elevated. FIG. 21 is a cross-sectional view of the drawer door in the state of FIG. 20.

In the state of FIGS. 18 and 19, the elevation of the support member 35 may be performed in the state in which the drawer door 30 is withdrawn. The support member 35 may be elevated by the operation of the elevation motor 411. In the state in which the door-side device of the front panel door part and the drawer-side device 42 of the drawer part 32 are coupled to each other, the power may be transmitted to elevate the support member 35.

In more detail, when the elevation motor 411 operates, the door-side shafts 413 connected to the elevation motor 411 may rotate, and also the first gear 414 and the second gear 415 connected to the door-side shaft 413 may rotate.

The rotation force of the door-side device 41 may be transmitted to the drawer-side device 42 by door connection member 416 and the drawer connection member 471, which are coupled to each other. Thus, the rotation force transmitted from the door-side device 41 may allow the drawer-side shaft 47 and the drawer-side gear 472 of the end of the drawer-side shaft 47 to rotate.

The rotation force may be transmitted in the state in which the drawer-side gear 472 and the shaft gear 434 are connected to each other, and the rotation force of the drawer-side shaft 47 may allow the elevation shaft 43 to rotate. Due to the rotation of the elevation shaft 43, the screw holder 48 may move upward along the elevation shaft 43.

Here, the screw holder 48 may vertically move together with the connecting bracket 45 in the state of being coupled to the connecting bracket 45, and the support member 35 coupled to the connecting bracket 45 may also move upward. Here, the elevation rail 44 disposed at the center of the connecting bracket 45 may extend upward to allow the support member 35 to be stably elevated without being tilted.

Also, the side cover 353 disposed on each of both sides of the support member 35 may cover the connecting bracket 45, the mounting part 383, and the constituents constituting the inside of the mounting part 383 so that the connecting bracket 45, the mounting part 383, and the constituents constituting the inside of the mounting part 383 are not exposed in the state of being covered and also prevent the food from being introduced or caught.

The support member 35 may ascend by a sufficient height so that the user is accessible to the food or container seated on the support member 35. Thus, the user may easily lift the food or container.

The support member 35 may ascend until the screw holder 48 is disposed at the upper end of the elevation shaft 43. When the ascending of the support member 35 is completed, the driving of the elevation motor 411 is stopped.

When an ascending completion signal is inputted, the driving of the elevation motor 411 may be stopped. For this, a height detection device 16 for detecting a position of the support member 35 may be provided. The height detection device 16 may be provided in the front panel door part 31 at a height corresponding to the uppermost ascending position of the support member 35 and the lowermost descending position of the support member 35.

The height detection device 16 may be provided as a detection sensor that detects a magnet 355. The height detection device 16 may detect the magnet 355 disposed on the support member 35 to determine whether the ascending of the support member 35 is completed. Also, the height detection device 16 may be provided as a switch structure to turn on the switch when the support member 35 maximally ascends. Also, the height detection device 16 may be provided on the elevation rail 44 or the elevation shaft 43 to detect the maximally ascending position of the support member 35. Also, whether the support member 35 maximally ascends may be determined according to a variation in load applied to the elevation motor 411.

The driving of the elevation motor 411 is stopped in the state in which the support member 35 maximally ascends. In this state, although the support member 35 is disposed inside the drawer part 32, the food or container 36 seated on the support member 35 may be disposed at a position higher than the opened top surface of the drawer part 32. Thus, the user may easily access the food or container 36. Particularly, it is not necessary to allow the waist excessively for lifting the container 36, so that it is possible to perform safer and more convenient operation.

After the user's food storing operation is completed, the user may allow the support member 35 to descend by manipulating the manipulation part 301. The descending of the support member 35 may be performed by reverse rotation of the elevation motor 411 and may be gradually performed through the reverse procedure with respect to the above-described procedure.

Also, when the descending of the support member 35 is completed, i.e., in the state of FIG. 18 or 19, the completion of the descending of the support member 35 may be performed by the height detection device 16. The height detection device 16 may be further provided at a position that detects the magnet disposed on the support member 35 when the support member 35 is disposed at the lowermost descending position. Thus, when the completion of the descending of the support member 35 is detected, the driving of the elevation motor is stopped.

Also, after the driving of the elevation motor 411 is stopped, the drawer door 30 may be inserted. Here, the drawer door 30 may be closed by the user's manipulation or by the driving of the draw-out motor 14. When the drawer door 30 is completely closed, a state of FIG. 17 may become.

In addition to the foregoing embodiment, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 22:
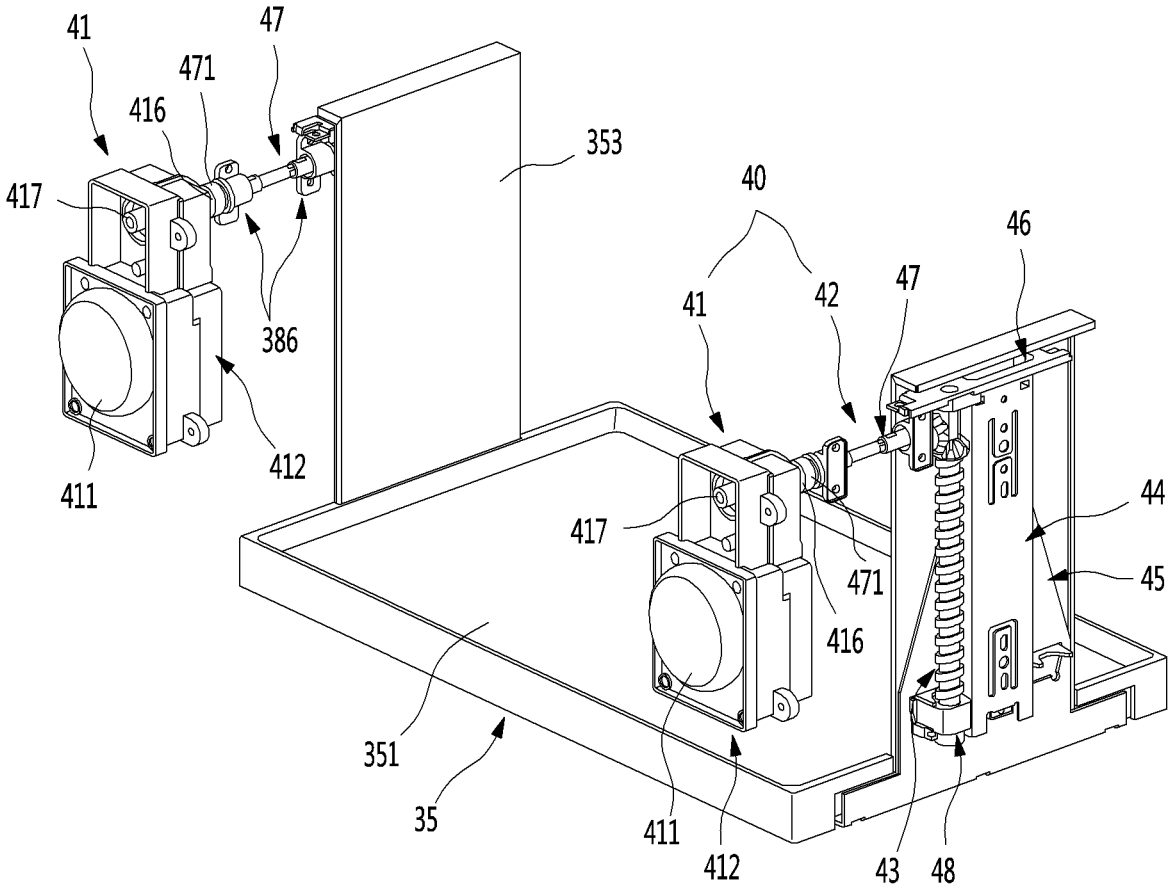
FIG. 22 is a perspective view illustrating a structure of an elevation assembly according to a second embodiment.

FIG. 22 is a perspective view illustrating a structure of the elevation assembly according to a second embodiment.

As illustrated in the drawings, an elevation assembly 40 according to another embodiment may include a door-side device 41 and a drawer-side device 42. The door-side device 41 may be provided in a front panel door part 31 of a drawer door 30, and the drawer-side device 42 may be provided in a drawer part 32 of a drawer door 30. When the front panel door part 31 and the drawer part 32 are coupled to each other, the drawer-side device 42 and the door-side device 41 may be connected to each other to transmit power. Also, the door-side device 41 and the drawer-side device 42 may be separated from each other. Thus, the front panel door part 31 and the drawer part 32 may be separated from each other.

The door-side device 41 may be provided in the front panel door part 31 and include an elevation motor 411, a motor assembly 412 including gears connected to the elevation motor 411, a door-side shaft 417 connected to the motor assembly 412 to rotate, and a door connection member 416 disposed on an end of the door-side shaft 417.

Here, a motor shaft of the elevation motor 411 may be disposed in a front and rear direction. The motor assembly 412 may have a width direction in parallel to a front surface of the front panel door part 31 to minimize a depth occupied by installing the motor assembly 412 in the front panel door part 31. Also, the door-side shaft 417 may be disposed in the front and rear direction and connected to the door connection member 416. Also, if necessary, the door-side shaft 417 and the door connection member 416 may be integrated with each other.

Also, each of the motor assembly 412, the door-side shaft 417, and the door connection member 416 may be provided in a pair, which are disposed on both left and right sides and have the same structure. Also, the elevation motors 411 disposed on both sides may operate together with each other and also operate at the same time so that the support member 35 is elevated in a horizontal state without being tilted and generate rotation force having the same intensity.

The elevation motor 411 may be disposed on each of both the left and right sides. Thus, when compared with a case in which one elevation motor is provided, the elevation motor 411 may decrease in size to minimize a thickness of the motor assembly 412 in the front and rear direction. Thus, an insulation thickness of the front panel door part 31 may be sufficiently secured.

Also, the pair of elevation motors 41 may be used to provide larger force to the support member 35. Thus, the more stable elevation operation of the support member 35 may be secured in the even state in which a heavy food or container is seated on the support member 35.

The drawer-side device 42 may be connected to the door-side device 41. Since the rawer-side device 42 has the same structure as the rawer-side device according to the foregoing embodiment, its detailed description will be omitted.

In addition to the foregoing embodiments, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Particularly, in the third embodiment, other constituents except for the drawer-side device 50 and constituents having a coupling relationship with the drawer-side device 50 are the same as those according to the forgoing embodiments.

Figure 23:
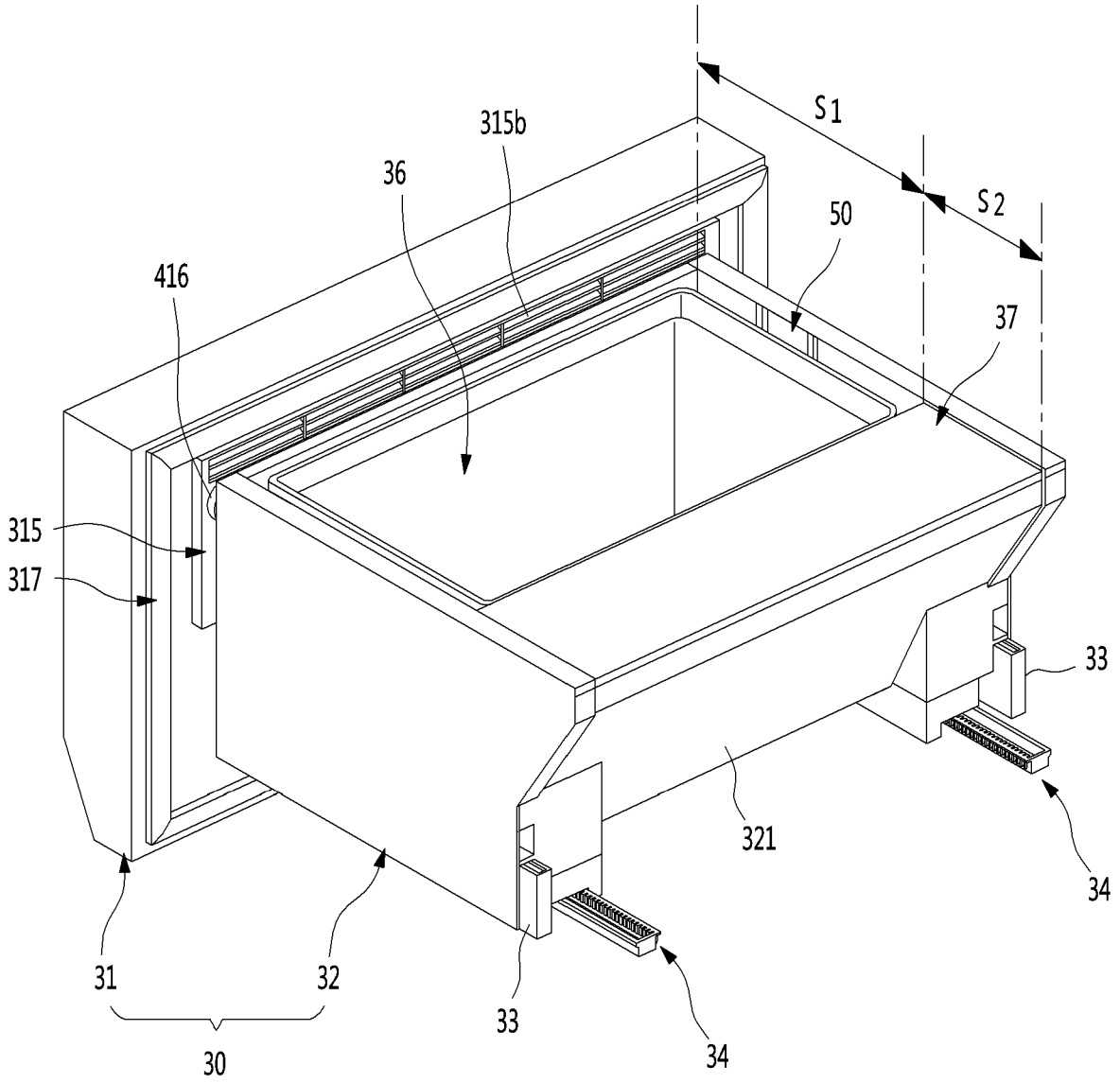
FIG. 23 is a perspective view of a drawer door according to a third embodiment.
Figure 24:
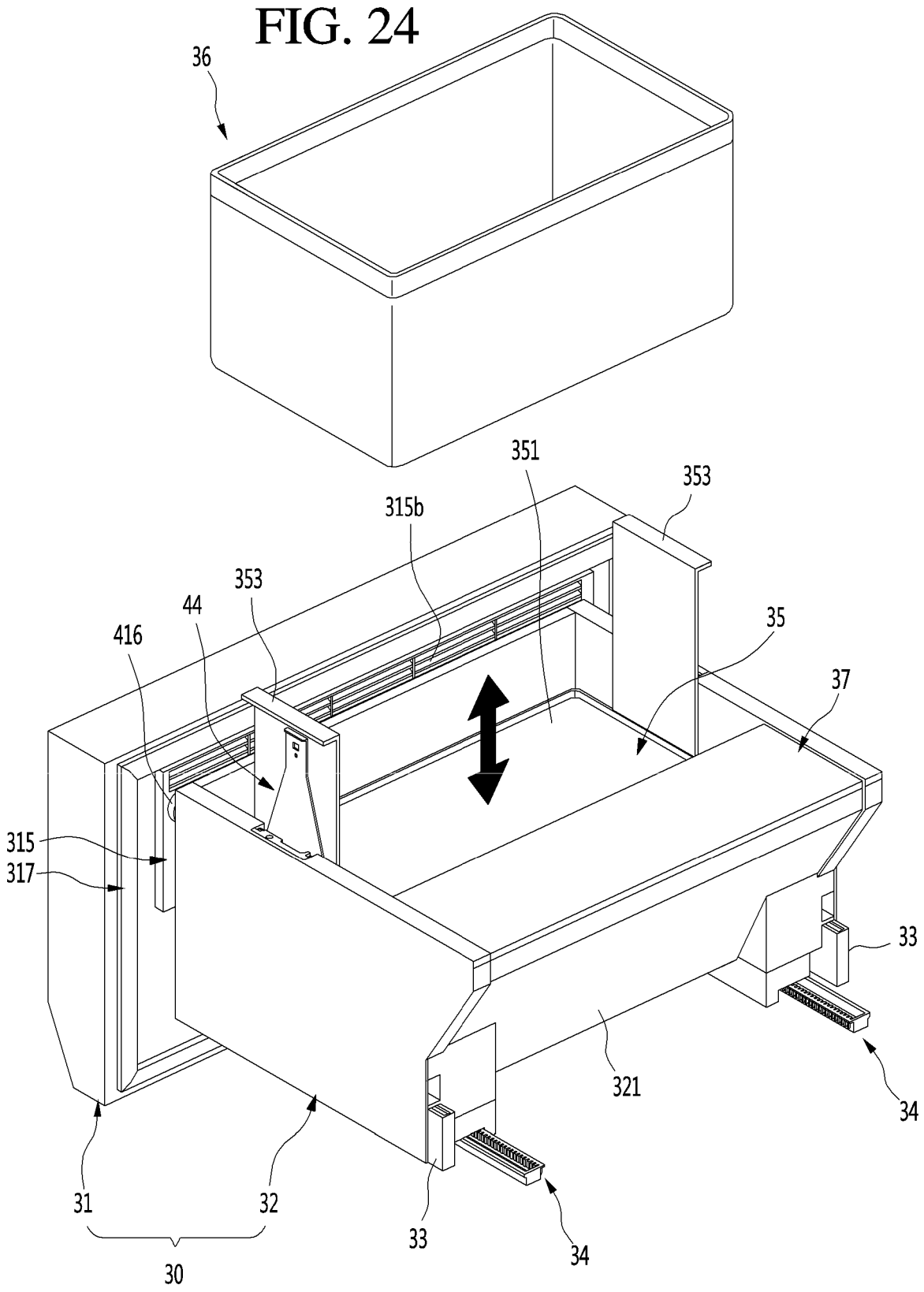
FIG. 24 is a perspective view illustrating a state in which a container of the drawer door is separated.
Figure 25:
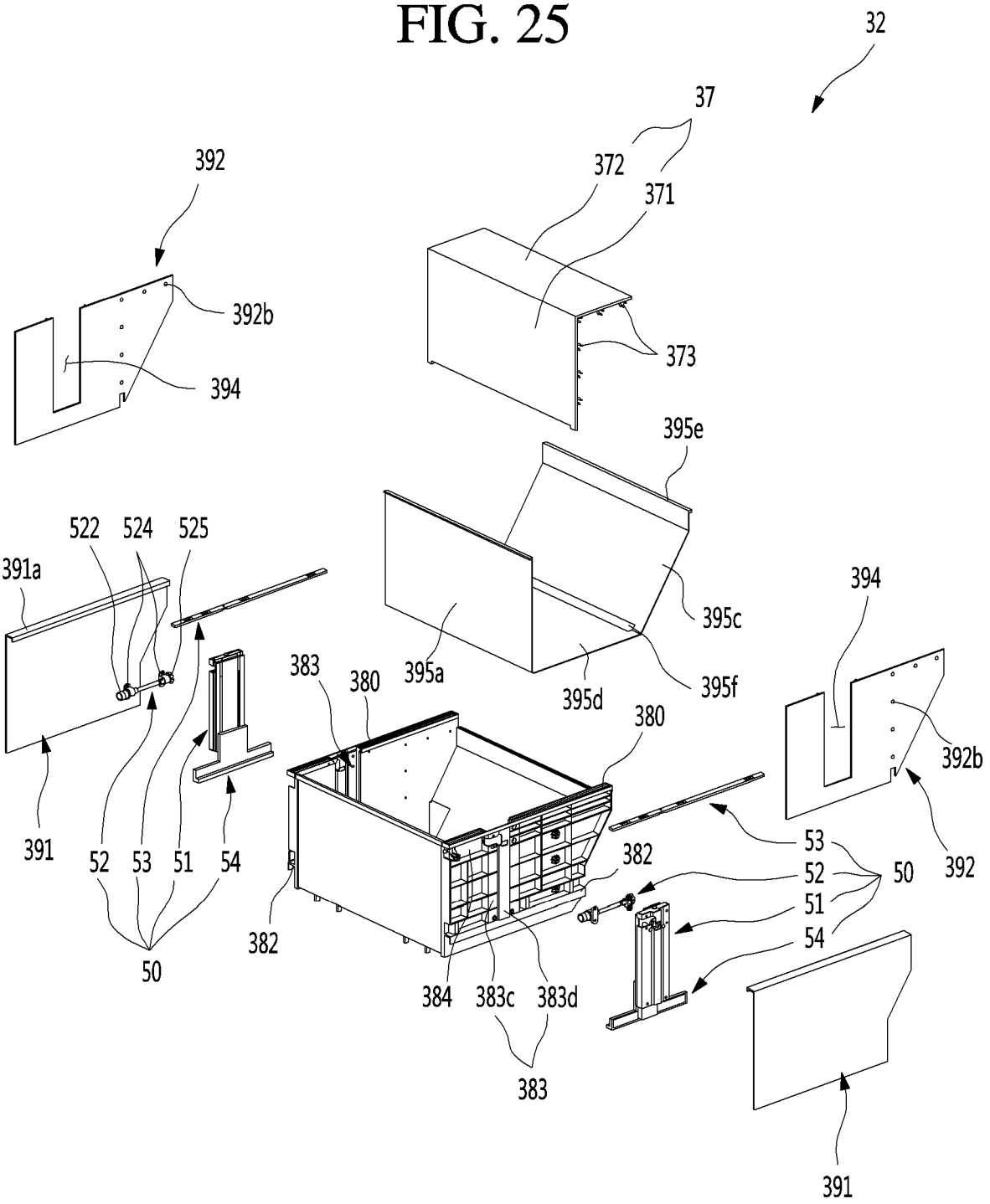
FIG. 25 is an exploded perspective view of a drawer part.
Figure 26:
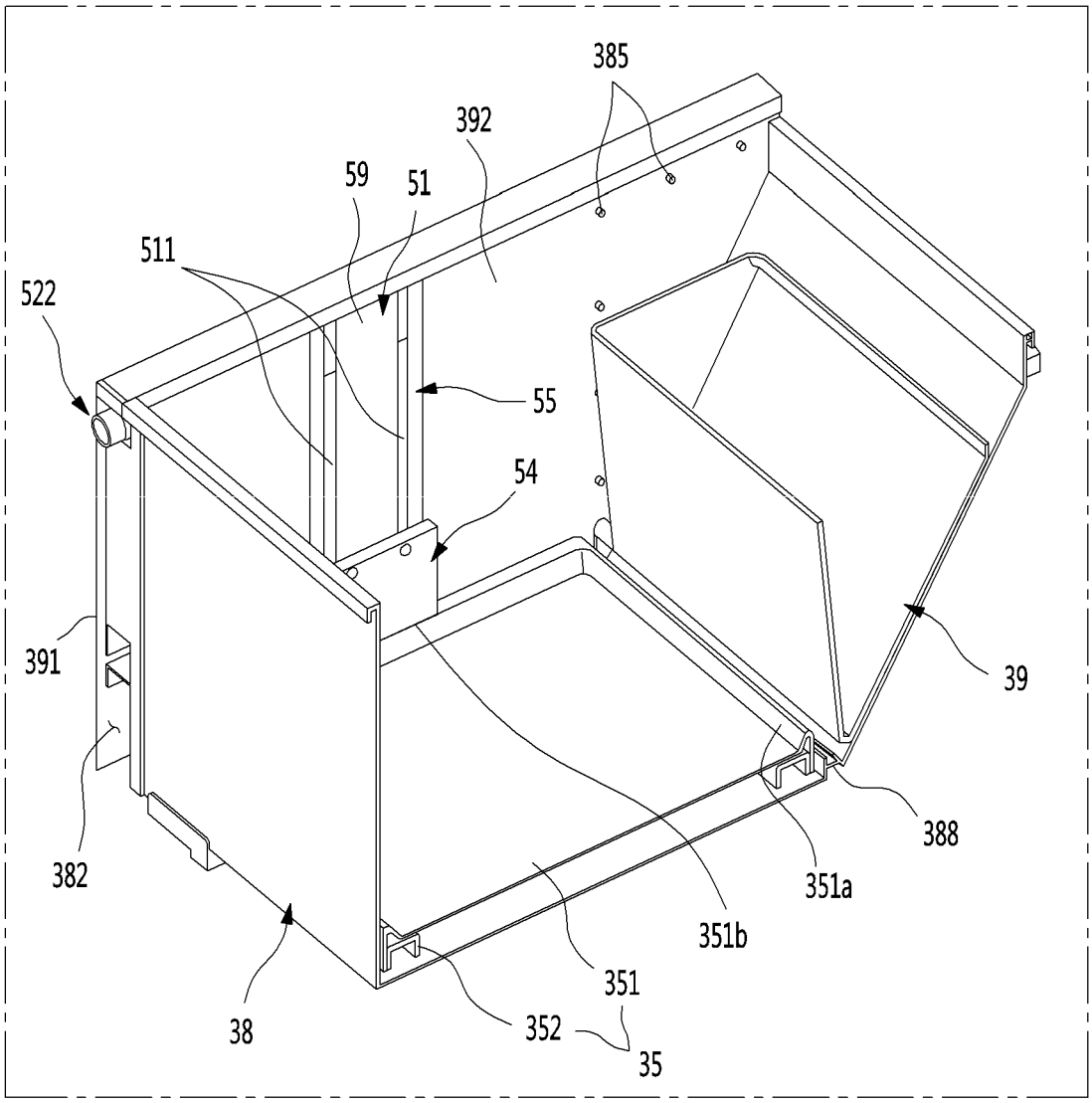
FIG. 26 is a cutaway perspective view illustrating a structure of the drawer part.

FIG. 23 is a perspective view of a drawer door according to a third embodiment. Also, FIG. 24 is a perspective view illustrating a state in which a container of the drawer door is separated.

A drawer door 30 according to the third embodiment may have the same structure as that of the foregoing embodiment. However, a drawer-side device 50 is provided on each of both left and right sides of a drawer part 32, and detailed structure of the drawer-side device 50 may have a different structure.

The drawer-side device 50 may include an elevation device 51, a drawer-side shaft 52, a mounting part bracket 53, and a connecting bracket 54. Among them, the drawer-side shaft 52 may have the same structure except for only reference numerals A rail mounting part 382 on which a draw-out rail 33 is mounted may be disposed on a lower portion of each of both side surfaces of the drawer body 38. The rail mounting part 382 may be disposed in an inner region of the drawer flange 380, which will be described below, and may be covered by the outer side plate 391.

A mounting part 383 on which the elevation device 51 that is a main component is mounted may be recessed inside both the side surfaces of the drawer body 38. The mounting part 383 may be recessed outward from the inner surface of the drawer body 38 providing the drawer space.

The mounting part 383 may extend in the vertical direction. Here, the mounting part 383 may vertically extend from the upper end of the drawer body 38 to the bottom surface of the drawer body 38. Here, a lower end of the mounting part 383 may be disposed above a lower end of each of both the side surfaces of the drawer body 38. The lower end of the mounting part 383 may extend up to the rail mounting part 382. Thus, the mounting part 382 may not interfere with the draw-out rail 33 and the components of the mounting of the draw-out rail.

Also, the inner surface of the mounting part 383 may have a shape corresponding to that of the outer surface of the elevation device 51. Here, in the even state in which the load is applied, the stably mounted state of the elevation device 51 may be maintained.

In detail, the mounting part 383 may include a first mounting part 383*c* recessed at a central portion and a second mounting part 383*d* recessed at each of both sides of the first mounting part 383*c*. Here, the first mounting part 383*c* may be further recessed than the second mounting part 383*d* to form a stepped portion between the first mounting part 383*c* and the second mounting part 383*d*. Thus, the elevation device 51 having the corresponding shape may be restricted in the mounted state without rotating.

Also, the elevation device 51 may be disposed on the same plane as the inner surface of the drawer body 38 in the state of being mounted on the mounting part 383 to prevent the interference when the support member 35 is elevated and provide a sense of unity.

A bottom surface of the mounting part 383 may support a lower end of the elevation device 51. Also, the top surface of the mounting part 383 may be opened so that the elevation device is inserted through the opened upper side. Here, the elevation device 51 may be inserted to be slid from the upper side so that both ends of the elevation device 51 is restricted within the mounting part 383.

A mounting part bracket 53 may be disposed on the opened top surface of the mounting part 383. The mounting part bracket 53 may be made of a metal material and mounted on an upper end of each of both side surfaces of the drawer body 38 to restrict the upper end of the elevation device 51.

In detail, the mounting part bracket 53 may be mounted on the upper end of each of both the ends of the drawer body 38 to pass through the opened top surface of the mounting part 383. Here, a bracket hole into which a cap protrusion (see reference numeral 581*a* of FIG. 11) is inserted may be defined in the top surface of the elevation device 51 in one side of the mounting part bracket 53 corresponding to the opened top surface of the mounting part 383. Also, the mounting part bracket 53 may extend from the front end to rear end of each of both the side surfaces of the drawer body 38 and be firmly fixed to the drawer body 38 by a plurality of fixing members. Thus, the elevation device may be maintained in the state of being more stably and firmly mounted on the drawer body 38.

The elevation device 51 may be connected to both ends of the support member 35 by the connecting bracket 54. Also, the elevation device 51 may operate to allow the support member 35 to vertically move and guide smooth vertical movement of the support member 35.

The shaft mounting part 384 may be opened outward from the upper end of each of both the side surfaces of the drawer body 38 to communicate with the mounting part 383. Thus, the drawer-side shaft 52 mounted on the shaft mounting part 384 may be coupled to the elevation device 51 mounted on the mounting part 383 to transmit the power.

The mounting part 383 may have a shape that is recessed from the inner surface of the drawer body 38, and the shaft mounting part 384 may have a shape that is recessed from the outer surface of the drawer body 38. Thus, when the drawer body 38 is molded, a mold may have a simple structure so that the drawer body 38 is easily molded.

The mounting part 383 and the shaft mounting part 384 may be disposed inside a region of the drawer flange 380 that is bent outward from an upper end of each of both side surfaces of the drawer body 38. That is, the mounting part 383 and the shaft mounting part 384 may be disposed below the region in which the drawer flange 380 is bent outward. Also, in addition to the mounting part 383 and the shaft mounting part 384, the elevation device 51 and the drawer-side shaft 52, which are mounted on the mounting part 383 and the shaft mounting part 384, may not also protrude inward or outward from the drawer flange 380. That is, all of the drawer-side device 50 constituting a portion of the elevation assembly 40 and the structure for mounting the drawer-side device 50 may be disposed in the region of the drawer flange 380. Thus, a loss of the storage space inside the drawer body 38 may be prevented from occurring.

The support member 35 of the drawer-side device 50 and the elevation device 51 may be disposed on the inner surface of the drawer body 38, and the drawer-side shaft may be disposed outside the drawer body 38. Also, the mounting part 383 and the shaft mounting part 384 may communicate with each other, and the shaft 52 and the elevation device 51 may be connected to each other in the state of being mounted on the drawer body 38.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the drawer-side shaft 52 and the draw-out rail 33, which are mounted on both the sides of the drawer body 38 may not be exposed to the outside.

Also, an upper bent part 391*a* may be disposed on an upper end of the outer side plate 391. The upper bent part 391*a* may cover the upper end of each of both the side surfaces of the drawer body 38 and the mounting part bracket 53.

A separate rear accommodation member 39 may be further provided in the drawer cover 37. The rear accommodation member 39 may correspond to a shape of the rear space S2 and have an opened top surface.

In detail, the rear accommodation member 39 may have a shape that is gradually narrowed downward. Also, the rear accommodation member 39 may have a front surface vertically contacting the drawer cover 37 and a rear surface inclinedly contacting the inclined surface 321 of the drawer body 38. Also, both left and right surfaces of the rear accommodation member 39 may contact both the left and right surfaces of the drawer body 38, and a lower end of each of both the left and right surfaces of the rear accommodation member 39 may be axially coupled to the drawer body 38 to rotate. Thus, in a state in which the drawer cover 37 is separated, the rear space S2 may be used to accommodate the food. Also, in the even state in which the drawer door 30 is not completely withdrawn forward, the access to the rear accommodation member 39 may be easy by rotating or tilting of the rear accommodation member 39.

The drawer-side device 50 extending in a direction that perpendicularly crosses the draw-out direction of the drawer part 32 may be mounted on the drawer body 38. The drawer-side device 50 may be disposed on the support member 35 and both the sides of the support member 35 and may transmit the power for vertically moving the support member 35 and guide the vertical movement of the support member 35.

The drawer-side device 50 may include the elevation device 51 mounted inside the mounting part 383 and may further include at least one of the connecting bracket 54, the drawer-side shaft 52, and the mounting part bracket 53 restricting the elevation device 51.

Hereinafter, a structure of the elevation assembly will be described in more detail with reference to the accompanying drawings.

Figure 27:
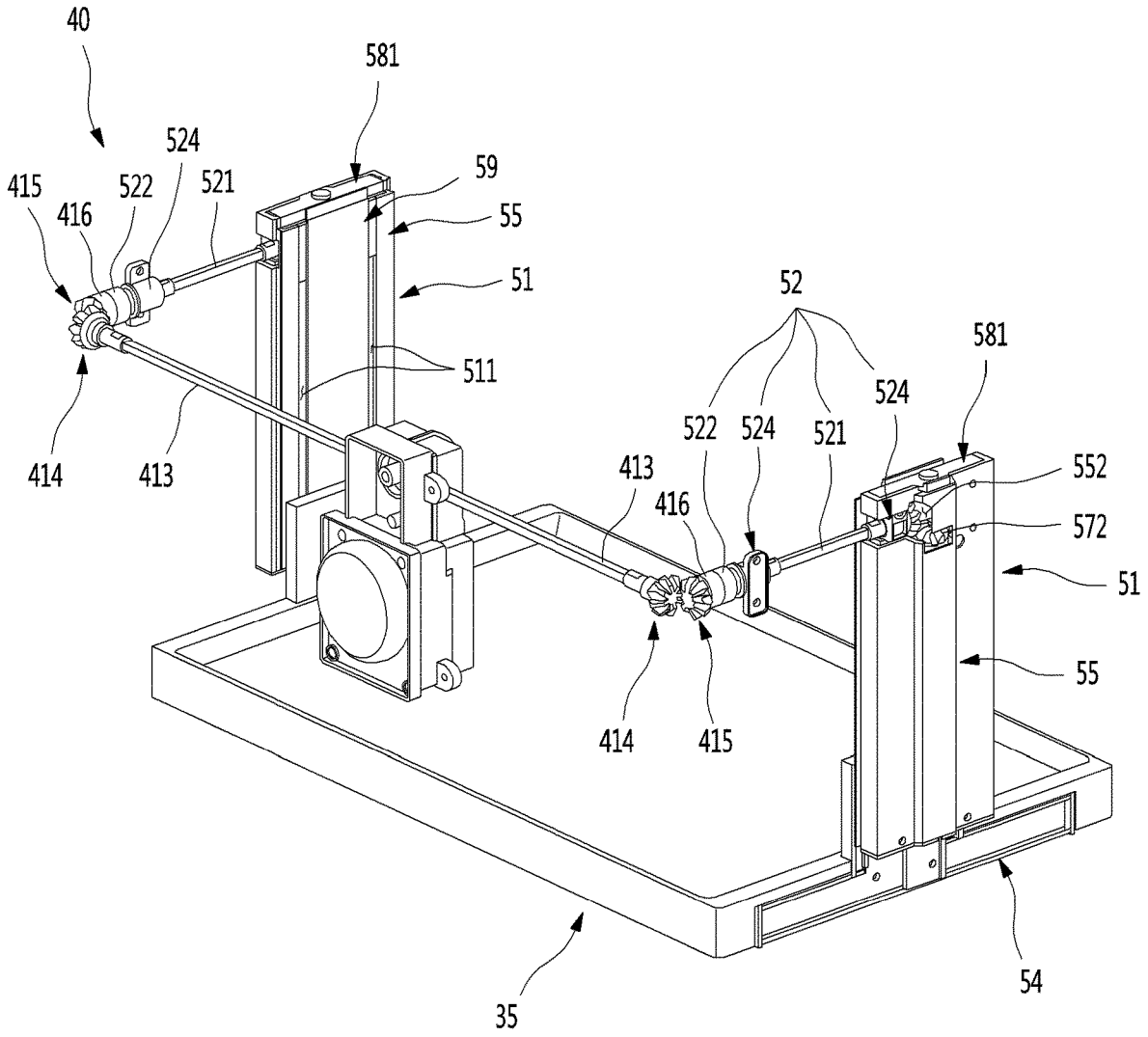
FIG. 27 is a perspective view of the elevation assembly built in the drawer door.

FIG. 27 is a perspective view of the elevation assembly built in the drawer door.

As illustrated in the drawing, the elevation assembly 40 may be constituted by the door-side device disposed in the front panel door part 31 and the drawer-side device 50 disposed in the drawer part 32. Also, the door-side device may have the same structure as that according to the foregoing embodiment.

Although one motor assembly 412 is provided in FIG. 27, if larger torque is required for the elevation of the support member 35, a pair of motor assemblies 412 may be provided as illustrated in FIG. 6. Also, although the motor assembly 412 is disposed in perpendicular to the front surface of the front panel door part 31 in FIG. 27, the motor assembly 412 may be disposed in parallel to the front surface of the front panel door part 31 to minimize a loss in insulation space of the front panel door part 31 as illustrated in FIG. 22.

Although one or two motor assemblies 412 are provided, the door-side first gear 414 and the door-side second gear 415, which are disposed on both sides, may rotate by the same rotation rate at the same time. That is, since the pair of elevation devices 51 are driven by rotation force transmitted to the pair of door-side second gears 415, the door-side first gear 414 and the door-side second gear 415 may rotate at the same rotation rate and at the same time to prevent the support member 35 from being tilted. For this, the door-side shaft 413 may have a structure in which one shaft or a plurality of shafts passing through the motor assembly 412 rotates together with each other.

The drawer-side device 50 may include the support member 35 provided inside the drawer body 38, the elevation device 51 and the connecting bracket 54, which disposed on both the sides of the support member 35 to elevate the support member 35, and the drawer-side shaft 52 disposed outside the drawer body 38 to transmit the rotation force of the door-side device 41 to the elevation device 51.

When the motor assembly 412 is driven, the rotation force of the door-side shaft 413 may be transmitted to the drawer-side device 50 by the door connection member 416 and the drawer connection member 522, which are coupled to each other. When the drawer-side shaft 52 rotates by the rotation of the drawer connection member 522, the elevation shaft 57 inside the elevation device 51 coupled to the drawer-side shaft 52 rotates. Since the elevation shaft 57 rotates, an elevation block 567 coupled to the elevation shaft 57 and a block holder 56 coupled to the elevation block 567 may move vertically. The elevation block 567 and the block holder 56 may be integrated to form one body and thus may be called a shaft holder.

The block holder 56 may be coupled to the connecting bracket 54 to elevate the connecting bracket 5, and the connecting bracket 54 disposed each of both the left and right sides may elevate the support member 35 in the state of being coupled to the elevation frame 352.

That is, the rotation force of the motor assembly 412 may be transmitted to the drawer-side shaft 52 through the door-side shaft 413 to allow the elevation shaft 57 to rotate. The block holder 56 and the connecting bracket 54 may guide the support member 35 to move vertically.

That is, the rotation force of the motor assembly 412 may be transmitted to the drawer-side shaft 52 through the door-side shaft 413 to allow the elevation shaft 57 to rotate. The block holder 56 and the connecting bracket 54 may guide the support member 35 to move vertically.

Hereinafter, a detailed structure of each of the constituents of the drawer-side device 50 will now be described in more detail with reference to the accompanying drawings.

Figure 28:
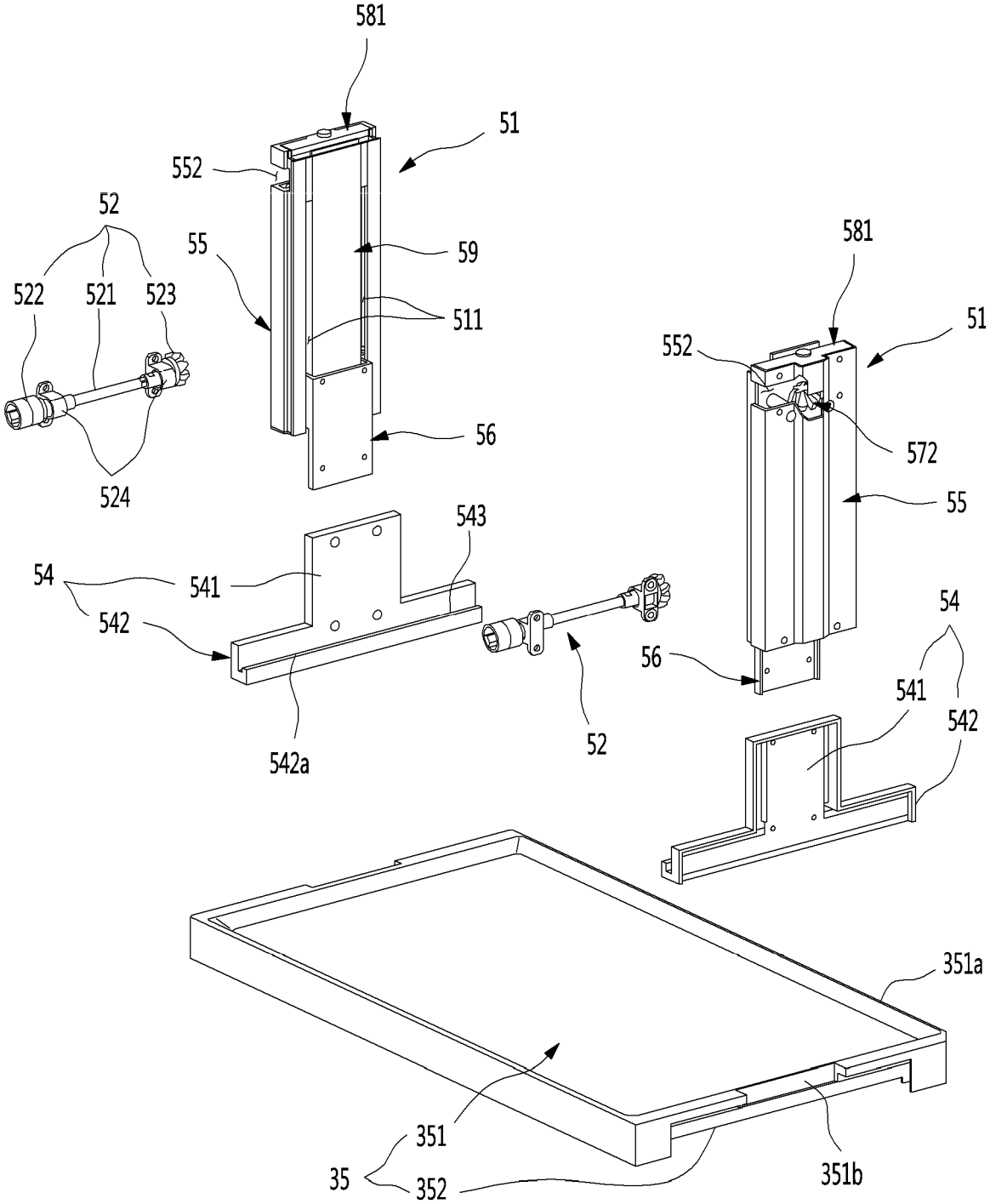
FIG. 28 is an exploded perspective view illustrating a coupling structure of a drawer-side device of the elevation assembly.

FIG. 28 is an exploded perspective view illustrating a coupling structure of a drawer-side device of the elevation assembly.

As illustrated in the drawing, the drawer-side device may include the elevation device 51 for the vertical movement of the support member 35, the drawer-side shaft 52 connected to the elevation device 51 and the door-side device 41 to transmit the power, and the connecting bracket 54 connected to the elevation device 51 and the support member 35.

The arranged position of the elevation device 51 may be a position corresponding to a center of the front space S1 in the front and rear direction and be disposed at a position corresponding to a central portion of each of both the side surfaces of the support member 35. Thus, the support member 35 may be stably elevated without being tilted.

The elevation device 51 may include the housing 55 mounted on the mounting part 383 to define the inner space, the upper and lower caps 581 and 585 covering the upper and lower ends of the housing 55, the elevation block 567 and the block holder 56, which move along the elevation shaft 57 within the housing 55, and the rail cover 59 covering the opened one surface of the housing 55.

The housing 55 and the rail cover 59 may include a pair of guide slits 511 extending in the vertical direction. The elevation block 567 and the block holder 56 may be elevated along the pair of guide slits 511.

Also, a central portion 553 protruding outward and a side part 554 extending to be stepped laterally from the central portion 553 may be provided on the outer surface of the housing 55. The central portion 553 and the side part 554 may have shapes corresponding to the first mounting part 383 and the second mounting part 383 of the mounting part 383 so that the housing 55 is closely attached and fixed to the inside of the mounting part 383.

Also, a shaft insertion part 552 into which an end of the drawer-side shaft 52 extending to the elevation device 51 is accommodated may be defined in the upper end of the housing 55. The shaft insertion part 552 may be opened in a shape corresponding so that the end of the drawer shaft 521 and the drawer-side gear 523 are inserted, i.e., may be opened to be exposed up to a portion of the elevation shaft 57 coupled to the upper end of the elevation shaft 57. Thus, the mounting and separation of the drawer-side mounting part 383 may be performed through the shaft insertion part 552, and also, the coupled state of the drawer-side gear 523 and the shaft gear 572 may be confirmed through the shaft insertion part 552. In addition, the shaft insertion part 552 may prevent the operations of the drawer-side gear 523 and the shaft gear 572 from interfering with the housing 55.

The drawer-side shaft 52 may include a drawer shaft 521 having a predetermined length, a drawer connection member 522 disposed on a front end of the drawer shaft 521, and a drawer-side gear 523 disposed on a rear end of the drawer shaft 521. The drawer connection member 522 may be coupled to the door connection member 416 when the front panel door part 31 and the drawer part 32 are coupled to each other, and the drawer-side gear 523 may be coupled to the shaft gear 572. Also, the drawer-side shaft 52 may be fixed and mounted on the drawer body 38 by the pair of shaft fixing members 524.

The connecting bracket 54 may include a rail coupling part 541 coupled to the elevation device 51 and a support member coupling part 542 coupled to the support member 35.

The rail coupling part 541 may define an upper portion of the connecting bracket 54 and be coupled to the block holder 56, which is exposed to the outside, of the elevation device 51. The rail coupling part 541 and the block holder 56 may be firmly coupled to each other by a coupling member such as a screw.

The support member coupling part 542 may be disposed on a lower end of the rail coupling part 541 and coupled to each of both side ends of the support member 35. The support member coupling part 542 may have a length greater than a horizontal width of the rail coupling part 541 to stably support both the ends of the support member 35.

The support member coupling part 542 may be bent several times to define a coupling groove 842*a* that is opened upward, and both the ends of the support member 35 may be seated on the coupling groove 842*a*. In detail, the elevation frame 352 may be inserted into the coupling groove 842*a*. The rail coupling part 541 may be inserted into the connecting bracket mounting part 351*b* to couple the support member 35 to the connecting bracket 54 without moving.

The support member 35 may have a structure that is seated downward from an upper side of the coupling groove 842*a*. Here, the support member 35 may be seated on the connecting bracket 54 without using a separate coupling member. That is, the firm and stable coupling structure may be provided in the drawer body 38. Thus, when a service of the elevation device 51 is required, the elevation device 51 may be easily separated. Also, when the elevation function is not used, the support member 35 may be easily separated.

Hereinafter, the configuration of the elevation device will be described in detail with reference to the accompanying drawings.

Figure 29:
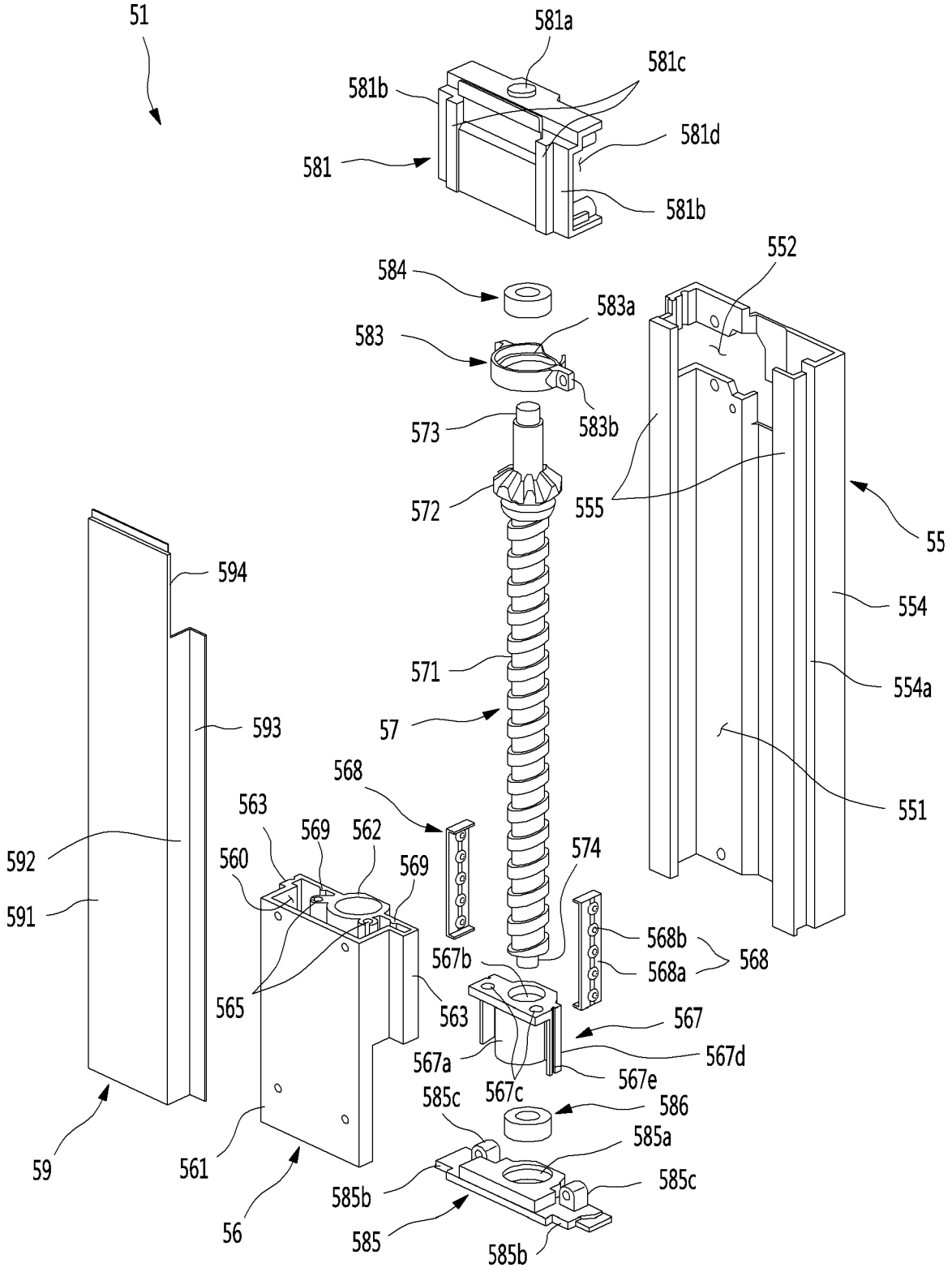
FIG. 29 is an exploded perspective view illustrating a structure of an elevation device when viewed in one direction.
Figure 30:
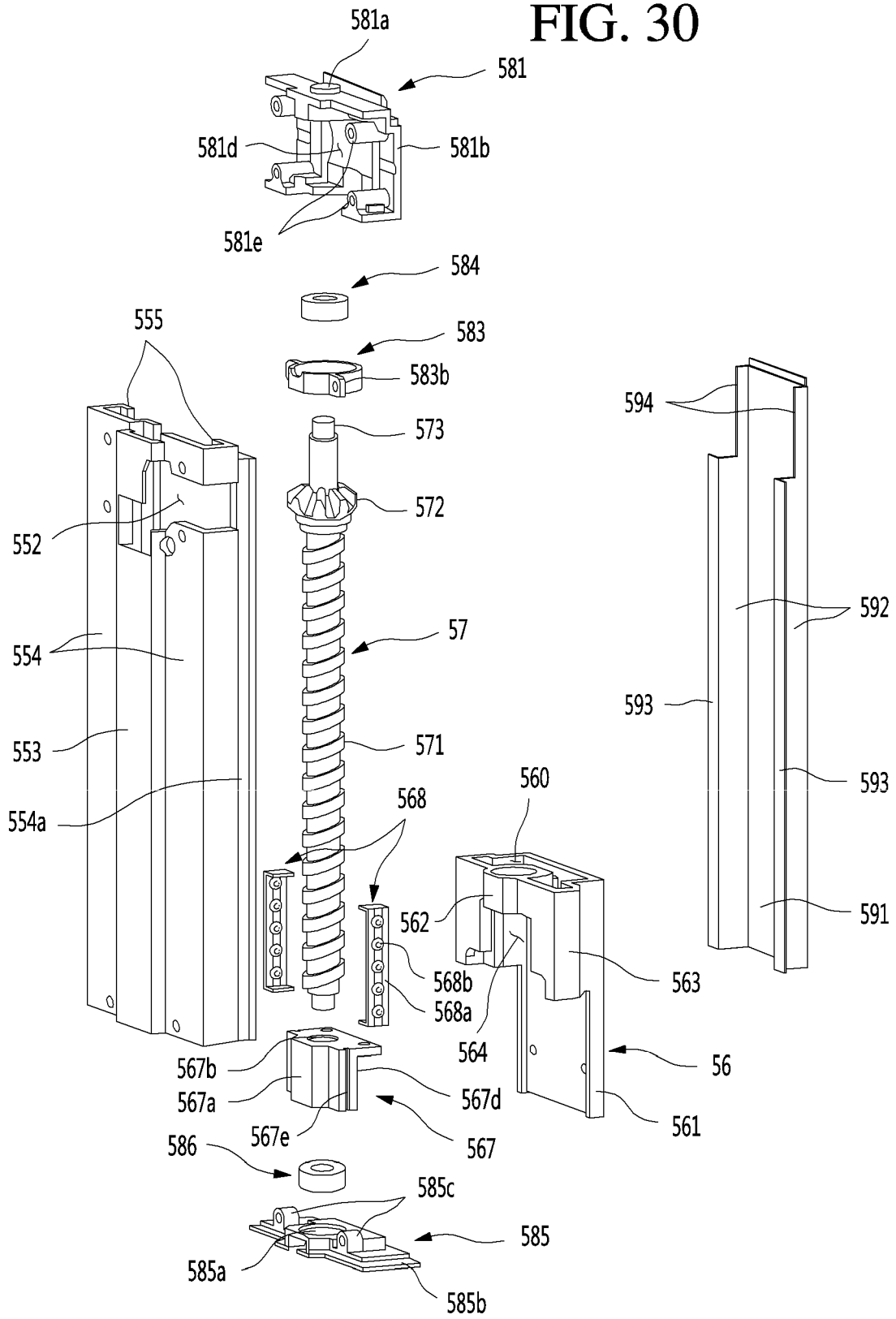
FIG. 30 is an exploded perspective view illustrating the structure of the elevation device when viewed in the other direction.
Figure 31:
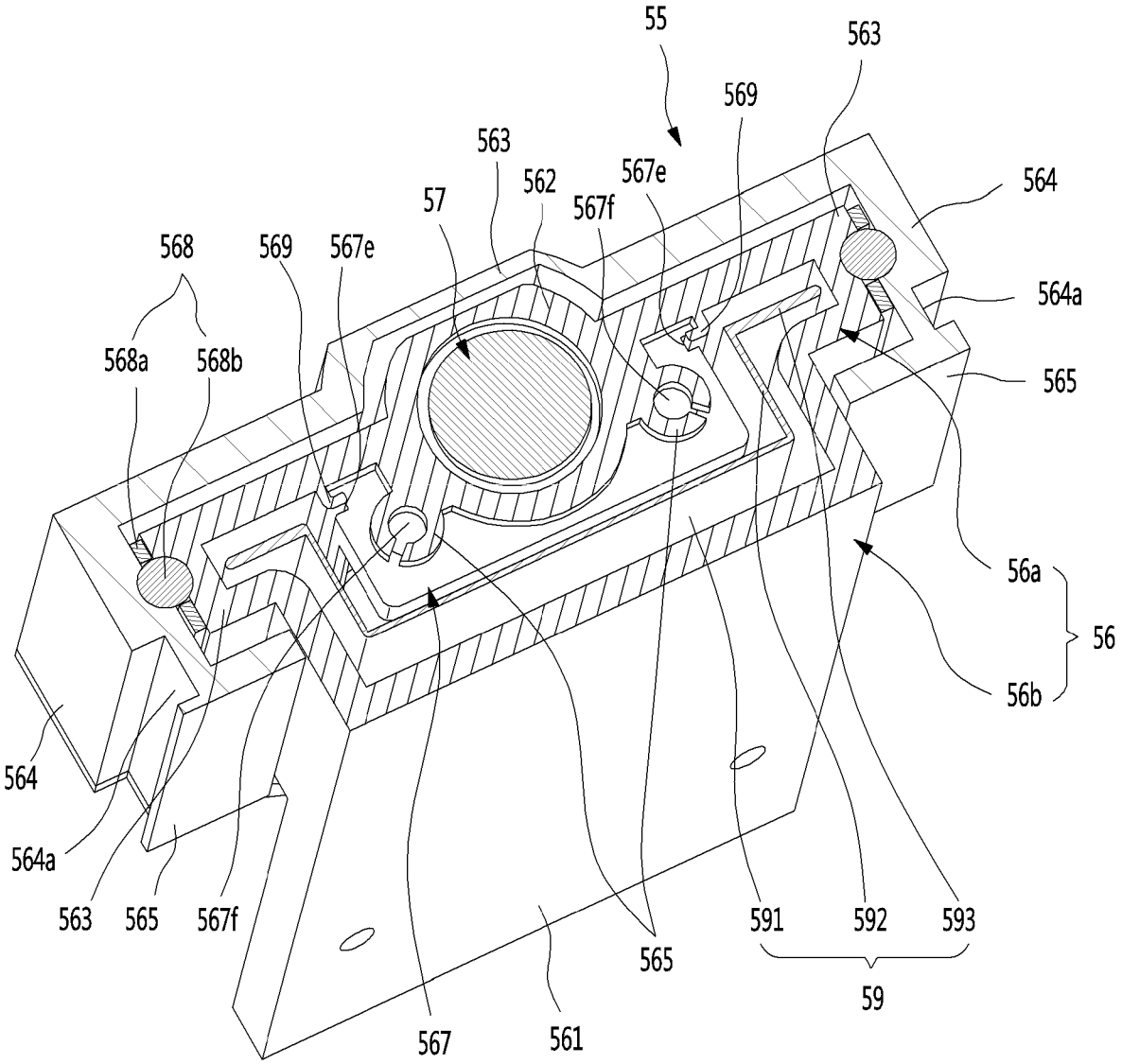
FIG. 31 is a cutaway perspective view illustrating a transverse cross-section of the elevation device.

FIG. 29 is an exploded perspective view illustrating a structure of an elevation device when viewed in one direction. Also, FIG. 30 is an exploded perspective view illustrating the structure of the elevation device when viewed in the other direction. Also, FIG. 31 is a cutaway perspective view illustrating a transverse cross-section of the elevation device.

As illustrated in the drawings, the elevation device 51 has an outer appearance defined by the housing 55. Also, the housing 55 may provide a space in which the elevation shaft 57 and the block holder 56 are accommodated, and the opened inner surface of the housing 55 may be covered by the rail cover 59.

The housing 55 may include the central portion 553 and the side part 554. The central portion 553 may be disposed at a position corresponding to the elevation shaft 57, and at least a portion of the elevation shaft 57 may be accommodated in the central portion 553. Also, the central portion 553 may be seated on the first mounting part 383.

The side part 554 may extend to be stepped to both sides of the central portion 553 and be seated on the second mounting part 383. The side part 554 may extend from both side ends to both sides of the central portion 553 and be vertically bent to define both the side surfaces of the housing 55 and then be bent again inward from an end of both the side surfaces of the housing 55.

Thus, a space in which the elevation shaft 57 and the block holder 56 are accommodated may be defined in the housing 55 by the side part 554. Also, both ends of the side part 554 may be bent in a direction facing each other and have a housing opening 551 therebetween. The housing opening 551 may have a horizontal width greater than a diameter of the elevation shaft 57 so that the elevation shaft 57 is easily mounted and also have a horizontal width less than a width of the block holder 56 to prevent the block holder 56 from being separated through the housing opening 551. The housing opening 551 may be covered by the rail cover 59.

The elevation shaft 57 may be accommodated in the housing 55 and disposed at the central portion 553. Also, a screw thread 4571 may be provided on an outer circumferential surface of the elevation shaft 57 so that the elevation block 567 vertically moves along the elevation shaft 57 when the elevation shaft 57 rotates.

The elevation block 567 may include a block body 567*a* having a block through-hole 567*b* through which the elevation shaft 57 passes and a body coupling part 567*d* extending from the block body 567*a* in both lateral directions. The block body 567*a* may have a cylindrical shape, and the block through-hole 567*b* may vertically pass through a center of the block body 567*a*. A screw corresponding to the screw thread 571 may be disposed on an inner circumferential surface of the block through-hole 567*b*. Thus, when the elevation shaft 57 rotates, the elevation shaft 57 may move along the screw thread 571 to allow the elevation block 567 to vertically move.

Also, a block coupling hole 567*c* may be defined in a top surface of the elevation block 567. The block coupling hole 567*c* may be defined in both sides with respect to a center of the block through-hole 567*b*. The screw 567*f* may be coupled to the block coupling hole 567*c*. Thus, the elevation block 567 may be coupled to the block holder 56 to move together with each other.

Also, the body coupling part 567*d* may extend from the center of the block body 567*a* in both directions, and a block groove 567*e* extending in the vertical direction may be defined in the extending end of the body coupling part 567*d*. The block groove 567*e* defined in each of both sides may be coupled to the block holder 56, and thus, the elevation block 567 and the block holder 56 may be more firmly coupled to each other.

The block holder 56 may be coupled to the elevation block 567 and thus be elevated together with each other inside the housing 55. Also, a portion of the block holder 56 may be exposed to the outside of the housing 55 and then coupled to the connecting bracket 65.

In detail, the block holder 56 may include an inner part 56*a* accommodated in the housing 55 and an outer part 56*b* exposed to the outside of the housing 55. Also, a hollow may be defined in the block holder 56 to provide a space 560. Particularly, a block accommodation part 564 in which the elevation block 567 is accommodated may be provided in a lower portion of the block holder 56, more particularly, a lower portion of the inner part 56*a*. The block accommodation part 564 may be opened backward and downward to communicate with the hollow. Thus, the elevation block 567 may be inserted and mounted from a lower side to an upper side of the inner part 56*a* and be disposed inside the block accommodation part 564.

A shaft through-part 562 passing in the vertical direction may be provided above the block accommodation part 564, i.e., at a center of the inner part 56*a*. The elevation shaft 57 may pass through the inside of the shaft through-part 562. Here, the screw thread 571 of the elevation shaft 57 may not be coupled to an inner circumferential surface of the shaft through-part 562 and also may not contact an inner surface of the shaft through-part 562. Also, in the state in which the elevation block 567 is disposed inside the block accommodation part 564, centers of the shaft through-part 562 and the block through-hole 567*b* may be disposed on the same extension line.

A holder coupling part 565 to which a screw 567*f* is coupled to couple the elevation block 567 to the block holder 56 may be disposed on each of both sides of an outer surface of the shaft through-part 562. The holder coupling part 565 may be disposed at a position corresponding to the block coupling hole 567*c*. Thus, the elevation block 567 and the block holder 56 may be vertically disposed when the elevation block 567 and the block holder 56 are coupled to each other. Thus, the screw 567*f* may pass through the block coupling hole 567*c* and be coupled to the holder coupling part 565, and thus, the elevation block 567 and the block holder 56 may be integrally fixed to each other.

A side extension part 563 extending in a lateral direction may be disposed on each of both sides of the shaft through-part 562. The side extension part 563 may extend laterally from the shaft through-part 562, i.e., extend up to each of both the side surfaces of the housing 55 along the side part 554. Also, the side extension part 563 may be bent in the shape of the inner surface of the side part 554 and may extend up to the housing opening 551. That is, the side extension part 563 may be bent in a shape corresponding to the shape of the inner surface of the side part 554.

Also, a bearing mounting part 383 may be disposed on the side extension part 563 facing the side surface of the housing 55. The bearing mounting part 383 may be recessed inward. A plurality of bearings 568*b* may be continuously disposed in the vertical direction. The plurality of bearings 568*b* may be mounted in a state of being rotatable by a retainer 568*a*, and the retainer 568*a* may be fixed to the bearing mounting part 383. The bearing 568*b* and the retainer 568*a* may be called a rolling member. The rolling member may not be limited to the bearing 568*b* and the retainer 568*a* and thus may include a different constituent as long as the constituent is rolled between the block holder 56 and the housing 55.

The plurality of bearings 568*b* may be disposed between the inner surface of the housing 55 and the side extension part 563 to respectively contact the housing 55 and the side extension part 563, thereby performing the rolling. Also, the bearings 568*b* may be disposed on the bearing mounting part 383 disposed on each of both sides thereof. Thus, the block holder 56 may be smoothly elevated inside the housing 55. Particularly, since the block holder 56 is maintained in the state of contacting the inner surface of the housing 55 while being elevated, the block holder 56 may be stably elevated without moving. Also, the inner surface of the side part 554 contacting the bearing 568*b* may be recessed at a position facing the bearing mounting part 383 to allow the bearing 568*b* to be more stably rolled.

The outer part 56*b* may pass through the housing opening 551 at both sides of the side extension part 563 to extend. Also, the outer part 56*b* may pass through the housing opening 551 to protrude so as to be coupled to the connecting bracket 54.

The outer part 56*b* may include the bracket mounting part 561 coupled to the connecting bracket 54, and the bracket mounting part 561 may be disposed outside the housing opening 551. Thus, even though the outer part 56*b* is elevated in the state of being coupled to the connecting bracket 54, the outer part 56*b* may not interfere with the housing 55 or the rail cover 59.

Both ends of the bracket mounting part 561 may vertically extend and respectively connected to the side extension parts 563. Here, the bracket mounting part 561 may have a thickness less than a width of the guide slit 511 to allow the block holder 56 to move along the guide slit 511.

A hollow space 560 may be defined in the block holder 56, i.e., inside the inner part 56*a* and the outer part 56*b*, and the rail cover 59 may be accommodated in the hollow space 560. Also, the block holder 56 may vertically move along the guide slit 511 defined by the rail cover 59 and the housing 55.

The bracket mounting part 561 may extend downward from the outside of the housing 55. In the state in which the block holder 56 is disposed at the lowermost side, the bracket mounting part 561 may be disposed below the housing 55. Here, the housing 55 may be disposed above the draw-out rail 33 and thus be mounted without interfering below the draw-out rail 33 and the drawer flange 380. Also, the bracket mounting part 561 may extend downward to pass through the draw-out rail 33 and be coupled to the support member 35 disposed on the bottom surface of the inside of the drawer body 38 or the connecting bracket 54 coupled to the support member 35.

Also, the block holder 56 may have a structure that extends laterally so that the side extension part 563 is accommodated in the side part 554 and a structure that protrudes or is bent so that the outer part 56*b* passes through the housing opening 551 to restrict movement of the block holder 56, which generally moves along the housing 55, in the front and rear direction and in the left and right direction. Thus, when the support member 35 is elevated, even though a load is applied to the block holder 56, the block holder 56 may not be separated but be stably elevated.

A block restriction protrusion 569 may be disposed on each of both sides, which are adjacent to the shaft through-hole 562, of the side extension part 563. The block restriction protrusion 569 may lengthily extend in the vertical direction on the side extension part 563 and also may extend from a lower end to an upper end of the inner part 56*a*. Also, the block restriction protrusion 569 may be coupled to a block groove 567*e* defined in each of both sides of the elevation block 567. The block restriction protrusion 569 and the block groove 567*e* may be coupled to each other when the elevation block 567 moves from the lower side to the upper side of the block holder 56. Since the elevation block 567 moves upward, the whole coupling may be performed. Since the block restriction protrusion 569 and the block groove 567*e* are coupled to each other, the elevation block 567 and the block holder 56 may be more firmly coupled to each other, and also, the structure in which the elevation block 567 and the block holder 56 are elevated together with each other may be provided. The block holder 56 may have a structure that is vertically coupled to the elevation block 567. Also, the block holder 56 may have a structure that is easily molded through processing such as extrusion.

That is, since a screw has to be provided to move along the elevation shaft 57, the structure may be complicated, and also, it may be difficult to mold the elevation block 567 having abrasion resistance and lubrication performance through engineering plastic injection molding. Also, the elevation block 567 to which a load is applied substantially when the support member 35 moves may have to have high strength. Thus, the elevation block 567 may have a structure that is capable of being molded by using a metal material through the extrusion. The elevation block 567 and the block holder 56, which are made of different materials, may be coupled to each other and may be integrally elevated inside the housing 55 to match the respective structure and environment.

A lower spacer 586 on which the elevation shaft 57 is rotatably supported may be disposed below the elevation shaft 57. A lower protrusion 437 protruding downward may be inserted into the elevation shaft 57. The lower spacer may have the same structure as the bearing. Thus, the elevation shaft 57 may rotate in the state of being supported on the lower spacer 586.

The lower spacer 586 may be fixed and mounted on the lower cap 585. The lower cap 585 may be mounted to cover the opened bottom surface of the housing 55 and define the bottom surface of the elevation device 51. A lower spacer seating part 585*s* into which the lower spacer 586 is inserted and mounted may be disposed at a center of the lower cap 585. Also, a lower cap coupling part 585*c* may be disposed on each of both sides of the lower spacer seating part 585*a*. A screw passing through the side part 554 of the housing 55 may be coupled to the lower cap coupling part 585*c*. Also, a central portion of the lower cap 585 may have a shape corresponding to the central portion 553 of the housing 55 and be inserted into the central portion 553. Each of both ends of the lower cap 585 may protrude in both directions and be inserted into the side part 554 of the housing 55 to cover the opened bottom surface of the housing 55.

The elevation shaft 57 may extend up to the upper end of the housing 55, and the shaft gear 572 and an upper spacer 584 may be mounted on the elevation shaft 57.

The shaft gear 572 may be disposed on an upper end of the screw thread 571 and be integrally coupled to the elevation shaft 57 to rotate together with the elevation shaft 57. Also, the shaft gear 572 may be gear-coupled to the drawer-side shaft 52 in the state of perpendicularly crossing the drawer-side gear 523 mounted on the drawer-side shaft 52.

An upper protrusion 573 extending upward may be disposed on the upper end of the elevation shaft 57. Also, the upper spacer 584 and a spacer fixing member 583 may be mounted to pass through the upper protrusion 573.

The spacer fixing member 583 may be penetrated at a center thereof by the elevation shaft 57, and an upper spacer seating part 583*a* on which the upper spacer 584 is seated may be disposed on a top surface of the spacer fixing member 583. The upper spacer seating part 583*a* may be recessed downward to accommodate at least a portion of the upper spacer 584. Also, a spacer fixing member coupling part 583*b* fixed to the inner surface of the housing 55 may be disposed on each of both sides of the spacer fixing member 583. Thus, the coupling member such as the screw passing through the housing 55 may be coupled to the spacer fixing member coupling part 583*b*, and the fixed state of the spacer fixing member 583 may be maintained.

As described above, the upper and lower ends of the elevation shaft 57 may be rotatably supported by the upper spacer 584 and the lower spacer 586. Also, the elevation shaft 57 may rotate by the power transmitted to the shaft gear 572 by the drawer-side gear 523, and the elevation block 567 and the block holder 56 may be elevated by the power.

The upper cap 581 may be disposed on the upper end of the housing 55. The upper cap 581 may cover the opened top surface of the housing 55 and define the top surface of the elevation device 51.

A cap protrusion 581*a* protruding upward may be disposed on the top surface of the upper cap 581, and the cap protrusion 581*a* is inserted into a protrusion hole defined in the mounting part bracket 53 to restrict the upper end of the elevation device 51.

Also, a cap coupling part 581*e* may be disposed inside the upper cap 581. The cap coupling part 581*e* may have the same shape as a boss and extend to the inner surface of the housing 55. An end of the cap coupling part 581*e* may extend to contact the side part 554, and the coupling member such as the screw passing through the housing 55 may be coupled to the end of the coupling part 581*e*. The upper cap 581 may be firmly fixed to the housing 55 by the coupling member.

The inner surface of the upper cap 581 and the inner surface of the housing 55 may be spaced apart from each other by the cap coupling part 581*e* and provide a space in which the drawer-side gear 523 and the shaft gear 572 are disposed. That is, the drawer-side gear 523 and the shaft gear 572 may be disposed to be coupled to each other in the inner region of the upper cap 581.

A guide protrusion 581*c* may be disposed on one surface of the upper cap 581 covering the housing opening 551. The guide protrusion 581*c* may protrude from a position corresponding to each of both ends of the housing opening 551 and have a thickness corresponding to that of the housing 55.

Also, a housing support part 581*b* extending to be stepped in both directions of the guide protrusion 581*c* may be provided. The housing support part 581*b* is configured to support the side part 554 of the housing 55 in the state in which the upper cap 581 is mounted on the housing 55.

Thus, the upper cap 581 may be inserted through the opened upper side of the housing 55, and the mounting of the upper cap 581 may be guided by the guide protrusion 581*c*. Also, the opened top surface of the housing 55 may be covered by a top surface of the upper cap 581, and the upper cap 581 may be fixed to the housing by the coupling member.

The rail cover 59 may be disposed on the housing 55. The rail cover 59 may cover the housing opening 551 and define the guide slit 511.

In detail, the rail cover 59 may be made of a plate-shaped metal material like the inner side plate 392. Thus, in the state in which the rail cover 59 is mounted, the outer appearance of the elevation device 51 may be have the same texture as the outer appearance of the inside of the drawer part 32, i.e., the inner side plate 392.

The rail cover 59 may cover the housing opening 551 to cover the constituents accommodated in the housing 55. For this, the rail cover 59 may include a cover covering part 591 disposed on an area of the housing opening 551, a cover bent part 592 bent from the cover covering part 591 to the inside of the housing 55, and a cover extension part 593 bent outward from the extending end of the cover bent part 592 and inserted into the side extension part 563. Also, upper and lower ends of the rail cover 59 may be coupled and fixed to the upper cap 581 and the lower cap 585.

A cover cutoff part 594 that is cut downward in a stepped shape may be provided in each of both left and right surfaces of the upper end of the rail cover 59. The cover cutoff part 594 may be seated on the upper cap 581 when the rail cover 59 is mounted.

The rail cover 59 may have a cross-sectional shape corresponding to the hollow shape within the block holder 56 to pass through the hollow of the block holder 56. Thus, the block holder 56 may vertically move in a state of being penetrated by the rail cover 59.

Also, the cover covering part 591 may have a horizontal width less than that of the housing opening 551. That is, when the rail cover 59 is mounted, an outer end of the cover covering part 591 and an inner end of the housing opening 551 may be spaced apart from each other to provide the guide slit that extends in the vertical direction.

The cover covering part 591 may have a horizontal width corresponding a thickness of a portion of the guide slit 511 defining both the side surfaces of the outer part 56*b*. Both the side surfaces of the outer part 56*b* may pass through the guide slit 511 and move along the guide slit 511 when the block holder 56 vertically moves.

The cover extension part 593 may extend from the end of the cover bent part 592 up to the inside of the side extension part 563 via the inner end of the housing opening 551. That is, a distance between both ends of the cover extension part 593 may be greater than a size of the housing opening 551.

Thus, in the state in which the rail cover 59 is mounted, most of the housing opening 551 may be covered by the cover covering part 591 and also be defined as the guide slit 511. Also, the inside of the guide slit 511 may also be covered by the cover extension part 593. Thus, the outer appearance of the inside of the housing opening 551 may be defined by the guide slit 511, and thus, the inside of the drawer part 32 may have the same metal texture on the whole. Also, most of the inner surface of the drawer part 32, on which the elevation device 51 is mounted, except for the gap by the guide slit 511 may be covered by the metal material to improve the outer appearance thereof.

Figure 32:
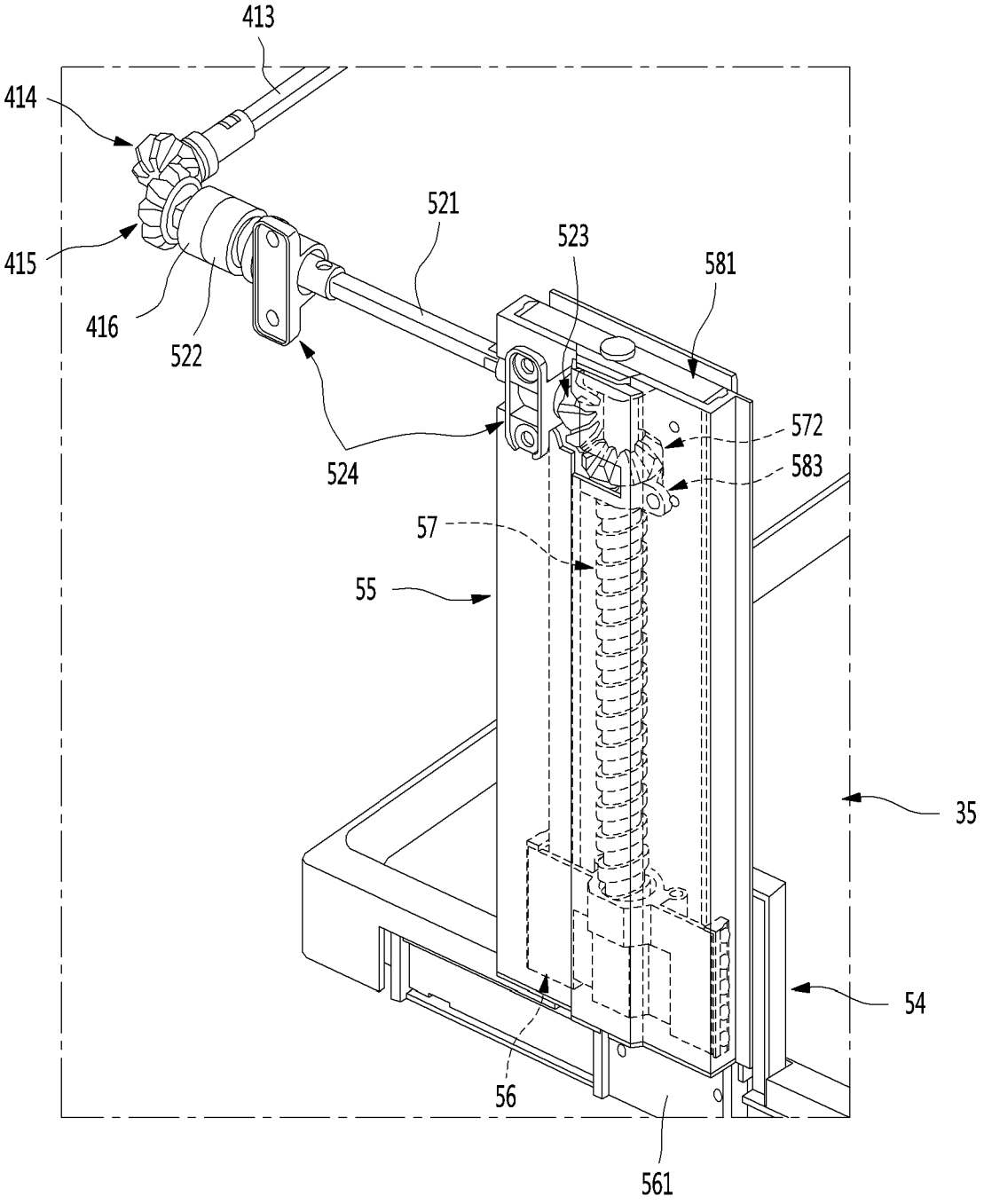
FIG. 32 is a partial perspective view illustrating a power transmission structure of the drawer-side device.
Figure 33:
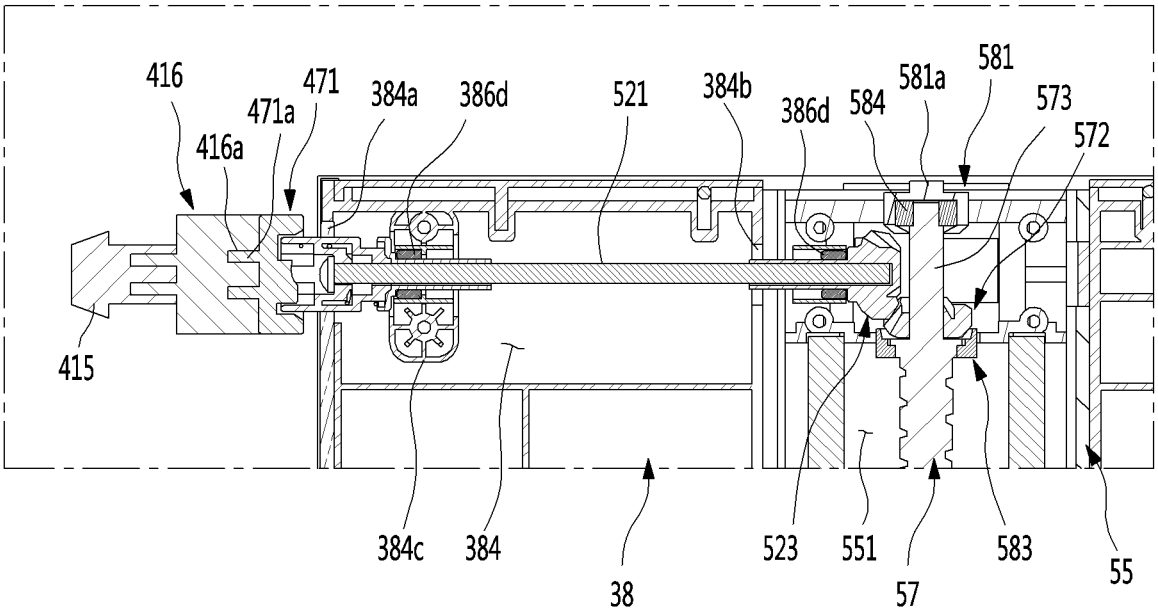
FIG. 33 is a perspective view illustrating a mounting structure of a drawer shaft of the drawer-side device of the elevation assembly.

FIG. 32 is a partial perspective view illustrating a power transmission structure of the drawer-side device. Also, FIG. 33 is a perspective view illustrating a mounting structure of a drawer shaft of the drawer-side device of the elevation assembly.

As illustrated in the drawings, the shaft mounting part 384 may be disposed on each of both the side ends of the drawer body 38. The shaft mounting part 384 may be disposed in a region between the front surface of the drawer body 38 and the mounting part 383 to provide a space in which the drawer-side shaft 52 is mounted.

Also, the front end of the shaft mounting part 384 may include a front opening 384*a* of which at least a portion of a front end is opened so that the shaft mounting part 384 communicates with the front surface of the drawer body 38 and a rear opening 384*b* of which at least a portion of a rear end is opened so that the shaft mounting part 384 communicates with the mounting part 383.

Also, the drawer-side shaft 52 may be disposed on the shaft mounting part 384. Also, the shaft fixing member 524 for fixing the drawer-side shaft 52 may be provided, and a mounting part 384*c* for mounting the shaft fixing member 524 may be further provided.

In detail, the drawer-side shaft 52 may extend from the front opening 384*a* to the rear opening 384*b*. Also, the drawer-side shaft 52 may include a drawer shaft 521 having a predetermined length.

The drawer connection member 522 may be coupled to the front end of the drawer shaft 521, and the drawer connection member 522 may be exposed to the front surface of the drawer part 32 through the front opening 384*a*. Also, as described above, the drawer connection member 522 may be coupled to the door connection member 416 when the front panel door part 31 and the drawer part 32 are coupled to each other and may rotate together with the driving of the door-side device 41.

Also, the drawer-side gear 523 may be disposed on the rear end of the drawer shaft 521. The drawer-side gear 523 may have a bevel gear shape and be coupled to the shaft gear 572 through the rear opening 384*b*. That is, the drawer-side shaft 52 and the elevation shaft 57, which are disposed to perpendicularly cross each other, may be connected to each other by the drawer-side gear 523 and the shaft gear 572 to transmit the power.

Here, the rear end of the drawer-side shaft 52, i.e., the rear end of the drawer shaft 521 and the drawer-side gear 523 mounted on the rear end of the drawer shaft 521 may be inserted through the shaft insertion part 552 of the housing 55 via the rear opening 384*b*. Thus, the rear end of the drawer-side shaft 52 including the drawer-side gear 523 may be disposed in the inner region of the upper cap 581 of the elevation device 51.

Also, the shaft fixing member 524 may be disposed on the drawer-side shaft 52. The shaft fixing member 524 may be provided in a pair on both left and right sides to support the drawer-side shaft 52 so that the drawer-side shaft 52 is rotatable without being tilted or moving. The front shaft fixing member 524 of the pair of shaft fixing members 524 may be fixed and mounted on the mounting part 384*c* of the shaft mounting part 384, and at least a portion of the rear shaft fixing member 524 may be accommodated in the housing 55.

A through-hole through which the drawer shaft 521 passes may be defined in the shaft fixing member 524, and a bearing may be provided in the through-hole to support the drawer shaft 521. Thus, the shaft fixing member 524 may stably support the drawer-side shaft 52 and be configured so that the drawer-side shaft 52 is rotatably mounted.

The mounting part 384*c* may be provided in a pair on the shaft mounting part 384 and be coupled to the shaft fixing member 524. A center of the mounting part 384*c* may be recessed so that a portion of the shaft fixing member 524 is accommodated, and the shaft fixing member 524 may be fixed and mounted on the mounting part 384*c* by the screw.

The drawer-side shaft 52 may be mounted on the outer surface of the drawer body 38, and the elevation device 51 may be mounted on the inner surface of the drawer body 38. Also, the mounting part 383 on which the elevation device 51 is mounted and the shaft mounting part 384 on which the drawer-side shaft 52 is mounted may communicate with each other through the rear opening 384*b*. Also, the drawer-side gear 523 disposed on the rear end of the drawer-side shaft 52 may be connected to the shaft gear 572 inside the elevation device 51 through the rear opening 384*b*.

Hereinafter, a state in which the drawer door 30 of the refrigerator 1 is inserted and withdrawn and is elevated according 3 to the third embodiment will be described in more detail with reference to the accompanying drawings.

Figure 34:
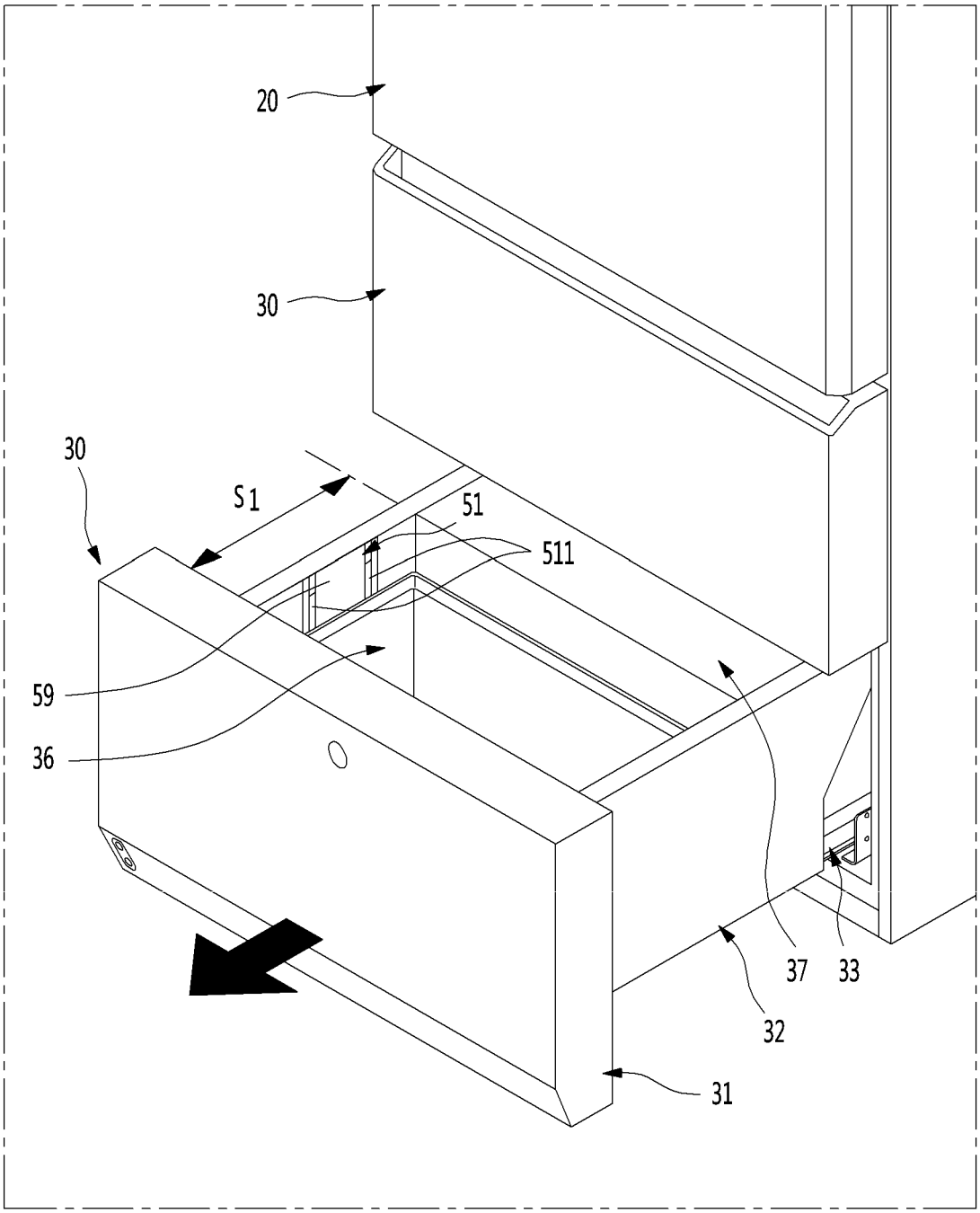
FIG. 34 is a perspective view illustrating a state in which the drawer door is completely opened.
Figure 35:
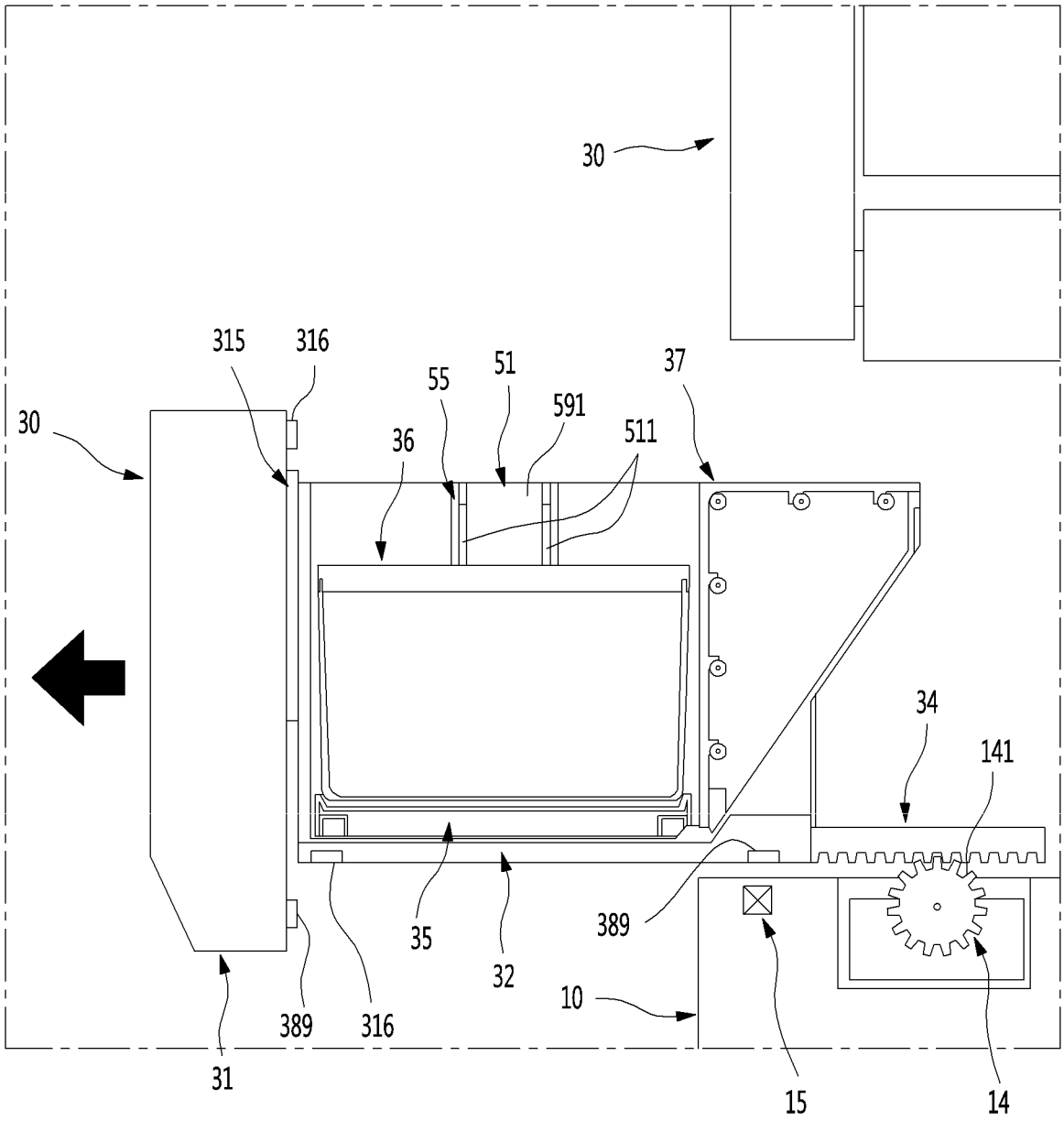
FIG. 35 is a cross-sectional view of the drawer door in the state of FIG. 34.
Figure 36:
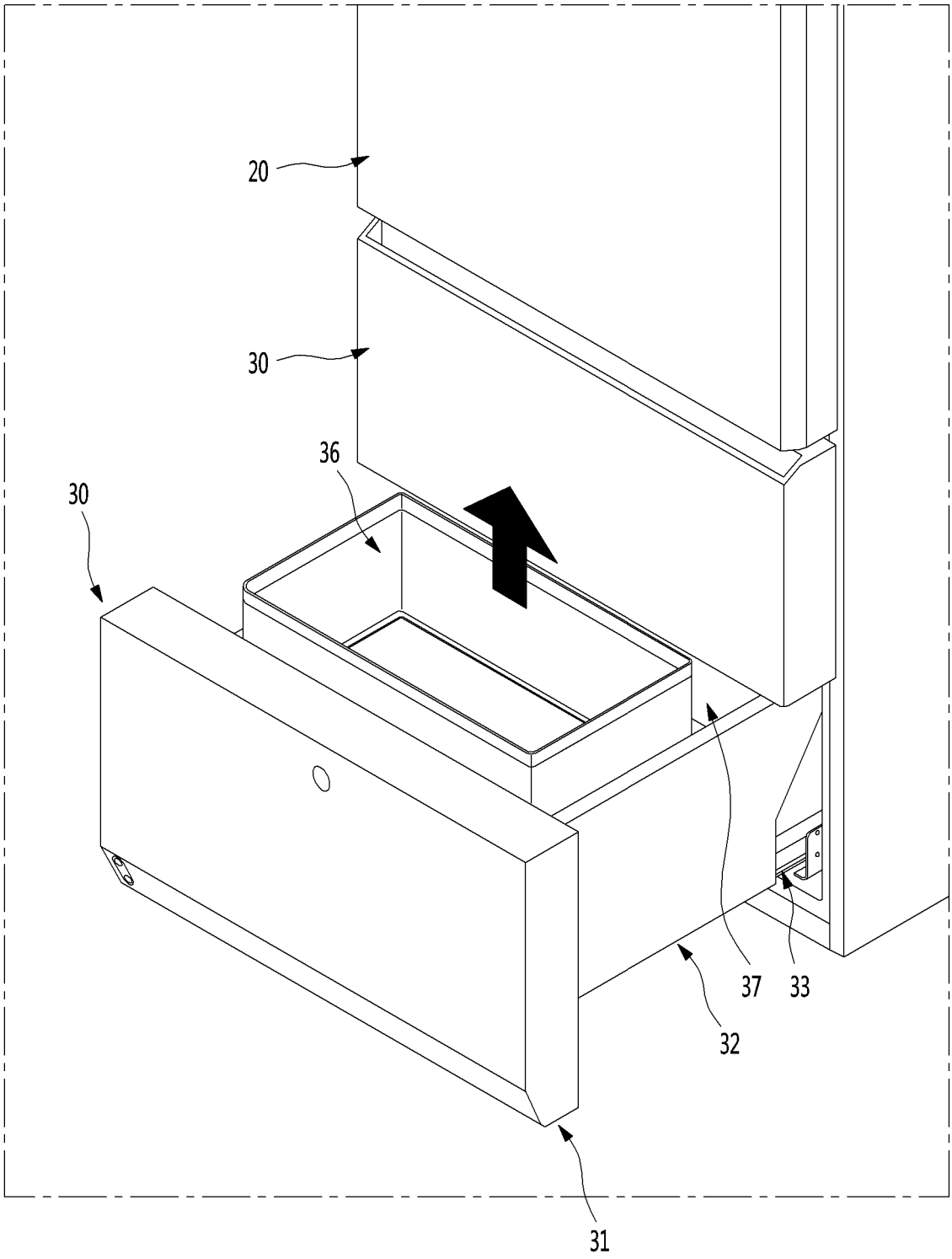
FIG. 36 is a perspective view illustrating a state in which the support member of the drawer door is completely elevated.
Figure 37:
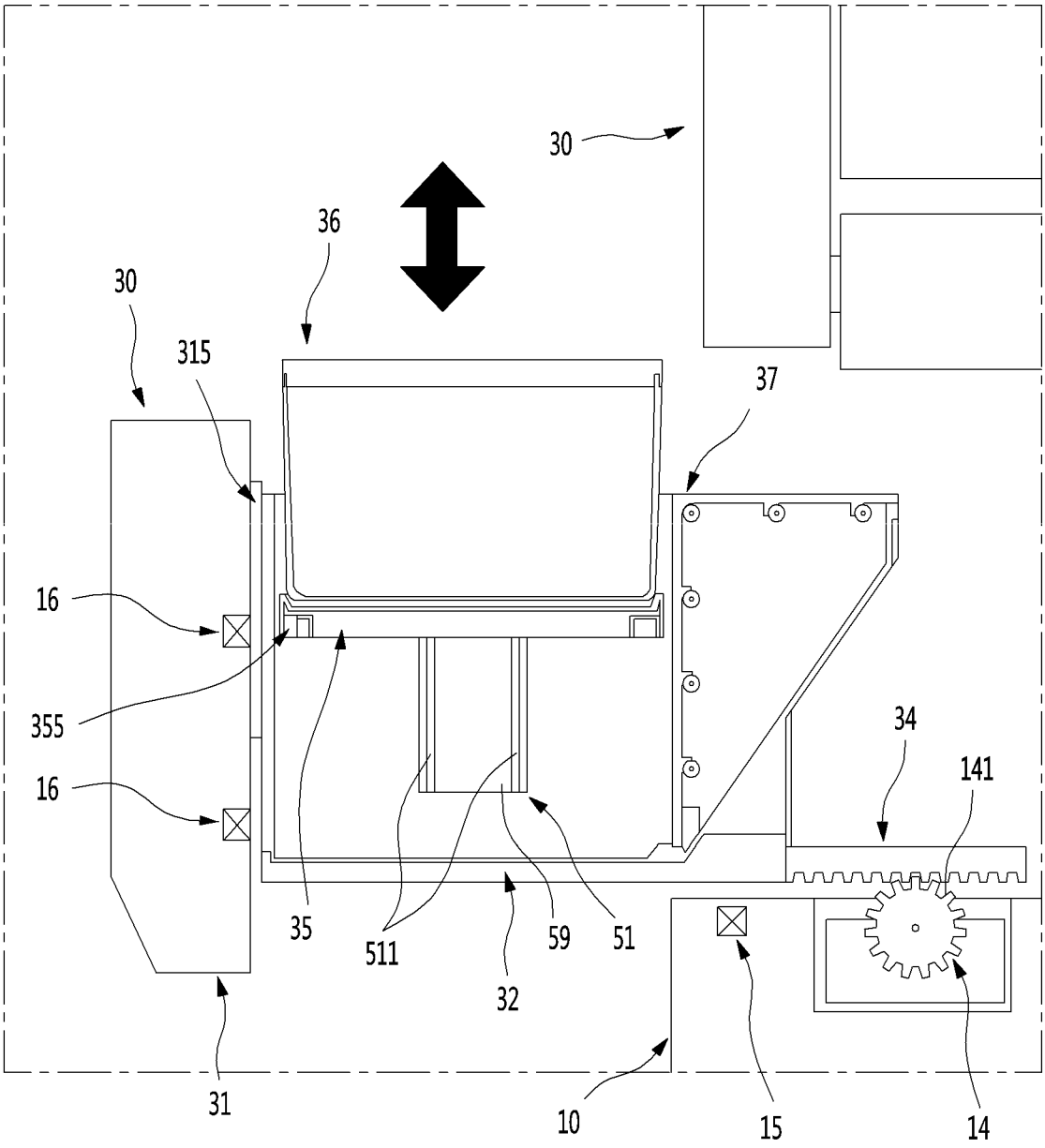
FIG. 37 is a cross-sectional view of the drawer door in the state of FIG. 36.

FIG. 34 is a perspective view illustrating a state in which the drawer door is completely opened. Also, FIG. 35 is a cross-sectional view of the drawer door in the state of FIG. 34. Also, FIG. 36 is a perspective view illustrating a state in which the support member of the drawer door is completely elevated. Also, FIG. 37 is a cross-sectional view of the drawer door in the state of FIG. 36.

Figure 47:
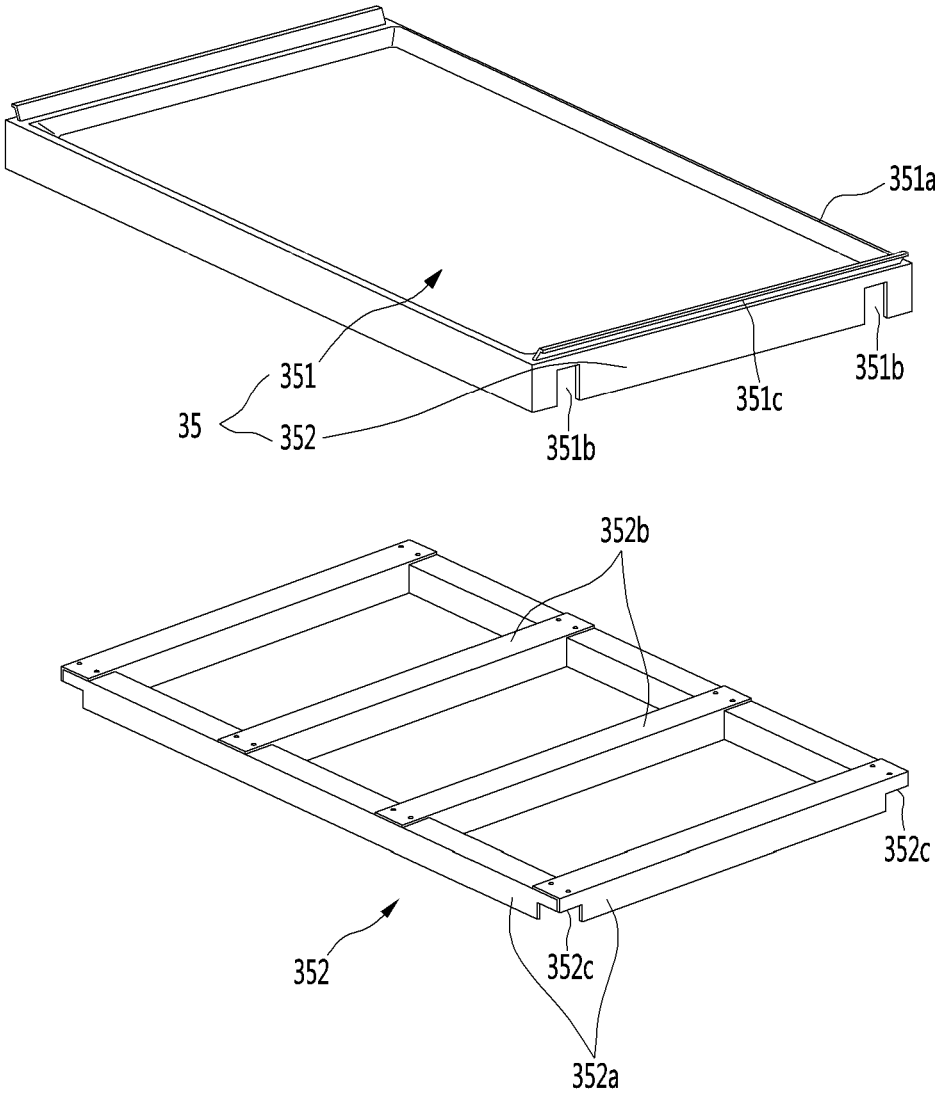
FIG. 47 is a perspective view illustrating a support member of the elevation assembly.

The drawer door of the refrigerator according to the third embodiment may be completely withdrawn as illustrated in FIGS. 34 and 35 and completely ascend as illustrated in FIG. 47 in the state of being completely closed as illustrated in FIG. 17.

The above-described overall operation may be the same as that according to the first embodiment except for a portion of only an elevation manner of the elevation device. Thus, an operation of the elevation device may be described.

The rotation force of the door-side device 41 may be transmitted to the drawer-side device 50 by door connection member 416 and the drawer connection member 522, which are coupled to each other. Thus, the rotation force transmitted from the door-side device 41 may allow the drawer-side shaft 52 and the drawer-side gear 523 of the end of the drawer-side shaft 52 to rotate.

The rotation force may be transmitted in the state in which the drawer-side gear 523 and the shaft gear 572 are connected to each other, and the rotation force of the drawer-side shaft 52 may allow the elevation shaft 57 to rotate. Due to the rotation of the elevation shaft 57, the elevation block 567 and the block holder 56 may move upward along the elevation shaft 57. Here, all of the portions of the elevation device 51, which is exposed to the inside of the drawer part 32, may be covered by the rail cover 59. Also, the block holder 56 may vertically move along the guide slit 511 defined by the rail cover 59.

Here, the block holder 56 may vertically move together with the connecting bracket 54 in the state of being coupled to the connecting bracket 54, and the support member 35 coupled to the connecting bracket 54 may also move upward. Here, the connecting bracket 54 may be connected to a center of both side surfaces of each of the support member 35, and the elevation device 51 may also be disposed at a center of each of both side surfaces of support member 35 to allow the support member 35 to be stably elevated without being tilted.

Particularly, the ascending block holder 56 may have the corresponding stepped or bent shape within the housing 55 and thus be restricted so that the block holder 56 does not move in the left and right direction or in the front and rear direction during the ascending.

The support member 35 may continuously ascend by a sufficient height so that the user is accessible to the food or container 36 seated on the support member 35. Thus, the user may easily lift the food or container.

In addition to the foregoing embodiments, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Particularly, in the fourth embodiment, other constituents except for the drawer-side device 50 and constituents having a coupling relationship with the drawer-side device 50 are the same as those according to the forgoing embodiments.

Figure 38:
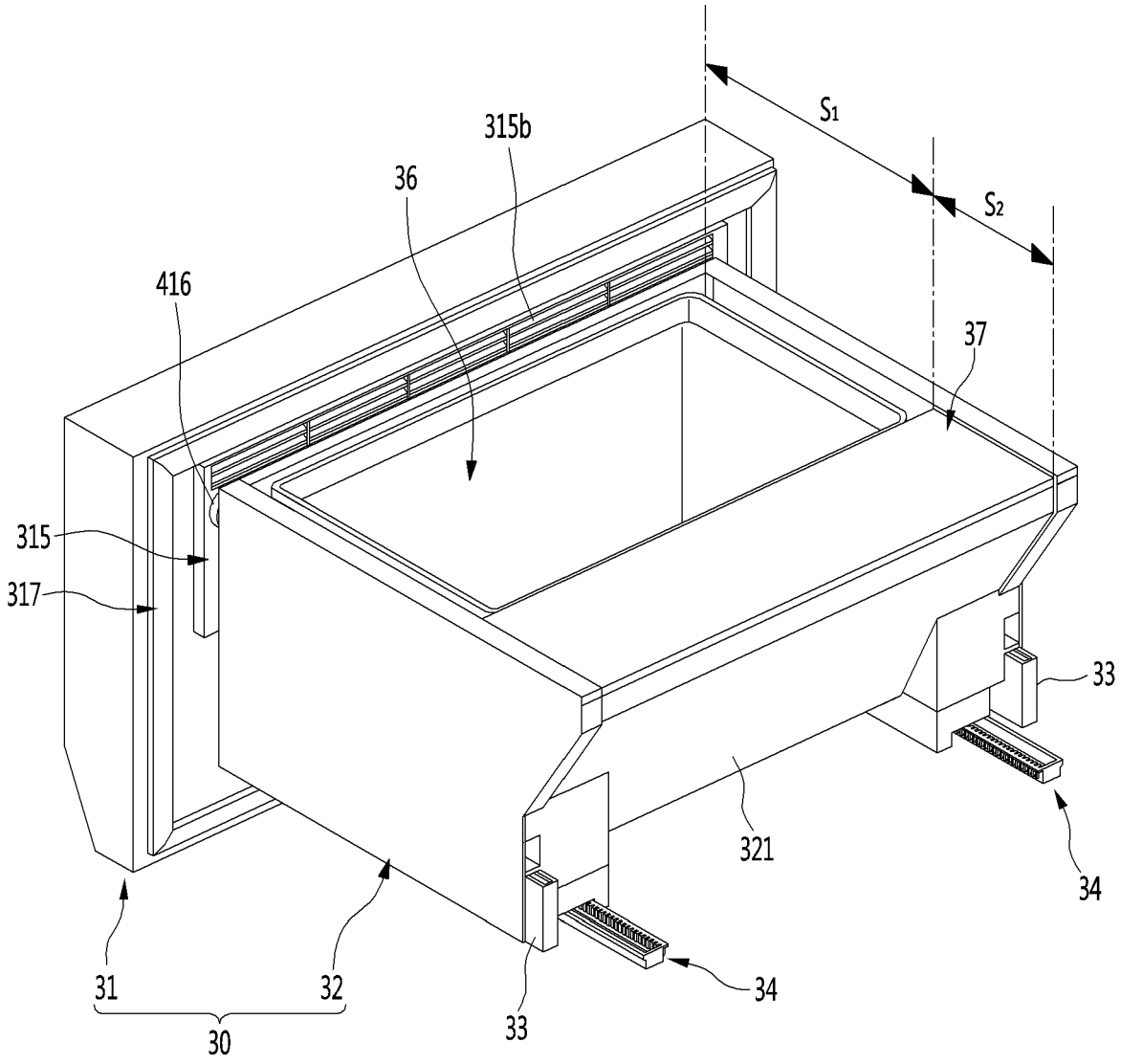
FIG. 38 is a perspective view of the drawer door according to an embodiment.
Figure 39:
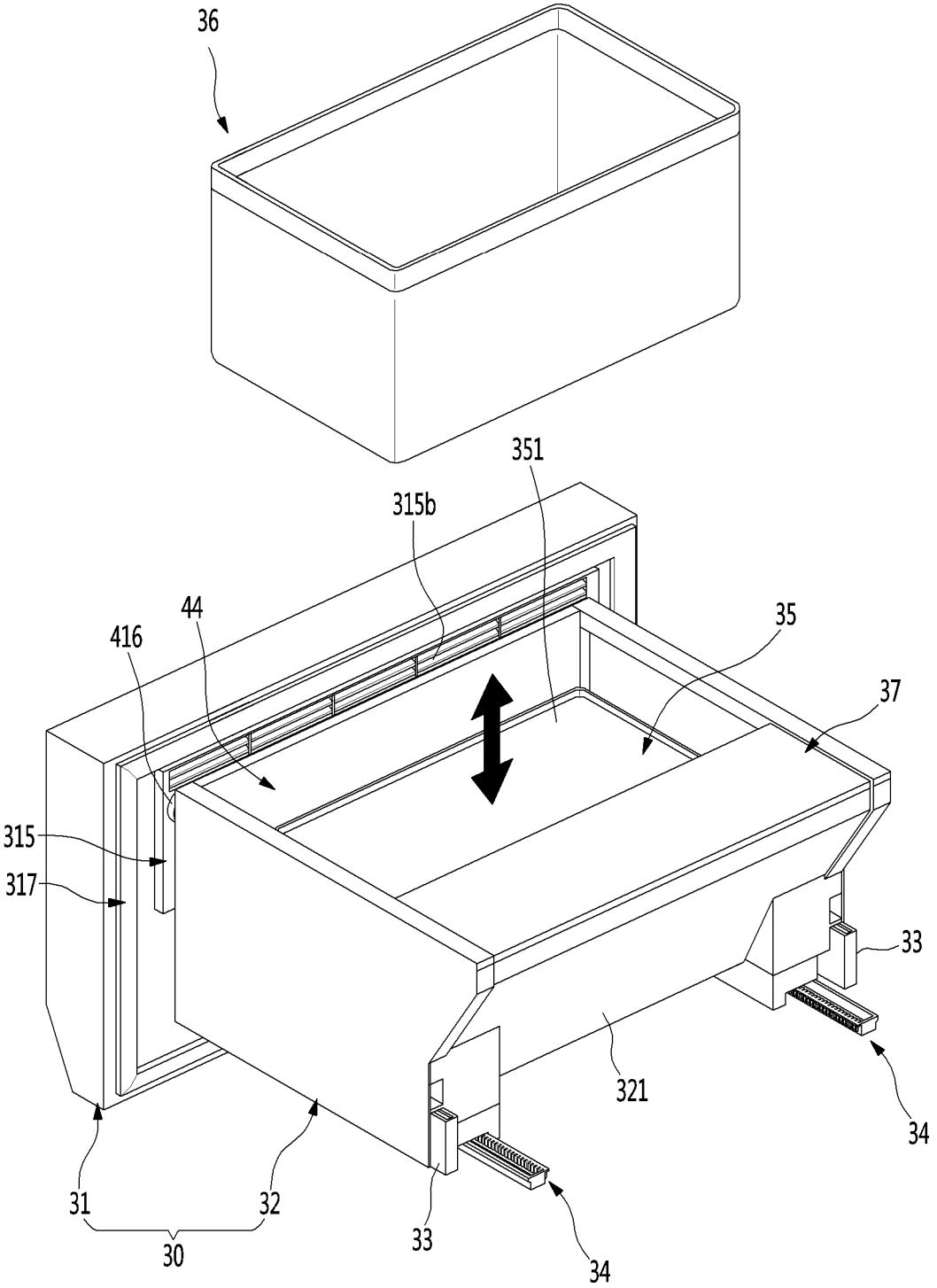
FIG. 39 is a perspective view illustrating a state in which a container of the drawer door is separated.
Figure 40:
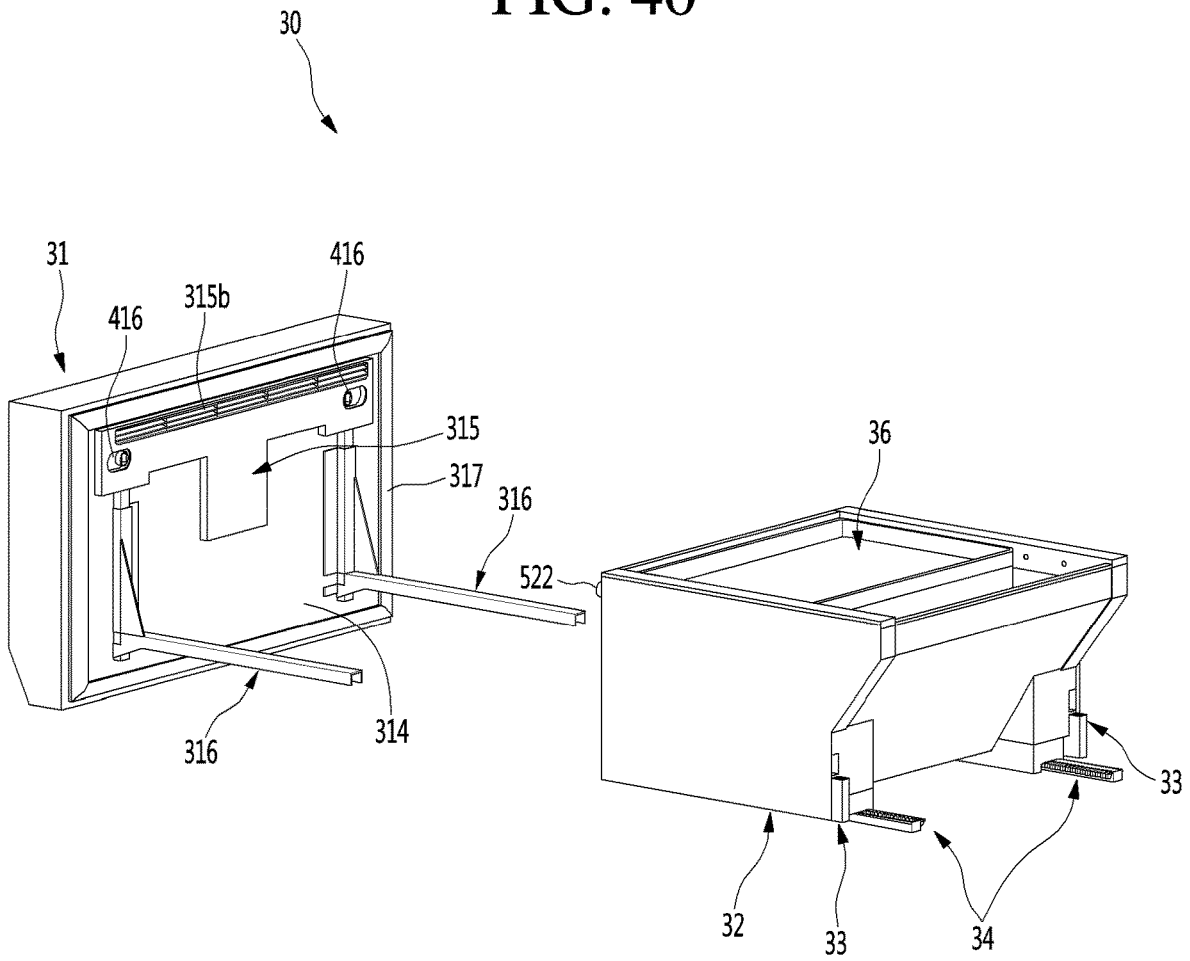
FIG. 40 is an exploded perspective view illustrating a state in which a drawer part of the drawer door and a front panel door part are separated from each other when viewed from a front side.
Figure 41:
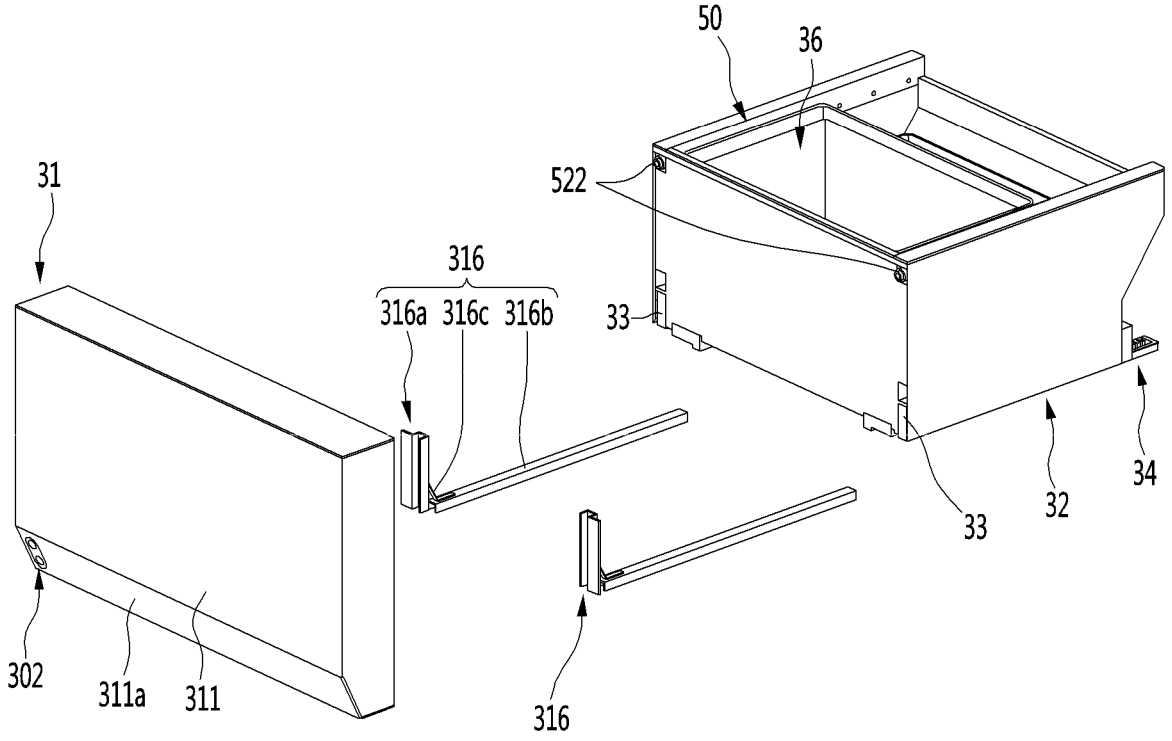
FIG. 41 is an exploded perspective view illustrating a state in which the drawer part of the drawer door and the front panel door part are separated from each other when viewed from a rear side.
Figure 42:
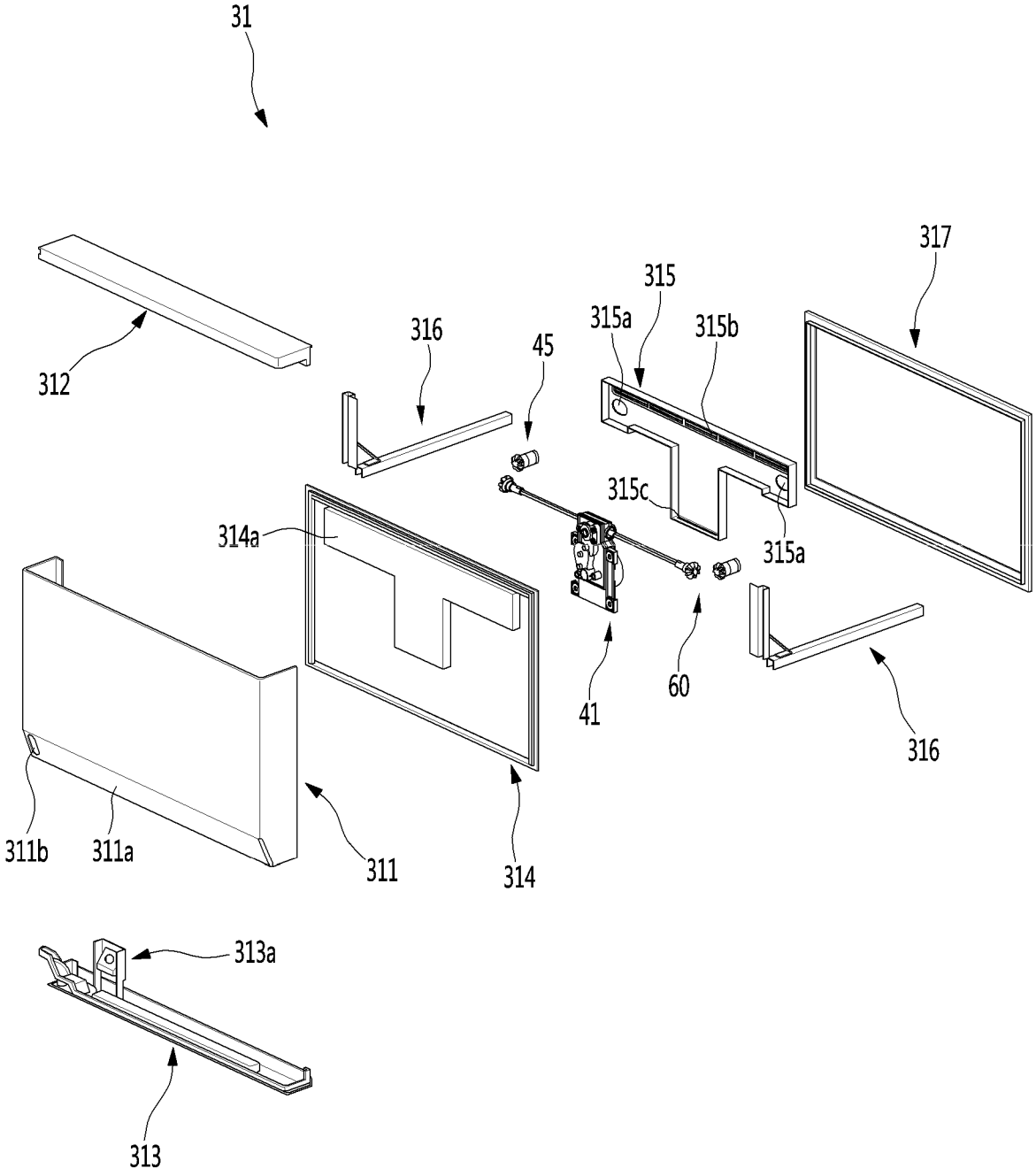
FIG. 42 is an exploded perspective view of the front panel door part.
Figure 43:
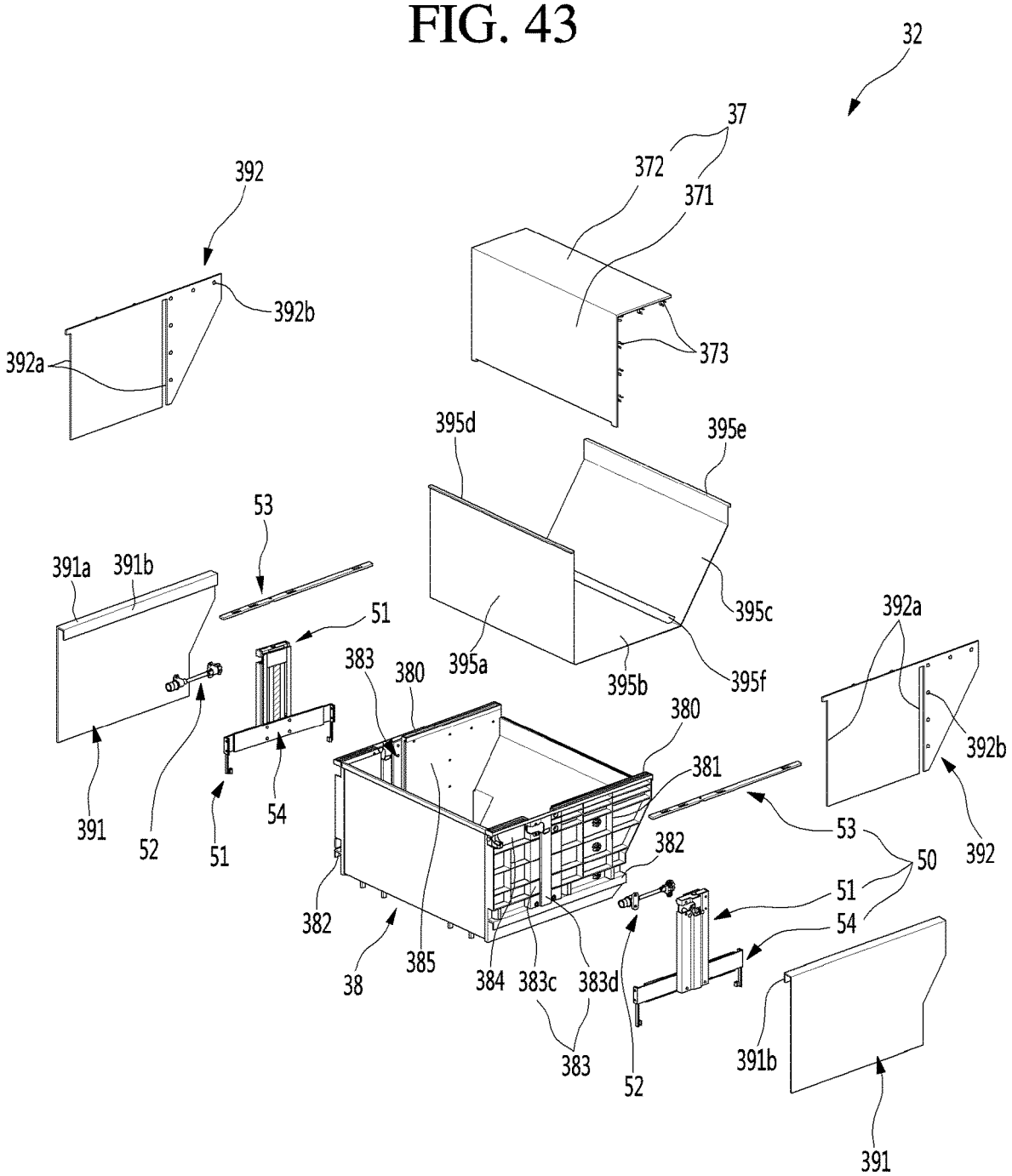
FIG. 43 is an exploded perspective view of the drawer part.
Figure 44:
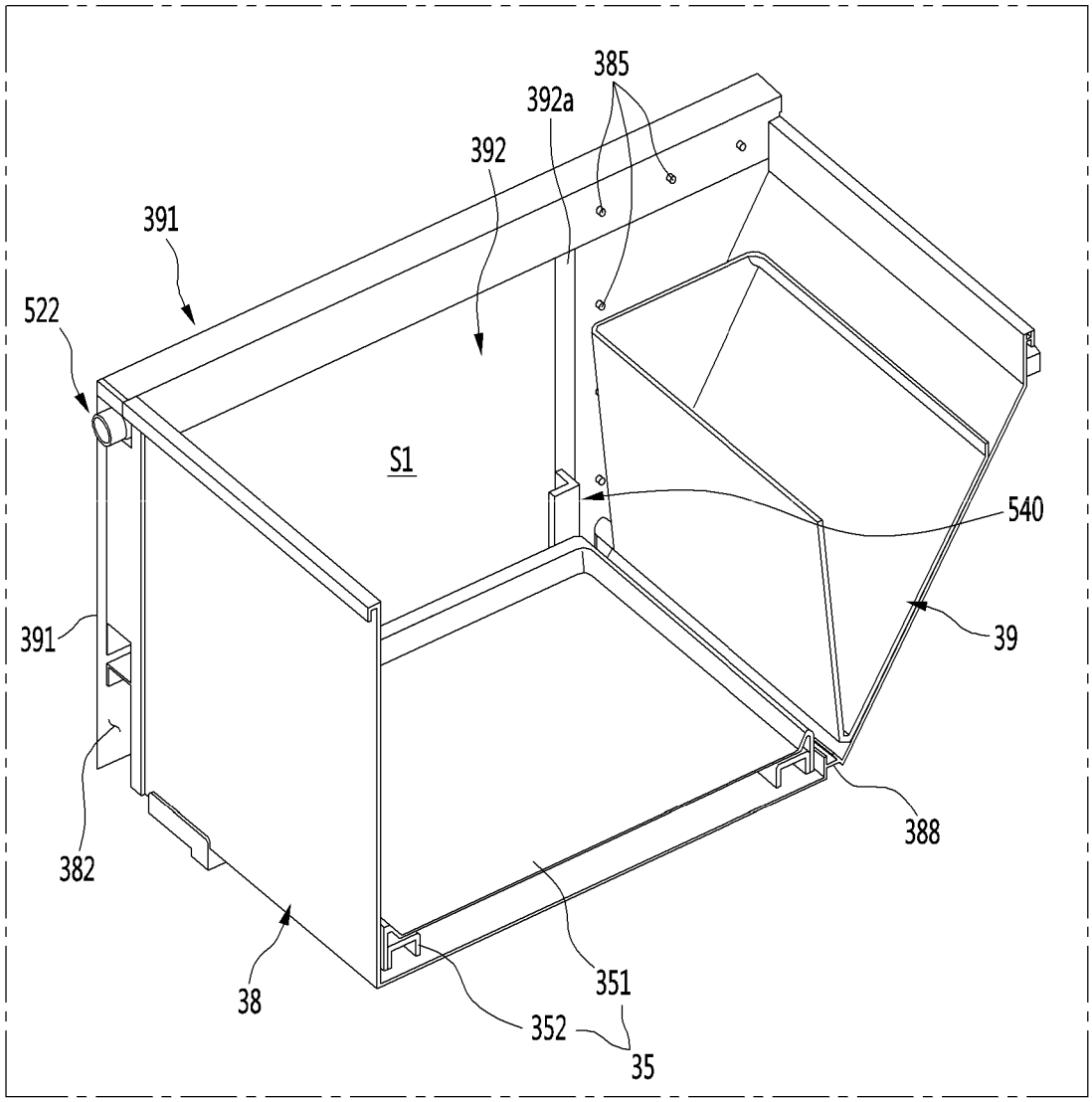
FIG. 44 is a cutaway perspective view illustrating a structure of the drawer part.

FIG. 38 is a perspective view of a drawer door according to an embodiment. Also, FIG. 39 is a perspective view illustrating a state in which a container of the drawer door is separated. Also, FIG. 40 is an exploded perspective view illustrating a state in which a drawer part of the drawer door and a front panel door part are separated from each other when viewed from a front side. Also, FIG. 41 is an exploded perspective view illustrating a state in which the drawer part of the drawer door and the door part are separated from each other when viewed from a rear side. Also, FIG. 42 is an exploded perspective view of the door part. Also, FIG. 43 is an exploded perspective view of the drawer part. Also, FIG. 44 is a cutaway perspective view illustrating a structure of the drawer part.

As illustrated in the drawings, a drawer door 30 according to the fourth embodiment may have the same structure as that of the third embodiment. An elevation assembly may be provided in the drawer door 30, a door-side device 41 may be provided in a front panel door part 31, and a drawer-side device 50 may be provided in the drawer part 32.

The door-side device 41 may be constituents disposed on the front panel door part 31 of the elevation assembly and include a motor assembly 412 providing power, a door-side shaft rotating by the motor assembly 412, a door-side first gear 414 having a bevel gear shape and disposed on each of both ends of the door-side shaft 413, and a door-side second gear 415 having a bevel gear shape and coupled to the door-side first gear 414 and the door connection member 416. Also, the door-side device 41 may further include the door connection member 416.

The motor assembly 412 may provide power for driving the elevation assembly. Also, the motor assembly 412 may be disposed in parallel to the front surface of the front panel door part 31 to minimize a recessed depth of the inside of the front panel door part 31, thereby securing insulation performance.

However, a drawer-side device 50 is provided on each of both left and right sides of a drawer part 32, and detailed structure of the drawer-side device 50 may be different from that according to the third embodiment.

The drawer-side device 50 may include an elevation device 51, a drawer-side shaft 52, a mounting part bracket 53, and a connecting bracket 54. Among them, the structure of the elevation device 51 and the connecting bracket 54 are somewhat different from the above-described embodiment, and the other structures are the same. Also, there may also be differences in other portions of the constituents that have the coupling relationship with the drawer side device 50.

The support member 35 of the drawer-side device 50 and the elevation device 51 may be disposed on the inner surface of the drawer body 38, and the drawer-side shaft may be disposed outside the drawer body 38. Also, the mounting part 383 and the shaft mounting part 384 may communicate with each other, and the shaft 52 and the elevation device 51 may be connected to each other in the state of being mounted on the drawer body 38.

Also, the plurality of plates 391, 392, and 393 made of a plate-shaped metal material such as stainless steel to define at least portions of the inside and outside of the drawer body 38 may be provided on the drawer body 38.

In detail, the outer side plate 391 may be disposed on each of both left and right surfaces of the outside of the drawer body 38. The outer side plate 391 may be mounted on each of both the left and right surfaces of the drawer body 38 to define an outer appearance of each of both the side surfaces. Particularly, the constituents such as the drawer-side shaft 52 and the draw-out rail 33, which are mounted on both the sides of the drawer body 38 may not be exposed to the outside.

Also, an upper bent part 391*a* may be disposed on an upper end of the outer side plate 391. The upper bent part 391*a* may cover the upper end of each of both the side surfaces of the drawer body 38 and the mounting part bracket 53. Also, a side end bent part 391*b* may be disposed on the extending end of the upper bent part 391*a*. The side end bent part 391*b* may be vertical bent downward and overlap the upper end of the inner side plate 392.

An inner side plate 392 may be disposed on each of both left and right surfaces of the inside of the drawer body 38. The inner side plate 392 may be mounted on each of both the side surfaces of the drawer body 38 to define both the left and right surfaces of the inside thereof.

The extending end of the upper bent part 391*a* may contact the upper end of the inner side plate 392 or overlap the upper end of the inner side plate 392. Thus, all of both side surfaces, inner and outer side surfaces, and a top surface of the drawer body 38 may be covered by the inner side plate 392 and the outer side plate 391.

Particularly, the inner side plate 392 may be disposed on each of both side surfaces of the inside of the drawer body 38 to completely cover the elevation device 51 mounted on the mounting part 383. Thus, in the state in which the inner side plate 392 is installed, the elevation device 51 may be completely covered except for a portion at which the elevation guide part 392*a* is disposed.

Also, a pair of elevation guide part 392*a* may be disposed on the inner side plate 392. The elevation guide part 392*a* may be disposed at a position corresponding to each of front and rear ends of the front space S1.

The support member coupling part 542 of the connecting bracket 54 of the elevation device 51 may be inserted into the elevation guide part 392*a*. When the elevation device 51 operates, the support member coupling part 542 may be vertically cut to vertically move.

The pair of elevation guide parts 392*a* may be disposed in parallel to each other. Also, the elevation guide part 392*a* may be vertically cut in the front end of the inner side plate 392 corresponding to the front end of the front space S1 and may be vertically cut in one side of the inner side plate 392 corresponding to the rear end of the front space S1. Each of the elevation guide parts may extend up to a height corresponding when the support member 35 ascends up to a maximum height from the lower end of the inner side plate 392.

The drawer cover 37 may include a cover front part 371 that partitions the inside of the drawer body 38 into a front space S1 and a rear space S2 and a cover top surface part 372 bent from an upper end of the cover front surface part 371 to cover a top surface of the rear space S2.

That is, when the drawer cover 37 is mounted, only the front space S1, in which the support member 35 is disposed, may be exposed in the drawer body 38, and the rear space S2 may be covered by the drawer cover 37.

Also, the elevation guide part 392*a* may be disposed on each of both side surfaces of the drawer part 32, which is adjacent to both ends of the drawer cover 37. That is, the elevation guide part 392*a* may be disposed on both edges of the front and rear ends of the front space S1 inside the drawer part 32.

Also, the support member 35 may have a rectangular plate shape. Substantially, the support member 35 may include an elevation plate 351 supporting the food or container and an elevation frame 352 supporting the elevation plate 351 at a lower side and reinforcing strength of the elevation plate 351.

The support member 35 may have a size corresponding to that of the front space S1. Thus, the bottom surface of the front space S1 may be defined by the support member 35 when the support member 35 is mounted, and the constituents in the lower portion of the front space S1 may be maintained to be covered while being elevated, thereby realizing more neat outer appearance.

In the state in which the drawer cover 37 is mounted on the drawer part 32, the front surface of the drawer cover 37 may contact the rear end of the support member 35. Also, the food and container seated on the support member 35 may be prevented from dropping or separated from the support member because the rear space S is blocked by the front surface of the drawer cover 37.

When the elevation device 51 descends to be disposed at the lowermost position, the support member 35 may contact the bottom surface of the drawer part 32. Also, a height of the support member 35 inside the front space S1 may be determined by the height to which the elevation device 51 is capable of being ascending. Here, the maximum position may be defined at a position that is less than that of the upper end of the drawer part 32.

Figure 45:
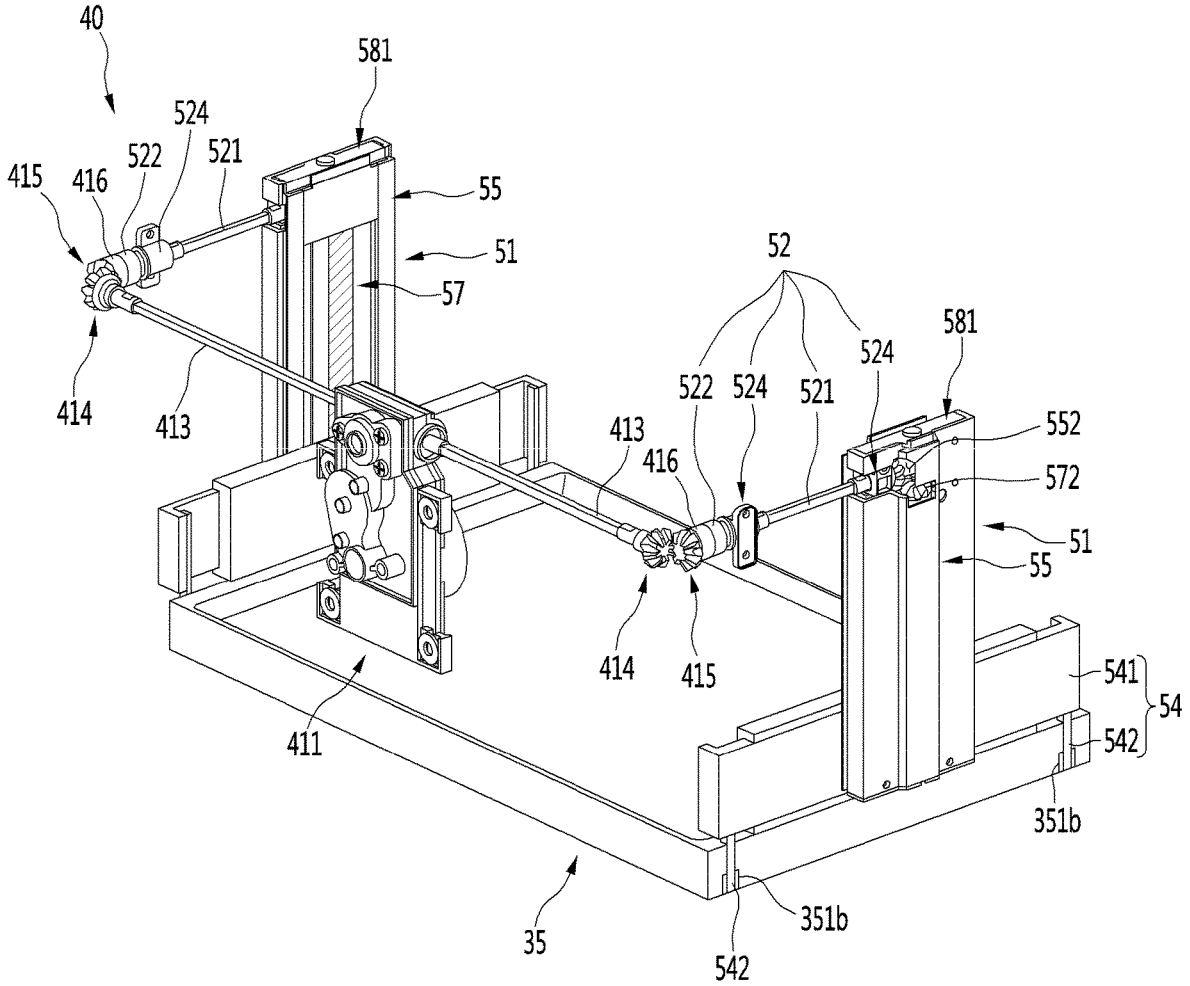
FIG. 45 is a perspective view of an elevation assembly built in the drawer door.
Figure 46:
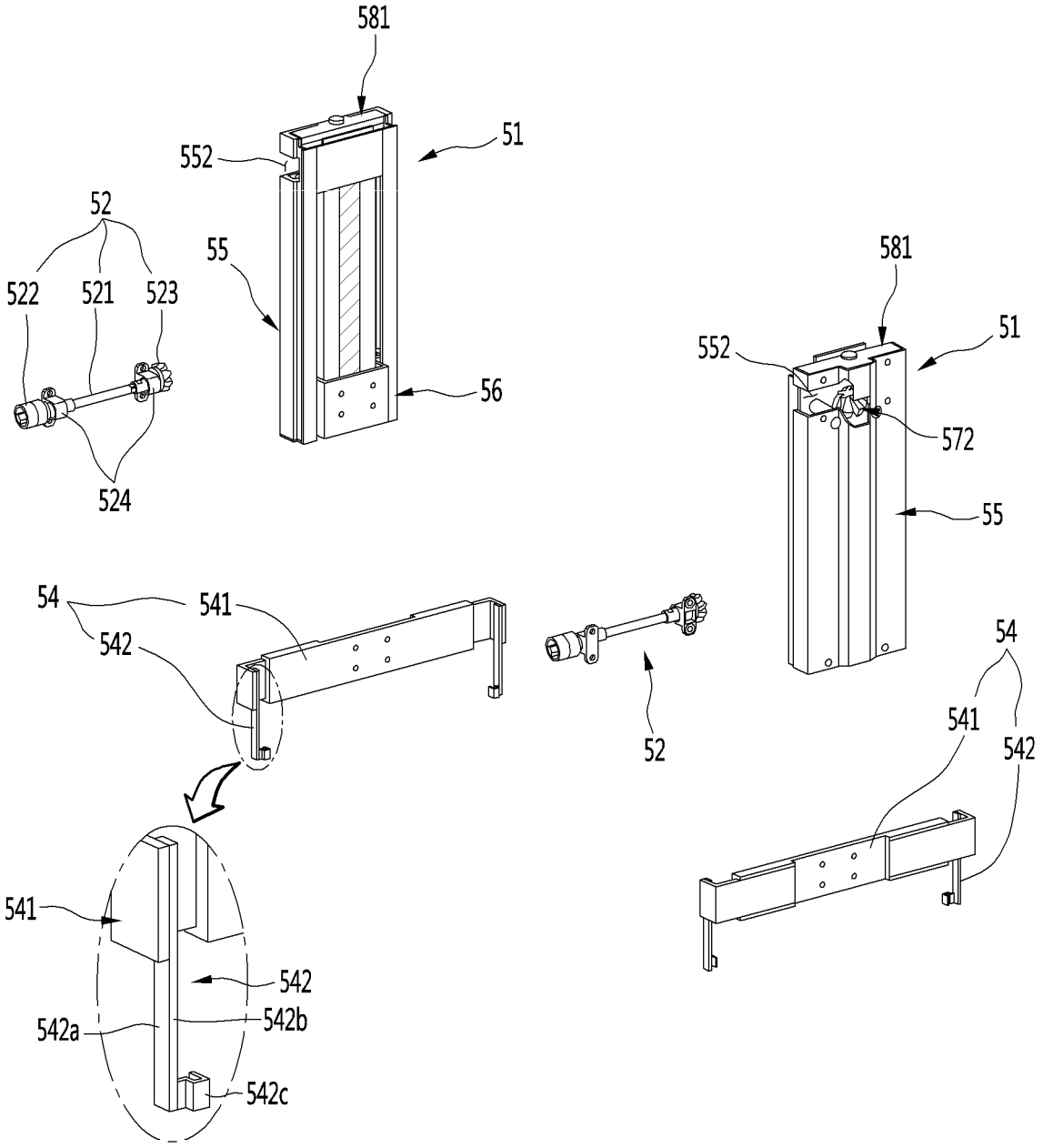
FIG. 46 is an exploded perspective view illustrating an elevation device of the elevation assembly.

FIG. 45 is a perspective view of the elevation assembly built in the drawer door. Also, FIG. 46 is an exploded perspective view illustrating an elevation device of the elevation assembly.

As illustrated in the drawings, the elevation assembly may be provided by coupling the door-side device 41 to the drawer-side device 50.

The drawer-side device may include the elevation device 51 for the vertical movement of the support member 35, the drawer-side shaft 52 connected to the elevation device 51 and the door-side device 41 to transmit the power, and the connecting bracket 54 connected to the elevation device 51 and the support member 35.

The arranged position of the elevation device 51 may be a position corresponding to a center of the front space S1 in the front and rear direction and be disposed at a position corresponding to a central portion of each of both the side surfaces of the support member 35. Thus, even though an eccentric load occurs at one side of the support member 35, the support member 35 may be in the stable state without being tilted, and thus, the support member may be stably elevated.

A connecting bracket 54 connecting the elevation device 51 to the support member 35 may be disposed on the lower end of the drawer-side device 50. The connecting bracket 54 may be connected to each of both ends of the support member 35.

Also, a support member coupling part 542 may be disposed on each of both ends of the connecting bracket 54, and the support member coupling part 542 may be coupled to each of front and rear ends of both side surfaces of the support member 35. Thus, when the elevation device operates, the connecting bracket 54 may be coupled to four corners of the support member 35 so that the support member 35 is elevated in the horizontal state.

The connecting bracket 54 may be coupled to the block holder 56 that is elevate along the elevation shaft 57 to connect the elevation device 51 to the support member 35.

The connecting bracket 54 may include a rail coupling part 541 coupled to the elevation device 51 and a support member coupling part 542 coupled to the support member 35.

In detail, the rail coupling part 541 may define an upper portion of the connecting bracket 54 and be coupled to an outer surface of the block holder 56. Also, the rail coupling part 541 may extend forward and backward and also extend to a length corresponding to that of each of both side surfaces of the support member 35.

Also, a side mounting part 541*a* to which the support member coupling part 542 is coupled may be disposed on each of both the ends of the rail coupling part 541. The side mounting part 541*a* may be bent at a position corresponding to the elevation guide part 392*a* and also bent toward the elevation guide part 392*a*.

The support member coupling part 542 may extend downward from both ends of the rail coupling part 541. The support member coupling part 542 may be provided as a separate constituent and coupled to the side mounting part 541*a*. Also, the support member coupling part 542 may be integrally molded with the side mounting part to extend downward.

The support member coupling part 542 may include an extension part extending up to the lower end of the support member 35 and a restriction part bent from a lower end of the extension part toward the support member.

The extension part may include a first extension part 542*a* and a second extension part 542*b*, which are bent in different directions. The first extension part 542*a* may be coupled to the side mounting part 541*a* to extend in a direction passing through the elevation guide part 392*a*. The second extension part 542*b* may be vertically bent at an end of the first extension part 542*a* and disposed outside the elevation guide part 392*a*.

The restriction part 542*c* may be inserted into both side surfaces of the support member 35 at the lower end of the extension part. The restriction part 542*c* may pass through an insertion part 351*b* of the elevation plate 351, which will be described below, to support the elevation frame 352 from a lower side. The restriction part 542*c* may be bent toward the support member 35 and then continuously bent in the vertical direction to maintain the seated state of the support member 35.

The support member coupling part 542 may be made of a metal material having high strength. Here, the plate-shaped material may be bent several times so as to be easily molded. Thus, even though the food or container is seated on the support member 35, the stable support state may be maintained without being deformed or broken in the heavy state.

The support member coupling part 542 may be provided in pairs on the connecting bracket 54 on both sides, and the support member 35 may be elevated in the state in which both front and rear ends of the support members 35 are supported.

FIG. 47 is a perspective view illustrating a support member of the elevation assembly.

As illustrated in the drawing, the support member may include an elevation plate 351 defining a surface supporting the food or container and an elevation frame 352 disposed below the elevation plate 351 to support the elevation plate 351.

A plate edge 351*a* protruding upward may be disposed on a circumference of the elevation plate 351 to prevent the food or container seated on the support member 35 from being separated from the support member 35 by the plate edge 351*a*. The plate edge 351*a* may extend downward to define a circumferential surface of a side surface of the elevation plate 351 and provide a space in which the elevation plate 351 is accommodated.

An insertion part 351*b* may be defined in each of both side surfaces of the elevation plate 351. The insertion part 351*b* may be defined in each of front and rear ends of both side surfaces of the elevation plate 351 corresponding to the position of the support member coupling part 542. Also, the insertion part 351*b* may serve as a path into which the restriction part 542*c* of the support member coupling part 542 is inserted and be disposed at a position corresponding to the frame support part 352*c* disposed on the restriction part 542*c* and the elevation frame 352. Thus, the restriction part 542*c* inserted into the insertion part 351*b* may be coupled to the frame support part 352*c*.

The insertion part 351*b* may have a shape that is cut in a lower end of each of both side surfaces of the elevation plate 351. Thus, in the state in which the elevation plate 351 is lifted upward to maintain the connection state between the support member 35 and the connecting bracket 54, only the elevation plate 351 may be separated.

A handle 351*c* may be disposed on an upper end of each of both side surfaces of the elevation plate 351. The handle 351*c* may be defined by recessing a portion of the elevation plate 351. The user may insert his hand into the handle 351*c* to lift and separate the support member 35. Here, the user may separate only the elevation plate to lift the elevation plate.

The elevation frame 352 may be made of a metal material and have a rectangular frame shape. The elevation frame 352 may be provided by bending a plate-shaped metal material and have a metal rod or tube shape.

The elevation frame 352 may have a rectangular frame shape that is capable of being accommodated into the elevation plate 351. The elevation frame 352 may closely contact the inner circumferential surface of the elevation plate 351 or may be fixed to the elevation plate 351 by a separate member.

The elevation frame 352 may include four frame outers 352*a* defining an outer circumference of the elevation frame 352 and a pair of frame inner 352*b* connecting the facing frame outer 352*a* in an inner space of the frame outer 352*a*. Thus, the elevation frame 352 may have a lattice shape to stably support the heavy object without being deformed or damaged.

A frame support part 352*c* into which the restriction part 542*c* is inserted may be disposed on each of front and rear ends of both side surfaces of the elevation frame 352. The frame support part 352*c* may have a groove shape that is recessed inward or a shape in which a portion of the elevation frame 352 is cut. The frame support part 352*c* may be configured that the elevation frame 352 is seated on the restriction part 542*c*.

Thus, when the elevation device 51 ascends, the restriction part 542*c* may lift the frame support part 352*c* from a lower side to allow the support member 35 to ascend. When the elevation device 51 descends, the restriction part 542*c* may descend in the state of supporting the frame support part 352*c*.

Figure 48:
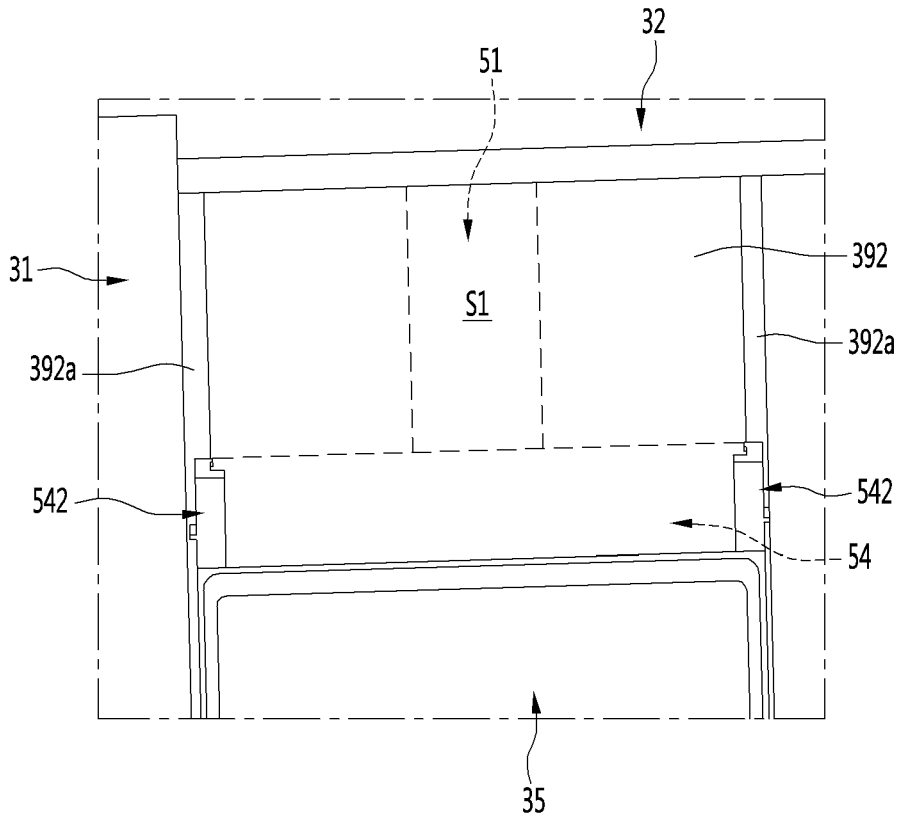
FIG. 48 is a partial perspective view of a sidewall surface of the drawer part.
Figure 49:
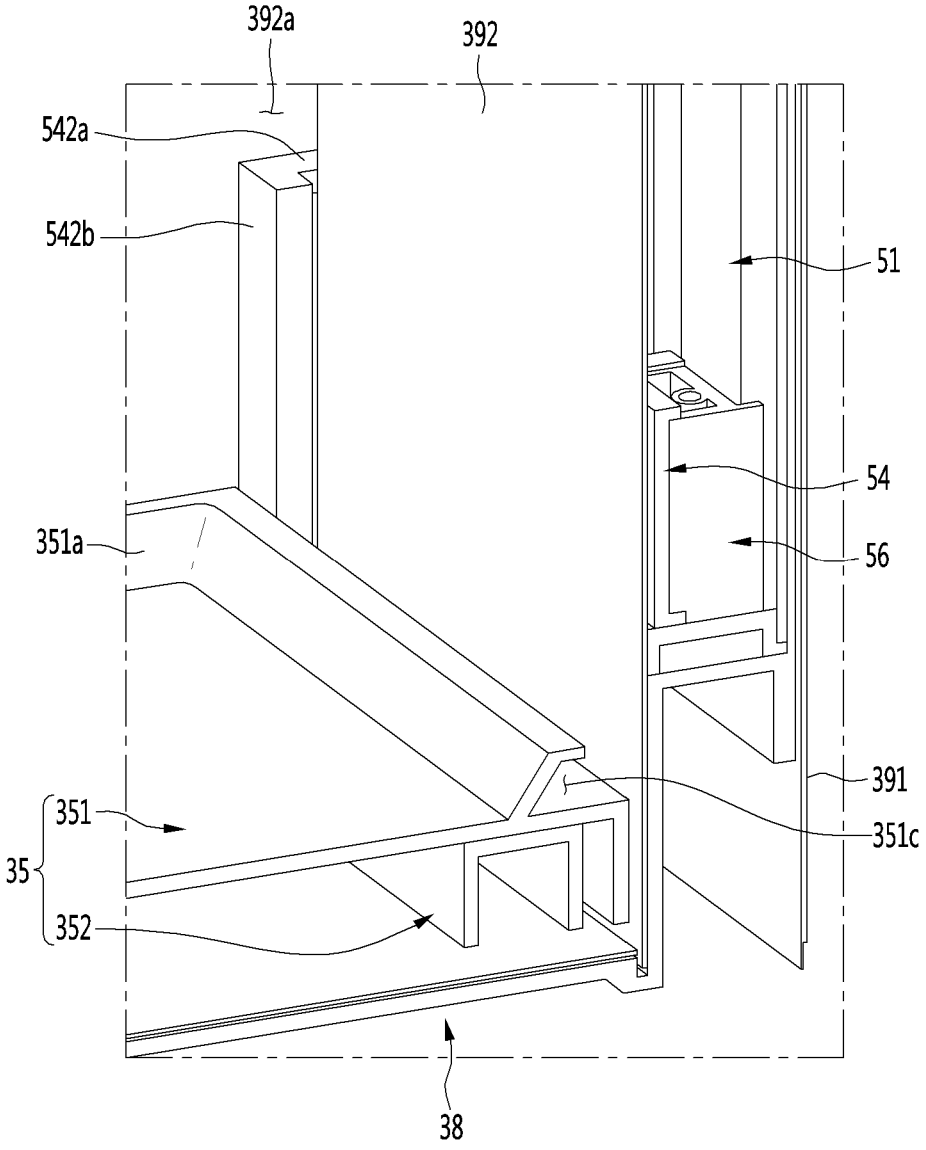
FIG. 49 is a partial cutaway perspective side view illustrating an arrangement of the support member and the drawer part of the elevation device.

FIG. 48 is a partial perspective view of a sidewall surface of the drawer part. Also, FIG. 49 is a partial cutaway perspective side view illustrating an arrangement of the support member and the drawer part of the elevation device.

Referring to the drawings, in the state in which the elevation device 51 and the support member 35 are mounted inside the drawer part 32, the elevation device may be completely covered by the inner side plate 392 in the state of being mounted on the drawer body 38. Also, the inner side plate 392 may define both side surfaces of the front space S1.

In the inner side plate 392, the elevation guide part 392*a* may extend in the vertical direction, and both ends of the connecting bracket 54 may be exposed through the elevation guide part 392*a*.

In detail, in the state in which the connecting bracket 54 is mounted, a portion of the support member coupling part 542 may be exposed to the outside of the elevation guide part 392*a* disposed on the inner side plate 392. That is, the first extension part 542*a* may pass through the elevation guide part 392*a*, and the second extension part 542*b* may pass through the elevation guide part 392*a* and then be bent to the inside of the inner side plate 392. Thus, since the support member coupling part 542 accommodates an end of the elevation guide part 392*a*, when the connecting bracket 54 is elevated, the connecting bracket 54 may be guided along the elevation guide part 392*a* without moving.

Also, the support member 35 may be seated on the support member coupling part 542 disposed at the front and rear ends of both side surfaces of the front space S1. The support member 35 may cover the bottom surface of the front space S1 by the elevation plate 351, and the elevation frame 352 may support the elevation plate 351 inside the elevation plate 351.

Also, the restriction part 542*c* of the support member coupling part 542 may pass through the insertion part 351*b* of the elevation plate 351 and then be coupled to the frame support part 352*c* of the elevation frame 352. Thus, the support member 35 connected to the connecting bracket 54 may be elevated by the elevation device 51.

The handle around the elevation plate 351 may be spaced somewhat from the inner side plate 392. Thus, the user may put his finger into the handle 351*c* to lift only the elevation plate 351 upward, thereby separating the elevation device 51 from the elevation frame 352.

Figure 50:
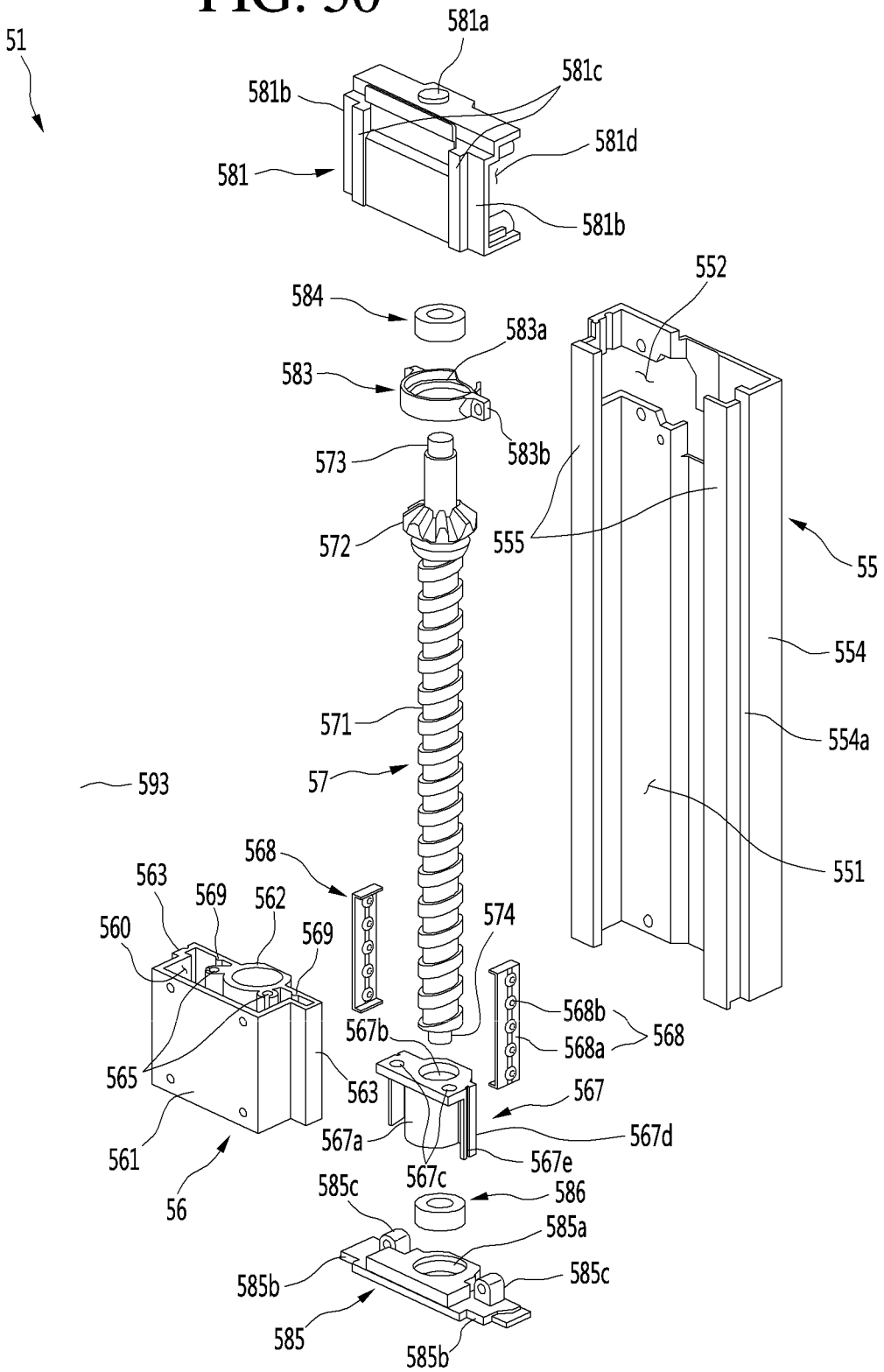
FIG. 50 is an exploded perspective view illustrating a structure of the elevation device when viewed in one direction.
Figure 51:
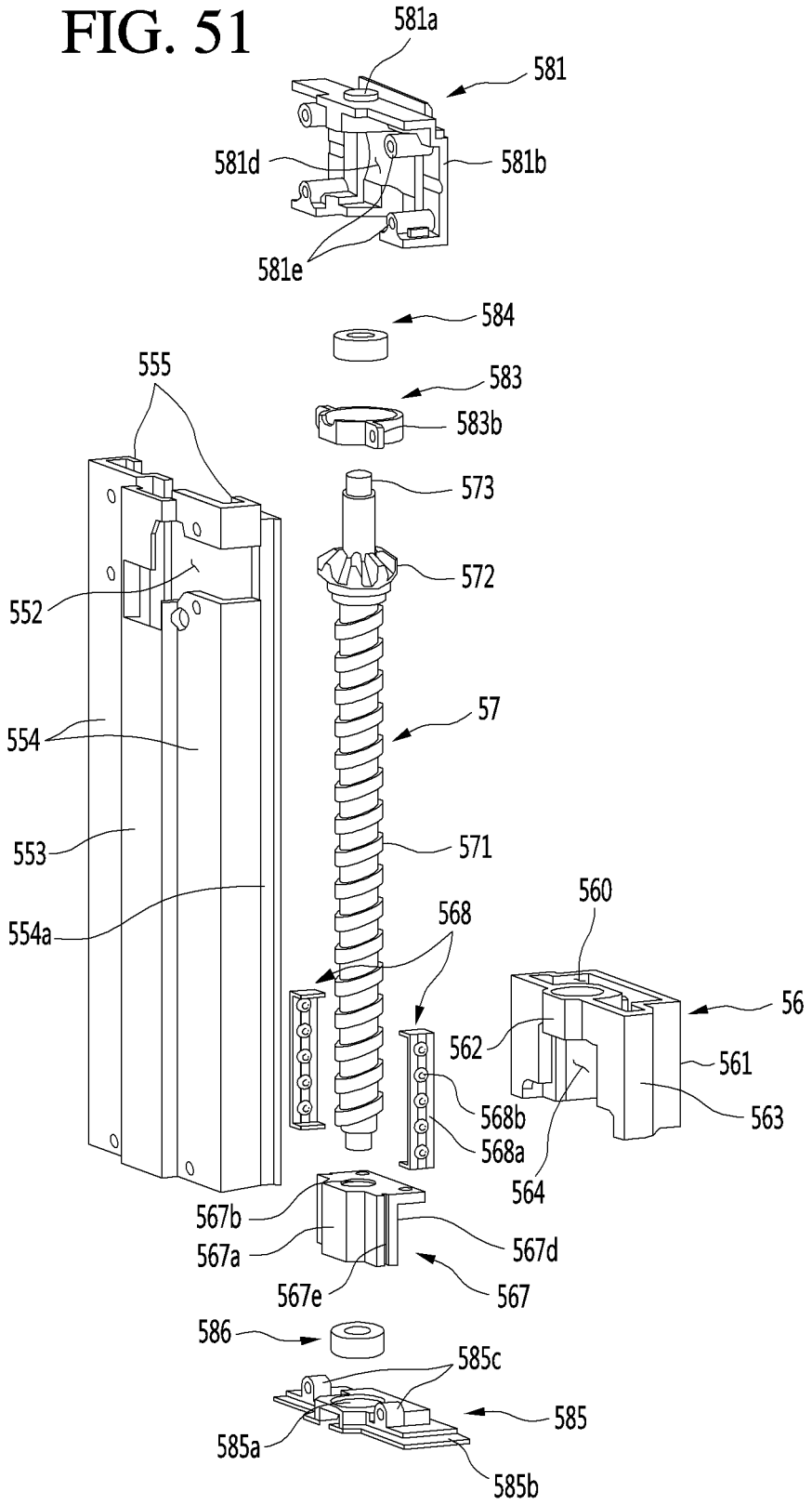
FIG. 51 is an exploded perspective view illustrating the structure of the elevation device when viewed in the other direction.
Figure 52:
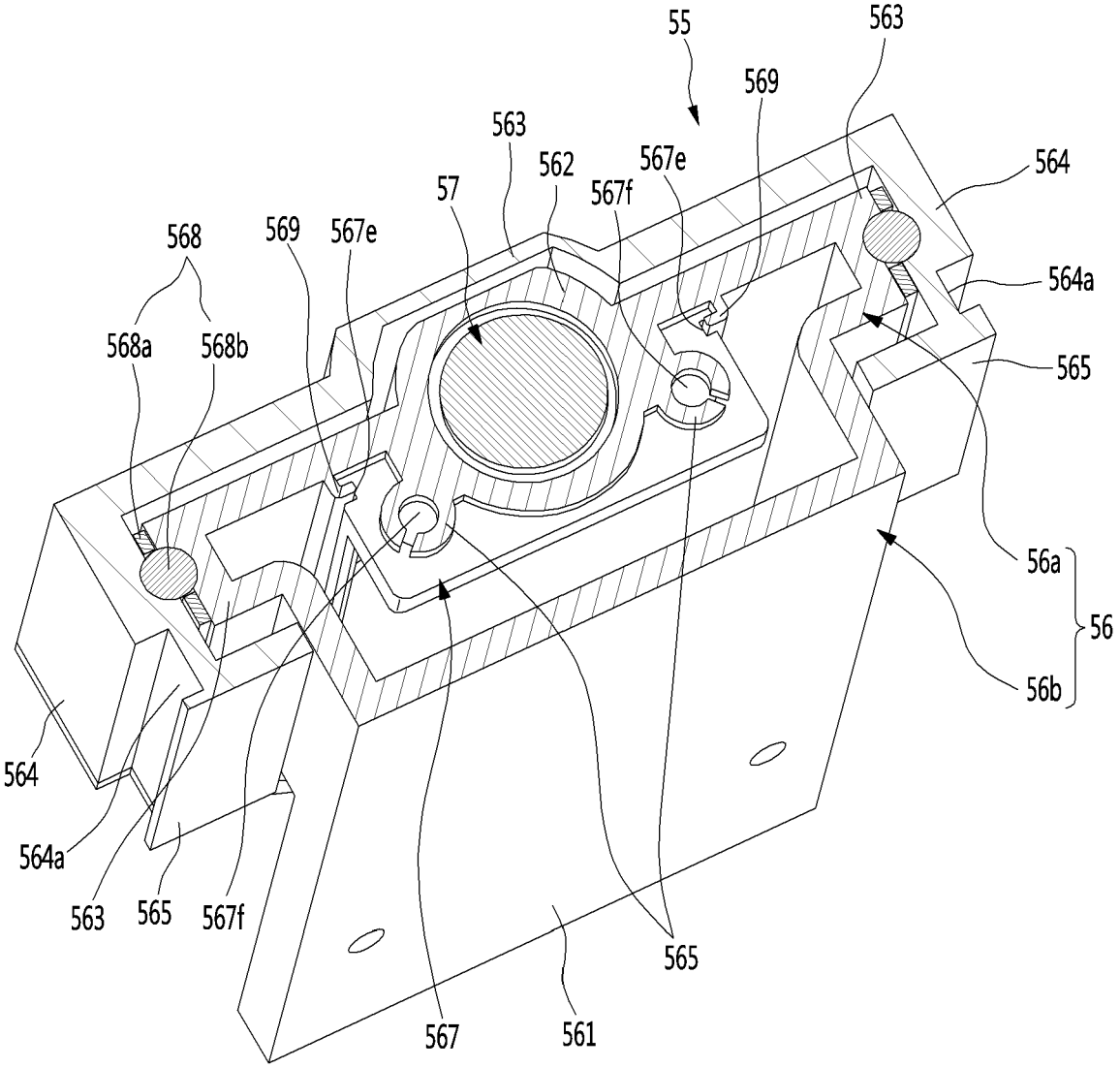
FIG. 52 is a cutaway perspective view illustrating a transverse cross-section of the elevation device.
Figure 53:
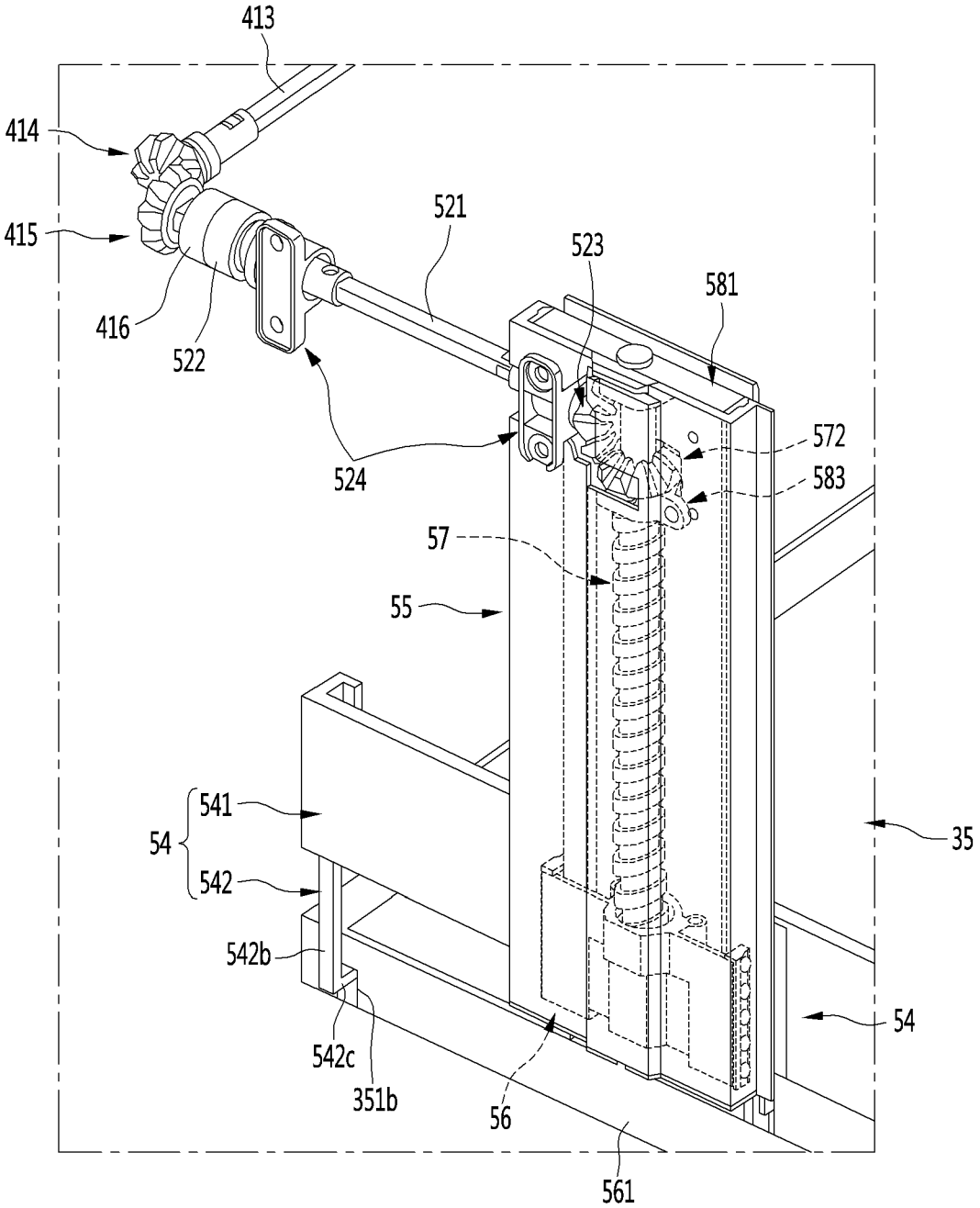
FIG. 53 is a partial perspective view illustrating a power transmission structure of the drawer-side device.

FIG. 50 is an exploded perspective view illustrating a structure of the elevation device when viewed in one direction. Also, FIG. 51 is an exploded perspective view illustrating the structure of the elevation device when viewed in the other direction. Also, FIG. 52 is a cutaway perspective view illustrating a transverse cross-section of the elevation device. Also, FIG. 53 is a partial perspective view illustrating a power transmission structure of the drawer-side device.

As illustrated in the drawings, the elevation device 51 may be the same as that according to the third embodiment except that the bracket mounting part 561 of the block holder 56 has a length less than that of the bracket mounting part according to the third embodiment, and the rail cover (see reference numeral 59 of FIG. 29) covering the housing opening 551 of the elevation device 51 is not provided.

Also, a structure of the connecting bracket 54 coupled to the elevation device 51 may be different.

Figure 54:
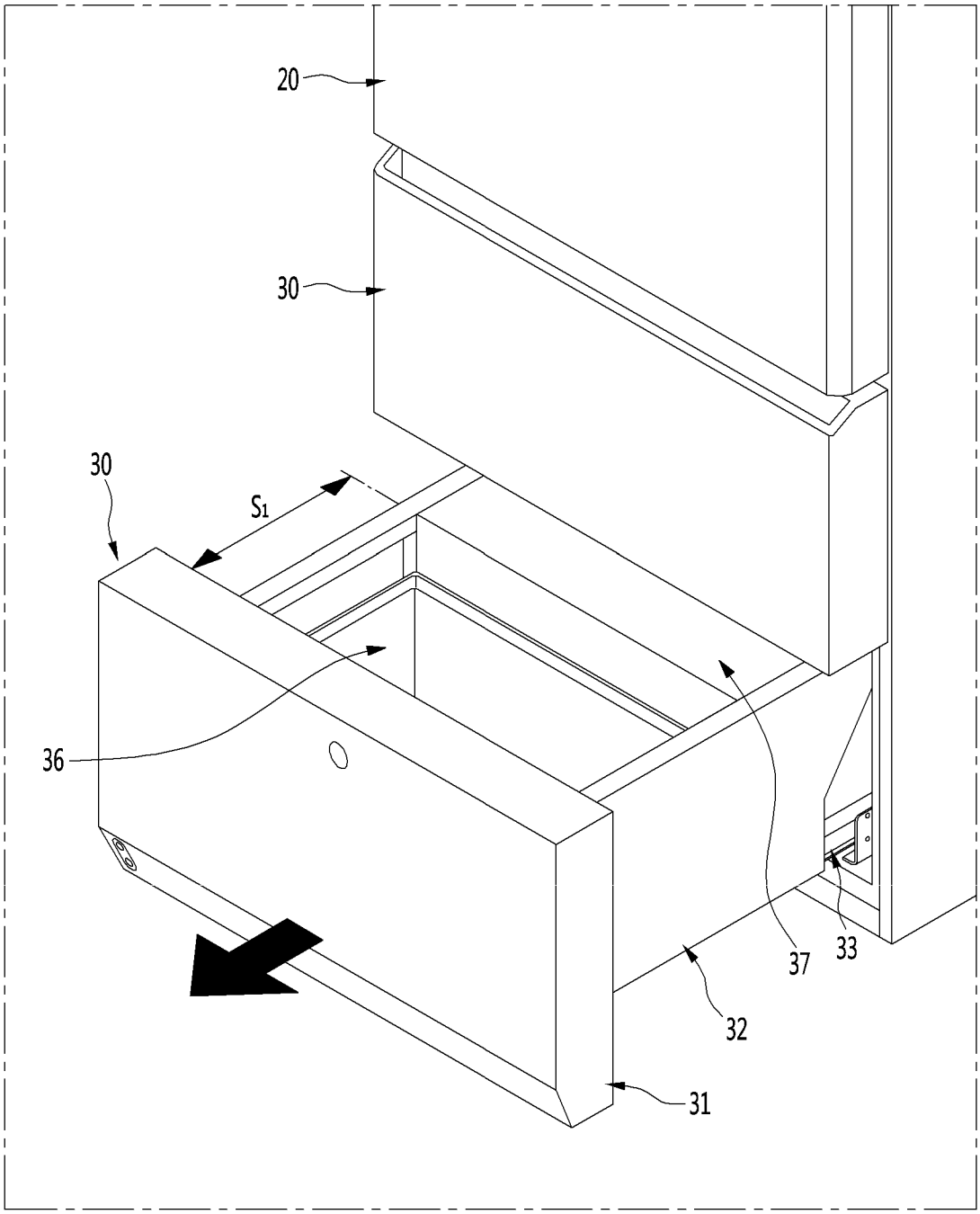
FIG. 54 is a perspective view illustrating a state in which the drawer door is completely opened.
Figure 55:
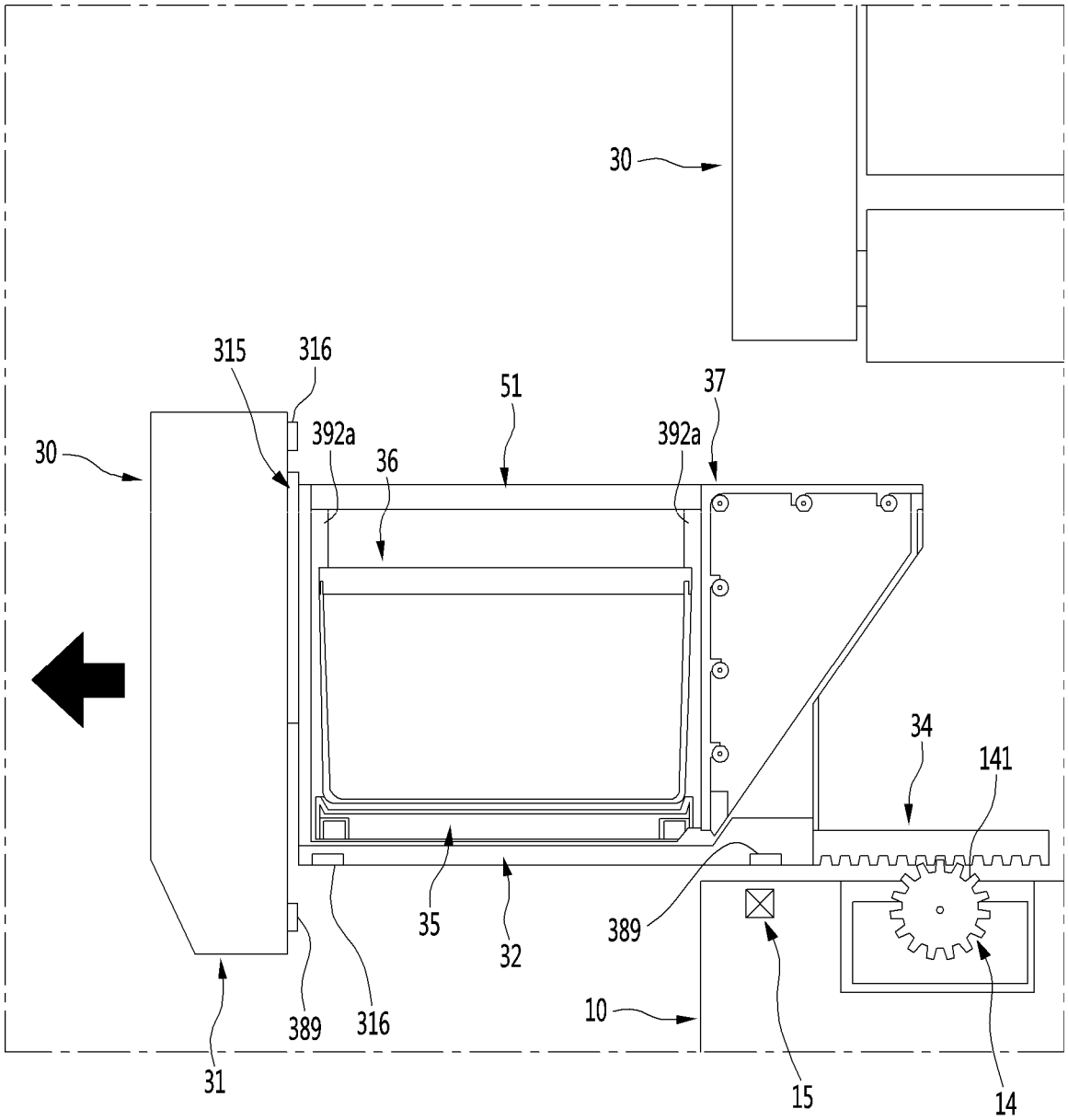
FIG. 55 is a cross-sectional view of the drawer door in the state of FIG. 54.

FIG. 54 is a perspective view illustrating a state in which the drawer door is completely opened. Also, FIG. 55 is a cross-sectional view of the drawer door in the state of FIG.

Figure 56:
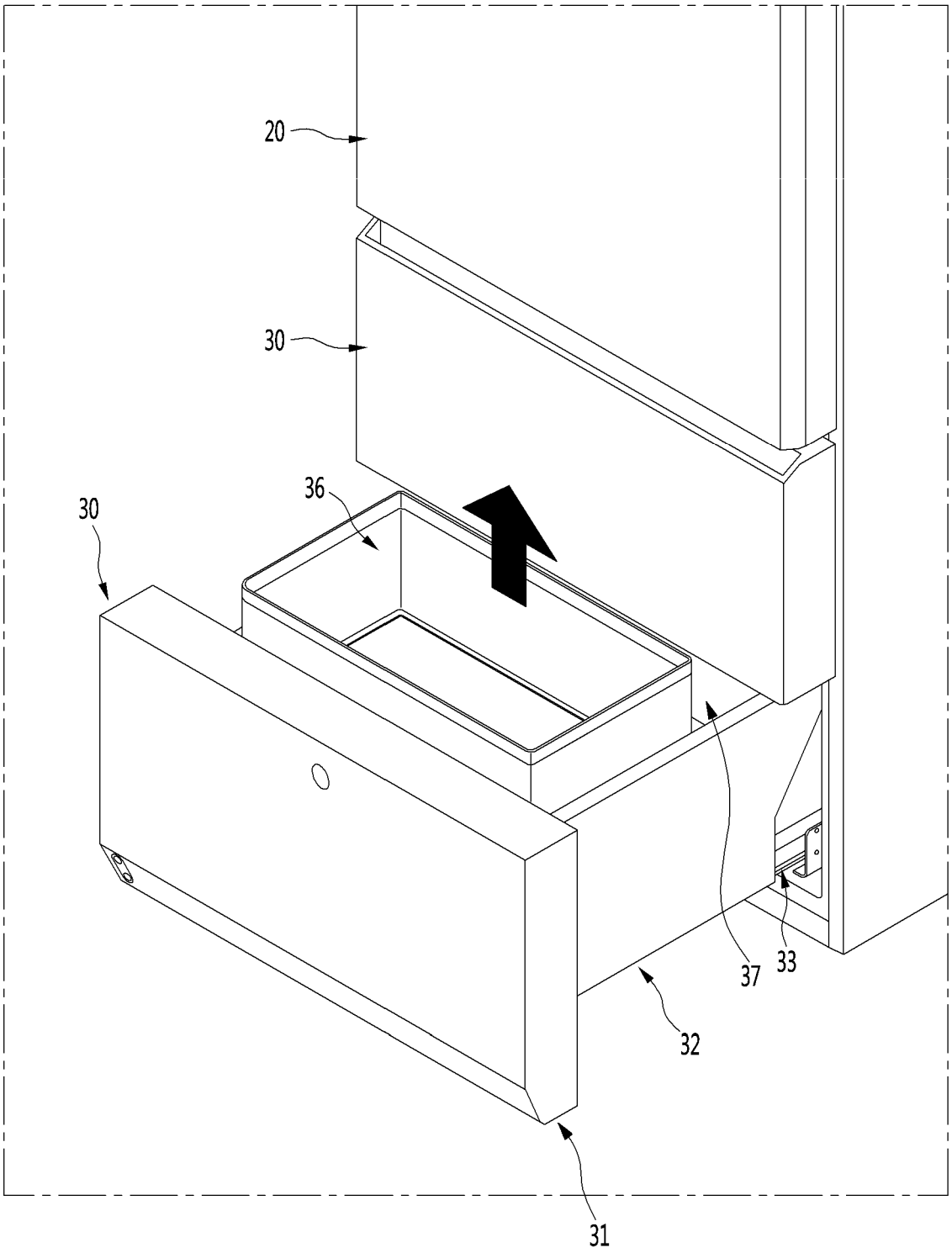
FIG. 56 is a perspective view illustrating a state in which the support member of the drawer door is completely elevated.
Figure 57:
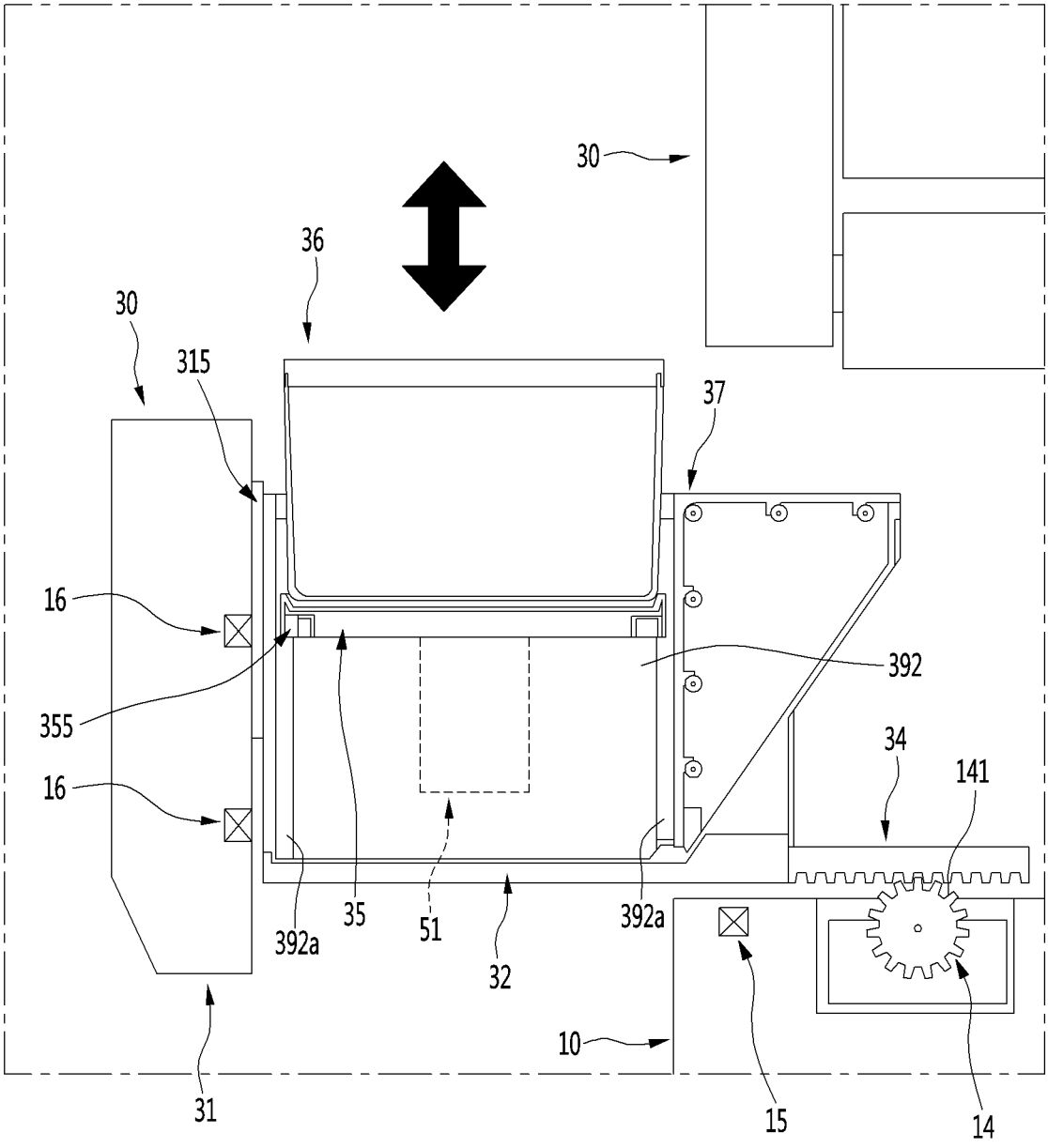
FIG. 57 is a cross-sectional view of the drawer door in the state of FIG. 56.

54. Also, FIG. 56 is a perspective view illustrating a state in which the support member of the drawer door is completely elevated. Also, FIG. 57 is a cross-sectional view of the drawer door in the state of FIG. 56.

Hereinafter, a state in which the drawer door 30 of the refrigerator 1 is inserted and withdrawn and is elevated according 4 to the third embodiment will be described in more detail with reference to the accompanying drawings.

The drawer door of the refrigerator according to the further embodiment may be completely withdrawn as illustrated in FIGS. 34 and 35 and completely ascend as illustrated in FIG. 47 in the state of being completely closed as illustrated in FIG. 17.

The above-described overall operation may be the same as that according to the third embodiment except for a portion of only an elevation manner of the elevation device. Thus, an operation of the elevation device may be described.

When the elevation motor 411 operates, the door-side shafts 413 connected to the elevation motor 411 may rotate, and also the first gear 414 and the second gear 415 connected to the door-side shaft 413 may rotate.

The rotation force of the door-side device 41 may be transmitted to the drawer-side device 50 by door connection member 416 and the drawer connection member 522, which are coupled to each other. Thus, the rotation force transmitted from the door-side device 41 may allow the drawer-side shaft 52 and the drawer-side gear 523 of the end of the drawer-side shaft 52 to rotate.

The rotation force may be transmitted in the state in which the drawer-side gear 523 and the shaft gear 572 are connected to each other, and the rotation force of the drawer-side shaft 52 may allow the elevation shaft 57 to rotate. Due to the rotation of the elevation shaft 57, the elevation block 567 and the block holder 56 may move upward along the elevation shaft 57.

Here, the block holder 56 may vertically move together with the connecting bracket 54 in the state of being coupled to the connecting bracket 54, and the support member 35 coupled to the connecting bracket 54 may also move upward. Here, the connecting bracket 54 may be connected to each of front and rear ends of both side surfaces of each of the support member 35, and the elevation device 51 may also be disposed at a center of each of both side surfaces of support member 35 to allow the support member 35 to be stably elevated without being tilted.

In addition to the foregoing embodiments, various embodiments may be exemplified.

Hereinafter, another embodiments will be described with reference to the accompanying drawings. In the other embodiments of the present disclosure, the same reference numerals are used for the same components as those of the above-described embodiments, and a detailed description thereof will be omitted.

Figure 58:
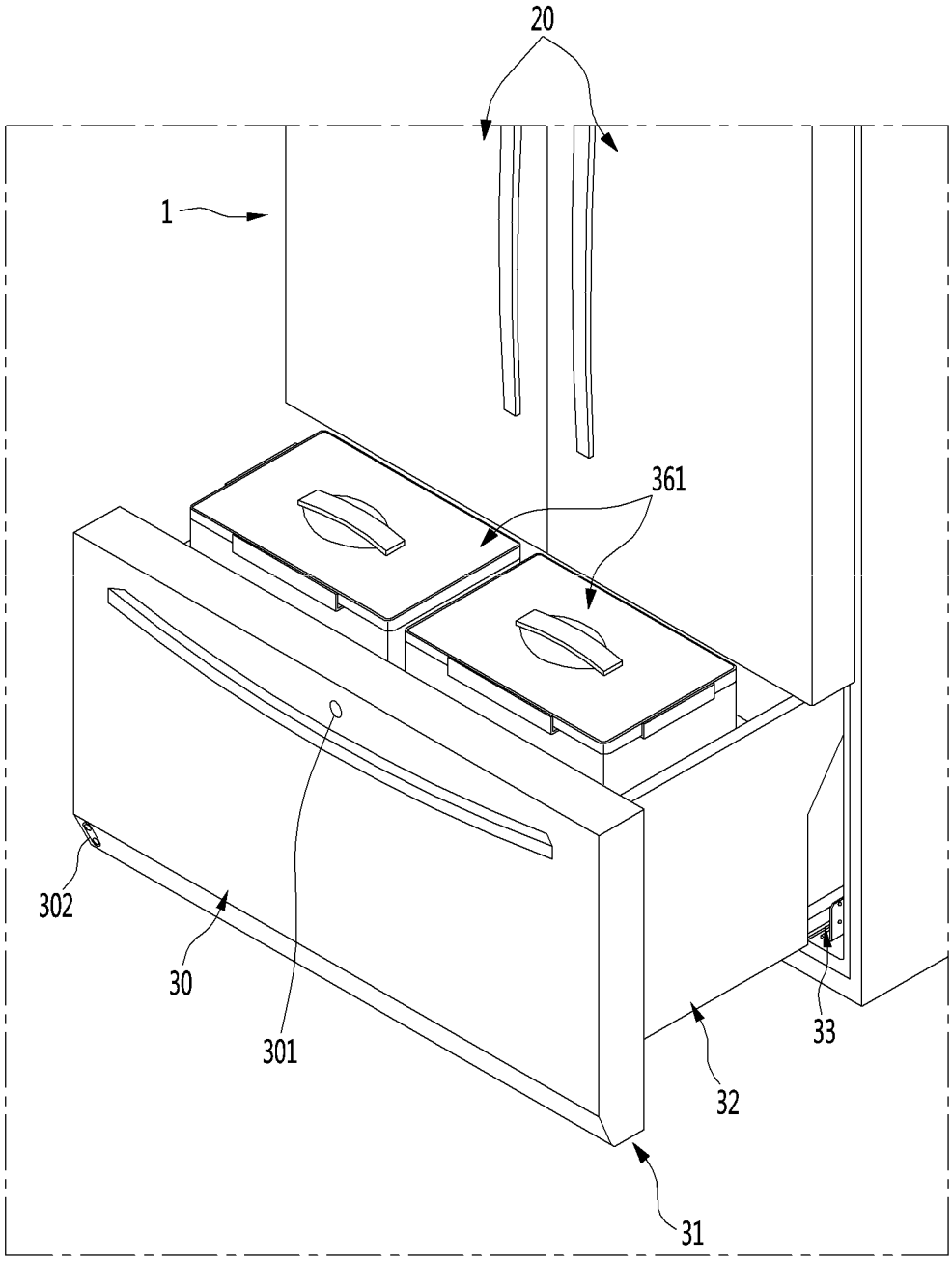
FIG. 58 is a perspective view of a refrigerator according to a fifth embodiment.

FIG. 58 is a perspective view of a refrigerator according to a fifth embodiment.

As illustrated in the drawing, a refrigerator 1 according to another embodiment may include a cabinet 10 having a storage space that is vertically partitioned and a door 2 opening and closing the storage space.

The door 2 may include a rotation door 20 which is provided in an upper portion of a front surface of the cabinet 10 to open and close an upper storage space and a drawer door 30 disposed in a lower portion of the front surface of the cabinet 10 to open and close a lower storage space. The drawer door 30 may be inserted and withdrawn forward and backward like the foregoing embodiment. In the state in which the drawer door 30 is withdrawn, the support member 35 within the drawer door 30 may be vertically elevated.

A manipulation part 301 or a manipulation device 302 may be provided at one side of the front panel door part 31. The insertion and withdrawal of the drawer door 30 and/or the elevation of the support member 35 may be realized by manipulating the manipulation part 301 or the manipulation device 302.

The support member 35 may be provided in the drawer part 32. The support member 35 may be elevated by driving the elevation assembly provided in the front panel door part 31 and the drawer part 32. Since the structure of the drawer door 30 and the structure of the elevation assembly 40 are the same as those according to the foregoing embodiment, their detailed descriptions will be omitted.

A plurality of containers 361 may be provided in the support member 35. The container 361 may be a sealed container such as a kimchi passage, and a plurality of the containers 361 may be seated on the support member 35. The container 361 may be elevated together with the support member 35 when the support member 35 is elevated. Thus, in the state in which the container 361 ascends, at least a portion of the drawer part 32 may protrude, and thus, the user may easily lift the container 361.

The support member 35 may interfere with the rotation door 20 in the rotation door 20 is opened even though the drawer door 30 is withdrawn. Thus, the support member 35 may ascend in a state in which the rotation door 20 is closed. For this, a door switch for detecting the opening/closing of the rotation door 20 may be further provided.

Figure 59:
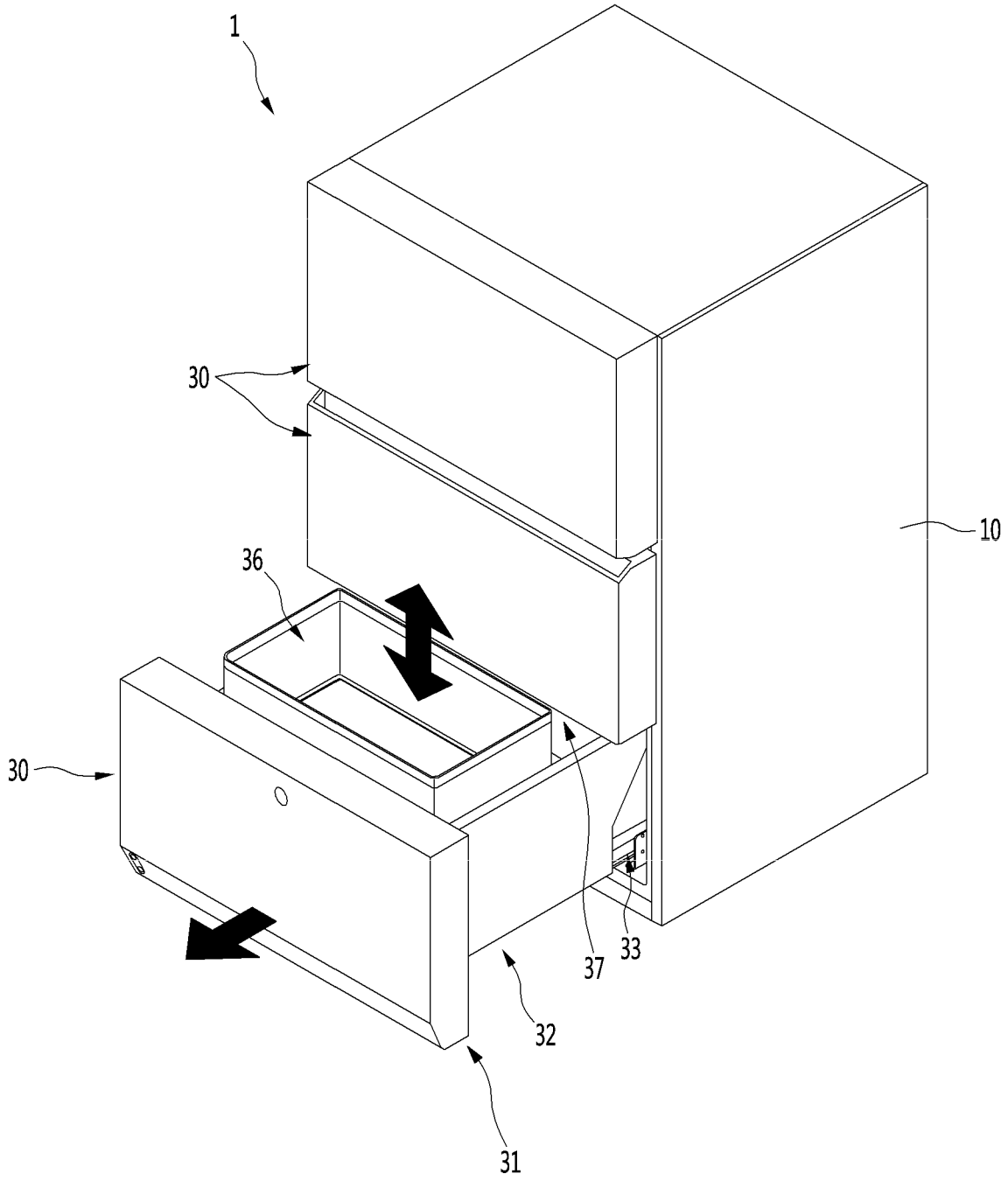
FIG. 59 is a perspective view of a refrigerator according to a sixth embodiment.

FIG. 59 is a perspective view of a refrigerator according to a sixth embodiment.

As illustrated in the drawings, a refrigerator 1 according to another embodiment includes a cabinet 10 defining a storage space therein and a door 2 opening and closing an opened front surface of the cabinet 10, which define an outer appearance of the refrigerator 1.

The door 2 may include a drawer door 30 that defines an entire outer appearance of the refrigerator 1 in a state in which the door 2 is closed and is withdrawn forward and backward. A plurality of drawer doors 30 may be continuously disposed in a vertical direction. The drawer doors 30 may be independently inserted and withdrawn by user's manipulation. A support member 35 within the drawer door 30 may be elevated. The insertion and withdrawal of the drawer door 30 and the elevation of the support member 35 may be individually performed. After the drawer door 30 is withdrawn, the support member 35 may ascend. Then, after the support member descends, the insertion of the drawer door 30 may be continuously performed.

Also, when the plurality of drawer doors 30 are vertically arranged, the support member 35 inside the drawer door 30, which is relatively downwardly disposed, may be prevented from ascending in a state where the drawer door 30 is relatively drawn upward. Thus, the drawer door 30 may be prevented from interfering with the drawer door 30 in which the food and container are withdrawn upward.

Also, although the support member 35 ascends in the state in which the drawer door 30 that is disposed at the uppermost side is withdrawn in FIG. 24, all of the drawer doors 30 disposed at the upper side may also be elevated by the support members 35 provided inside.

If a height of each of the drawer doors 30 disposed at the upper side is sufficiently high, only the drawer door 30 disposed at the lowermost position or the support member 35 of the plurality of drawer doors 30 disposed relatively downward may be elevated.

Figure 60:
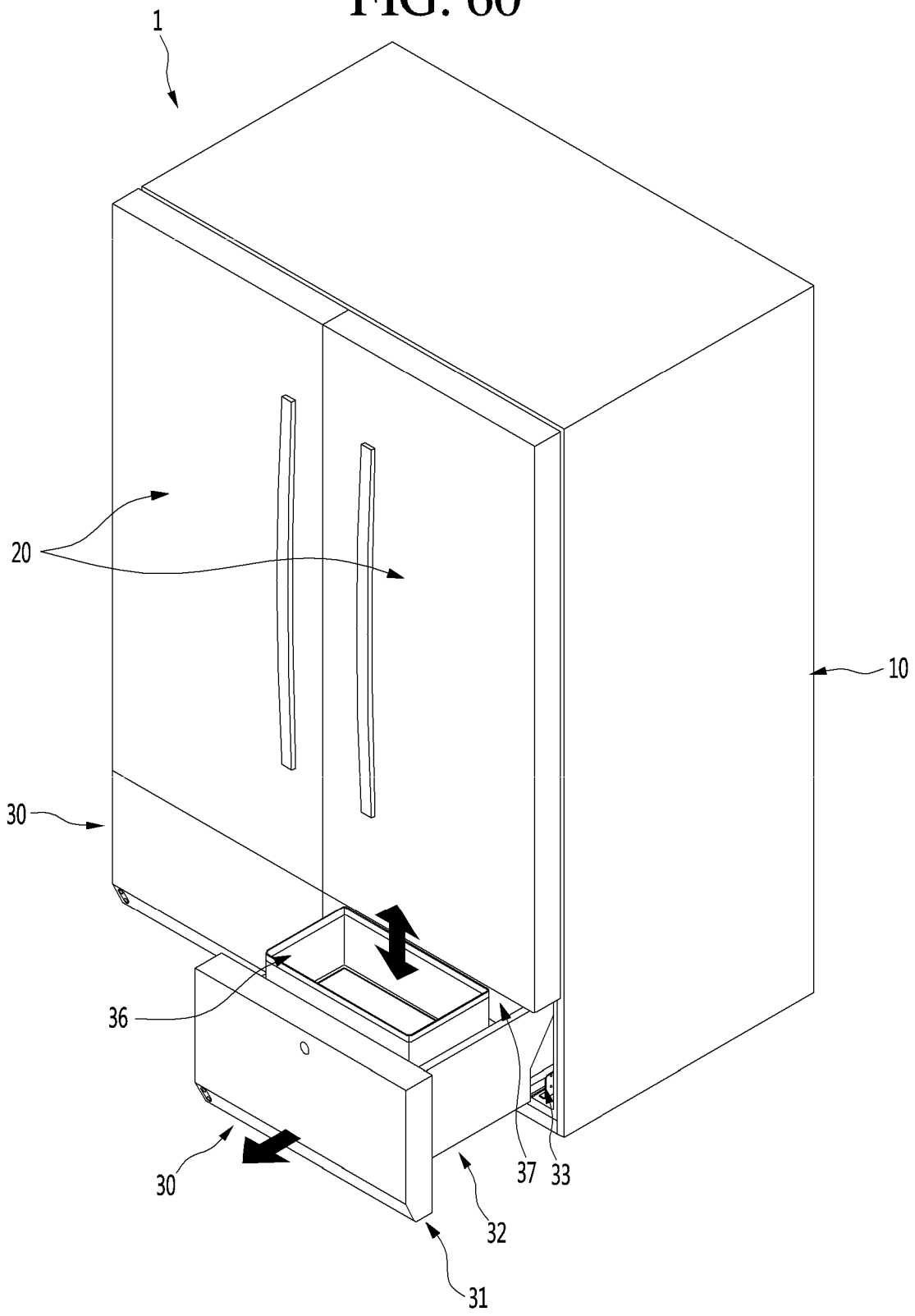
FIG. 60 is a perspective view of a refrigerator according to a seventh embodiment.

FIG. 60 is a perspective view of a refrigerator according to a seventh embodiment.

As illustrated in the drawings, a refrigerator 1 according to another embodiment includes a cabinet 10 defining a storage space therein and a door 2 opening and closing an opened front surface of the cabinet 10, which define an outer appearance of the refrigerator 1.

The inside of the cabinet 10 may be divided into an upper space and a lower space. If necessary, the upper and lower storage spaces may be divided again into left and right spaces.

The door 2 may include a rotation door 20 which is provided in an upper portion of the cabinet 10 to open and close the upper storage space and a drawer door 2 disposed in a lower portion of the cabinet 10 to open and close the lower storage space.

Also, the lower space of the cabinet may be divided into left and right spaces. The drawer door 30 may be provided in a pair so that the pair of drawer doors 30 respectively open and close the lower spaces. The pair of drawer doors 30 may be disposed in parallel to each other at left and right sides. The drawer doors 30 may have the same structure.

The drawer door 30 may have the same structure as the drawer door according to the foregoing embodiment. Thus, the drawer door 30 may be inserted and withdrawn by user's manipulation. In the drawer door 30 is withdrawn, the support member 35 may ascend so that a user more easily accesses a food or container within the drawer door 30.

Various embodiments in addition to the foregoing embodiments may be provided.

A refrigerator according to an embodiment may include a cabinet defining a storage space, a drawer door opening and closing the storage space and having an accommodation space of which a top surface is opened, a draw-out rail connecting the drawer door to the storage space to guide insertion and withdrawal of the drawer door, a support member provided in the accommodation part to support a food and a container, and an elevation assembly disposed on each of both side surfaces of the drawer door and coupled to each of both ends of the support member to vertically elevate the support member in the state in which the drawer door is withdrawn.

The drawer door may include a front panel door part opening and closing the storage space and having an outer appearance that is exposed forward and a drawer part coupled to a rear surface of the door part to define the accommodation space. The elevation assembly may include a door-side device provided in the door part and including an elevation motor for elevating the support member and a drawer-side device provided in the drawer part and connected to the door-side device to elevate the support member by power supplied from the door-side device.

The door part and the drawer part may be detachable. A door-side connection member exposed to a rear surface of the door part and rotating by the elevation motor may be provided in the door-side device, and a drawer-side connection member exposed to a front surface of the drawer part and coupled to the door-side connection member when the drawer part is coupled to rotate together.

The door-side devise may include an elevation motor providing the power and a door-side shaft connected to the elevation motor to transmit the power of the elevation motor to the drawer-side device disposed on both the sides.

The door shaft may be connected to each of both sides of the elevation motor to allow both the door shafts to rotate at the same time.

The elevation motor may be provided in a pair, and the door shaft may be connected to each of the elevation motors.

The drawer door may include a drawer body made of a plastic material and including a mounting part on which the support member is mounted and a plurality of metal plates mounted on inner and outer surfaces of the drawer body to define an outer appearance and covering the support member.

The support member may include a pair of elevation shafts rotatably mounted on both side surfaces of the drawer door to vertically extend and having a screw thread on an outer circumferential surface thereof, a shaft holder mounted to pass through the elevation shaft and having one side connected to a side end of the support member to vertically move along the elevation shaft when the elevation shaft rotates, and an elevation rail connected to an inner surface of the drawer door and both sides of the support member and disposed in parallel to the elevation shaft to vertically extend in multistage.

A mounting part in which the elevation shaft and the elevation rail are accommodated may be provided in the inner surface of the drawer door.

Each of upper and lower ends of the elevation shaft may be rotatably supported inside the mounting part, and the elevation rail may extend upward to pass through a top surface of the mounting part when the support member ascends.

A connecting bracket may be mounted on each of both side surfaces of the support member, and the shaft holder and the elevation rail may be fixed and mounted on the other surface of the connecting bracket.

A shaft mounting part on which the drawer-side shaft transmitting the power for the rotation of the shaft is mounted may be provided on an outer surface of the drawer door, and the mounting part and the shaft mounting part may be opened to communicate with each other. The drawer-side shaft and the elevation screw may be gear-coupled to each other to cross each other.

The connecting bracket may be made of a plate-shape material, and a holder opening having a shape corresponding to the shaft holder may be defined in the connecting bracket. The shaft holder may be inserted into and mounted inside the holder opening.

The elevation rail may be mounted to pass through a center of the connecting bracket, and the holder opening may be defined with the same shape in both sides with respect to the elevation rail.

The holder opening may be defined to pass through the holder bracket, and a holder support extending toward the elevation shaft to support a top surface of the shaft holder may be disposed on one end of the holder opening.

A recess part in which the elevation shaft is accommodated may be defined in an end of the holder support part.

A side cover extending upward to be elevated together with the support member and covering the elevation shaft and the elevation rail may be provided on each of both side surfaces of the support member.

An upper end of the side cover may be bent outward to define a portion of the top surface of the drawer door and cover an upper end of the elevation rail.

The accommodation space of the drawer door may include a front space in which the support member is provided and a rear space defined behind the front space. The draw-out rail may be completely exposed through the front space, and the rear space may have a draw-out distance so as to be disposed in the cabinet.

A drawer cover mounted inside the drawer door to partition the inner space into the front space and the rear space and cover a top surface of the rear space may be provided in the rear space.

A refrigerator according to an embodiment may include a cabinet in which an upper storage space and a lower storage space are defined, a front panel door part inserted and withdrawn to open and close the lower storage space, a drawer part connected to the door part so as to be inserted into and withdrawn from the lower storage space, a support member which is provided in the drawer part and on which a food or container is seated, a motor assembly provided in the door part to provide power; and an elevation device extending from each of both side surfaces of the drawer part in a direction crossing the draw-out direction of the door and coupled to both sides of the support member to elevate the support member by the power transmitted from the motor assembly.

The drawer part may include at least a bottom surface; and a side surface part vertically extending from each of both side ends of the bottom surface, wherein the elevation device may be disposed on the side surface part.

A mounting part recessed to accommodate the elevation device may be provided inside the drawer part.

The elevation device may include a housing mounted on an inner surface of the drawer part; an elevation shaft which is mounted to be rotatable by the power transmitted from the motor assembly inside the housing and on which a screw thread is disposed on an outer circumferential surface thereof, a shaft holder penetrated by the elevation shaft inside the housing and elevated along the elevation shaft, and a connecting bracket connecting each of both ends of the support member to the shaft holder. The shaft holder may be connected to each of both ends of the support member so as to be elevated together with the support member.

A stepped space may be defined in an inner surface of the housing, and the shaft holder may have a shape corresponding to that of the stepped space.

The elevation device may further include a rolling member contacting an inner surface of the housing and an outer surface of the shaft holder between the housing and the shaft holder to guide the elevation of the shaft holder.

The housing may include a central part recessed at a position corresponding to the elevation shaft and a side part stepped with respect to the central part at each of both sides of the central part to accommodate both the sides of the shaft holder. The rolling member may be disposed in the side part.

The shaft holder may include a shaft through-part through which the elevation shaft passes and which is accommodated into the central part; an extension part extending to each of both sides of the shaft through-part and accommodated inside the side part to contact the rolling member, and a bracket mounting part protruding to the outside of the housing and connected to the support member.

A connecting bracket connecting the support member to the shaft holder may be mounted on the bracket mounting part, and the connecting bracket may include a rail coupling part coupled to the bracket mounting part by a separate coupling member and a support member coupling part which is disposed on a lower end of the rail coupling part and on which the support member is detachably seated.

A rail cover mounted to pass through a vertically opened space inside the shaft holder and covering an opening of the housing may be provided, and the shaft holder may vertically move along the rail cover.

A plurality of plates made of the same material as the rail cover to define an outer appearance of the drawer part may be provided in inner and outer surfaces of the drawer part.

The support member may include an elevation frame of which each of both side surfaces is connected to the elevation device and which has a frame shape corresponding to a shape of a bottom surface of the drawer part.

The support member may include a plate-shaped elevation plate mounted on the elevation frame to cover the frame.

The drawer part may have a box shape having an opened top surface so that the support member is accommodated therein.

The inside of the drawer part may be divided into a front space which is defined at a front side with respect to a front and rear direction in which the door is inserted and withdrawn and in which the support member is disposed and a rear space defined behind the front space. The drawer part may be withdrawn so that the front space is disposed outside the lower storage space. Here, at least a portion of the rear space may be disposed inside the lower storage space.

A refrigerator according to an embodiment may include a cabinet in which an upper storage space and a lower storage space are defined, a front panel door part opening and closing the lower storage space, a drawer part connected to the door part so as to be inserted into and withdrawn together with the door part, a support member which is provided in the drawer part and on which a food or container is seated, a motor assembly provided in the door part; a pair of elevation device coupled to both ends of the support member to elevate the support member, and a pair of drawer-side shafts extending from one end of the drawer part facing a rear surface of the door part so as to be connected to the elevation device and transmitting power of the motor assembly to the elevation device.

The motor assembly may be provided in a pair, and the pair of motor assemblies may be respectively disposed on both sides of the rear surface of the door so as to be respectively connected to the pair of drawer-side shafts.

A door-side shaft rotatably connected to the motor assembly and connected to each of the drawer-side shafts to transmit the power of the motor assembly may be further provided.

The door-side shaft may be provided as one shaft to pass through the motor assembly. Each of both ends of the door-side shaft may be connected to the drawer-side shaft to rotate at the same rotation number at the same time.

The end of the door-side shaft and the drawer-side shaft may be disposed in perpendicular to each other and connected by gears engaged to rotate to rotate at the same time.

The elevation device may include a housing mounted on an inner wall of the drawer part, an elevation shaft which is rotatably disposed, on which a screw thread is disposed on an outer circumferential surface, and which extend in a vertical direction, and a shaft holder mounted to be elevated along the elevation shaft inside the housing and connected to each of both ends of the support member.

A drawer-side gear may be disposed on one end of the drawer-side shaft, and an elevation gear may be disposed on the elevation shaft. The drawer-side gear and the elevation gear may be gear-coupled to each other in a direction in which the drawer-side gear and the elevation gear cross each other inside the housing.

An insertion opening having a shape corresponding to each of the drawer-side shaft and the drawer-side gear may be defined in the housing so that the elevation gear is coupled to the drawer-side gear inside the housing.

A shaft mounting part on which the drawer-side shaft is mounted may be disposed on an outer surface of the drawer part, and a mounting part on which the elevation device is mounted may be disposed on an inner surface of the drawer part. The shaft mounting part and the mounting part may communicate with each other so that the drawer-side shaft passes therethrough.

A plate having the form of a plate made of a metal material to define an outer appearance of each of an inner surface and an outer surface of the drawer part may be disposed on each of the inner surface and the outer surface of the drawer part, and the plate may cover the shaft mounting part, the mounting part, and the draw-out rail.

A refrigerator according to an embodiment may include a cabinet in which an upper storage space and a lower storage space are defined, a front panel door part inserted and withdrawn to open and close the lower storage space, a drawer part connected to the door part so as to be inserted into and withdrawn from the lower storage space, a support member which is provided in the drawer part and on which a food or container is seated, a motor assembly provided in the door part to provide power; an elevation device provided on each of both sides of the inside of the drawer part so as to be elevated by the power transmitted from the motor assembly, a connecting bracket mounted on the elevation device and coupled to each of both side surfaces of the support member so as to be elevated together with the support member, and inner plate mounted on an inner surface of the drawer part to cover the elevation device. An elevation guide part through which the connecting bracket connected to the support member passes may be disposed on the inner plate.

The elevation device may include a housing mounted on an inner surface of the drawer part; an elevation shaft which is mounted to be rotatable by the power transmitted from the motor assembly inside the housing and on which a screw thread is disposed on an outer circumferential surface thereof; and a shaft holder penetrated by the elevation shaft inside the housing and elevated along the elevation shaft. The shaft holder may be coupled to the connecting bracket.

The connecting bracket may include a rail coupling part and coupled to the shaft holder and a support member coupling part disposed on each of both ends of the rail coupling part and coupled to each of both ends of a side surface of the support member.

The support member coupling part may pass through the elevation guide part and be exposed to the inside of the drawer part, and the elevation guide part may be opened in the elevation direction to guide the movement of the support member coupling part.

The support member coupling part may include an extension part passing through the elevation guide part and a restriction part protruding from an end of the extension part toward the support member and coupled to the support member.

The elevation guide may vertically extend from each of front and rear ends of both side surfaces of the front space.

An insertion part into which one side of the connecting bracket is inserted and coupled to the support member may be provided on each of the front and rear ends of the side surface of the support member.

Plates made of the same material as the inner plate to define inner and outer appearances of the drawer part may be further provided on an outer surface of the drawer part and front, bottom, and rear surfaces of the inner surface of the drawer part.

The support member may include a support plate which has a plate shape to cover a lower side of the drawer part and on which a food or container is seated and a support frame disposed below the support plate to support the support plate.

The connecting bracket may pass through an insertion part that is opened in a side surface of the support plate and be coupled to a frame support part of the support frame.

The insertion part may be opened from a lower end of a side surface of the support plate, and the support plate may be separated upward in a state in which the connecting bracket and the support frame are coupled to each other.

The following effects may be expected in the refrigerator according to the proposed embodiments.

The refrigerator according to the embodiment, the portion of the storage space within the drawer door may be elevated in the state in which the drawer door is withdrawn. Thus, when the food is accommodated in the drawer door disposed at the lower side, the user may not excessively turn its back to improve the convenience in use.

Particularly, in order to lift the heavy-weight food or the container containing the food, the user has to lift the food or container with a lot of power. However, the support member within the drawer door may ascend up to a convenient position by driving the elevation assembly to prevent the user from being injured and significantly improve the convenience in use.

Also, the support member on which the food or the container is seated may be disposed in the drawer door, and the elevation assembly may be provided on both the sides of the drawer door to elevate the support member. Thus, the support member may be elevated in the state in which both ends of the support member are supported. Thus, the support member may be prevented from being eccentric or tilted to secure the stable elevation and the operation reliability.

Also, the elevation assembly for transmitting the power may be disposed on each of both the sidewall surfaces of the accommodation space to minimize the loss of the storage space. Particularly, the elevation assembly for transmitting the power may be disposed in the region in which the flange on both sidewall surfaces of the accommodation space is disposed to minimize the loss of the storage space without requiring the additional space for disposing the elevation assembly.

Also, the support member may constitute a portion of the space within the drawer part and be disposed in the front space of the drawer part to elevate the support member in the state in which the drawer part is withdrawn so that only the front space is disposed to the outside without withdrawing the entire drawer part. Thus, the instability due to the excessive withdrawal of the drawer part may be solved, and the additional constituent for supporting the load may be unnecessary, and also, the loss of the cold air to the outside due to the withdrawal of the entire drawer part may be prevented.

Also, the drawer door may include the door part defining the front surface of the door and the drawer part defining the accommodation space, and the door part and the drawer part may be coupled to be separated from each other. Also, the support member may include the door-side device provided in the door part and the drawer-side device provided in the drawer part. When the door part and the drawer part are coupled to each other, the door-side device and the drawer-side device may be connected to each other to transmit the power. Thus, the assemblability and the service performance of the drawer door may be improved.

Also, the electrical device, to which the power is supplied, such as the elevation motor may be disposed in the door-side device, and only the mechanism-side of the drawer-side device may be disposed to secure the user's safety. Also, the separation of the drawer par and the arrangement of the electrical device may be performed on the drawer part to improve the cleanability of the drawer part.

Also, the drawer-side device disposed in the drawer part may be connected to the center of both the ends of the support member that is elevated in the drawer part. Thus, the support member may not be lean or tilted to one side until the food and the container, which are accommodated in the drawer part. Thus, the support member may be stably elevated.

Also, the elevation device constituting the drawer-side device may transmit the power and also be prevented from moving in the front/rear and left/right directions to more stably elevate the support member.

Also, the support member may include the elevation screw and the screw holder, which are connected to the support member to elevate the support member. The elevation rail may be disposed in parallel to the elevation screw to more stably elevate the support member so that the support member is stably elevated even through the heavy food or container is accommodated.

Particularly, the connecting bracket having one side to which the screw holder and the elevation rail are coupled and the other side to which the support member is coupled may be disposed on each of both the sides of the support member to allow the support member to be more stably elevated without being tilted.

Also, the side cover covering the elevation screw and the elevation rail may be disposed on each of both the sides of the support member. Particularly, the structures for mounting the elevation screw and the elevation rail in addition to the elevation screw and the elevation rail may be covered while being elevated together with the support member when the support member is elevated, thereby improving the outer appearance of the drawer door and preventing the safety problem such as the catching of the user's body or food from occurring.

Also, the assembly cover defining the outer appearance may be further provided on the elevation assembly mounted inside the drawer part. The assembly cover may be made of the metal material and bent in several times to define the slot in the elevation assembly. Thus, it may be possible to improve the appearance of the storage space inside the drawer door by making the inside of the elevation assembly and the inside of the elevation slot look the same when viewed from the outside.

Also, each of the elevation slots may be defined in each of the left and right sides so as to minimize the width thereof and prevent the safety problems such as the catching of the user's body or food from occurring.

The inner plate of the plurality of plates may be disposed on both the side surfaces of the inside of the drawer part. The elevation guide part through which the connecting bracket passes may be provided on the inner plate. The elevation guide part may be disposed on the edge portions of the front and rear ends of the front space so as not be visible to the user as if the entire inside of the drawer part is made to appear to be constituted by the plurality of plates, thereby more improving the outer appearance.

Also, the connecting bracket connecting the support member to the elevation device may pass through the elevation guide disposed on the inner plate and be connected to each of both the side ends of the support member so that the support member is stably elevated in the horizontal state as a whole without being tilted.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines an upper storage space and a lower storage space;

a front panel door part that is configured to open and close the lower storage space and that is configured to move toward and away from the lower storage space;

a drawer part that is connected to the front panel door part, that is configured to insert into the lower storage space based on the front panel door part moving toward the lower storage space, and that is configured to withdraw from the lower storage space based on the front panel door part moving away from the lower storage space;

a support member located in the drawer part and configured to seat an object stored in the drawer part;

an elevation device that is coupled to each of both sides of the support member and that is configured to elevate the support member relative to a bottom surface of the drawer part;

a mounting part that is recessed from each of both inner surfaces of the drawer part and that accommodates the elevation device;

a side cover that is disposed inside of the drawer part and that covers the mounting part and the elevation device;

a draw-out detection device disposed on the cabinet or the drawer part and configured to detect whether the drawer part is withdrawn from the lower storage space or inserted into the lower storage space; and a height detection device configured to detect a vertical position of the support member.

2. The refrigerator according to claim 1, wherein a size of the side cover corresponds to a size of the mounting part to cover the mounting part.

3. The refrigerator according to claim 1, wherein the mounting part vertically extends upward with respect to the bottom surface of the drawer part.

4. The refrigerator according to claim 1, wherein the elevation device is disposed inside of the mounting part, and the support member is configured to be elevated without interference with the elevation device.

5. The refrigerator according to claim 1, wherein the mounting part comprises an opening defined at a top surface of the drawer part.

6. The refrigerator according to claim 5, wherein an upper end of the side cover is bent outward to cover the opening defined at the top surface of the drawer part.

7. The refrigerator according to claim 1, wherein the inner surfaces of the drawer part comprise one or more plates made of a metal material, and wherein the side cover is made of the metal material or a material having a metal texture.

8. The refrigerator according to claim 1, further comprising a drawer cover that is located in the drawer part and that is configured to partition an inside of the drawer part into (i) a front space in which the support member and the elevation device are disposed and (ii) a rear space that is located rearward of the front space.

9. The refrigerator according to claim 8, wherein the drawer cover comprises:

a cover front surface part that is configured to partition the inside of the drawer part into the front space and the rear space; and a cover top surface part that extends rearward from an upper end of the cover front surface part to a rear end of the drawer part and that is configured to cover a top portion of the rear space.

10. The refrigerator according to claim 1, further comprising a motor assembly that is located in the front panel door part and that is configured to generate power to provide a rotational force to the elevation device, wherein the elevation device is configured to be elevated by the rotational force transmitted from the motor assembly.

11. The refrigerator according to claim 1, wherein the elevation device comprises:

a pair of elevation shafts rotatably mounted on a first side surface of the drawer part and a second side surface of the drawer part, respectively, each elevation shaft extending in a vertical direction and defining a screw thread on an outer surface thereof;

at least one elevation shaft holder that is penetrated by the pair of elevation shafts and that is configured to move in the vertical direction along each of the pair of elevation shafts based on rotation of the pair of elevation shafts;

at least one elevation rail that extends in parallel to the pair of elevation shafts and that is disposed at inner surfaces of the drawer part, the at least one elevation rail comprising multistage sliding rails that are configured to extend and contract based on the at least one elevation shaft holder moving along of the pair of elevation shafts; and at least one connecting bracket that is coupled to the at least one elevation shaft holder and the at least one elevation rail and that is fixed to each of a first side of the support member and a second side of the support member, wherein the at least one elevation shaft holder is configured to elevate the at least one connecting bracket to cause the support member to elevate relative to the bottom surface of the drawer part, and wherein the at least one elevation rail is configured to guide movement of the at least one connecting bracket in the vertical direction.

12. The refrigerator according to claim 1, wherein the side cover is mounted on the elevation device.

13. The refrigerator according to claim 1, wherein the elevation device is configured to start elevating the support member relative to the bottom surface of the drawer part based on the drawer part being completely withdrawn from the lower storage space.

14. The refrigerator according to claim 1, further comprising a magnet disposed at the drawer part or the cabinet, wherein the draw-out detection device comprises a detection sensor configured to detect the magnet.

15. The refrigerator according to claim 14, wherein the magnet is disposed at the bottom surface of the drawer part, and the detection sensor is disposed at the cabinet.

16. The refrigerator according to claim 14, wherein the magnet comprises:

a first magnet configured to face the draw-out detection device based on the drawer part being inserted into the lower storage space; and a second magnet configured to face the draw-out detection device based on the drawer part being withdrawn from the lower storage space.

17. The refrigerator according to claim 1, wherein the height detection device comprises a detection sensor configured to detect a magnet.

18. The refrigerator according to claim 1, wherein the height detection device is disposed at the front panel door part.

19. The refrigerator according to claim 1, wherein the height detection device is disposed at the front panel door part, the height detection device comprising:

a first height detection device disposed at a first height corresponding to an uppermost ascending position of the support member; and a second height detection device disposed at a second height corresponding to a lowermost descending position of the support member.

* * * * *